US007419150B2

(12) United States Patent
Kushida et al.

(10) Patent No.: US 7,419,150 B2
(45) Date of Patent: Sep. 2, 2008

(54) SHEET STACKING APPARATUS, SHEET PROCESSING APPARATUS AND IMAGE FORMING APPARATUS

(75) Inventors: Hideki Kushida, Moriya (JP); Daisaku Kamiya, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 78 days.

(21) Appl. No.: 11/442,322

(22) Filed: May 30, 2006

(65) Prior Publication Data

US 2006/0279037 A1 Dec. 14, 2006

(30) Foreign Application Priority Data

Jun. 10, 2005 (JP) ..... 2005-171720
Aug. 15, 2005 (JP) ..... 2005-235556
Mar. 31, 2006 (JP) ..... 2006-096492

(51) Int. Cl.
*B65H 37/04* (2006.01)

(52) U.S. Cl. ..... 270/58.07; 270/58.08; 270/58.11; 270/58.12; 270/58.27

(58) Field of Classification Search ..... 270/58.07, 270/58.08, 58.11, 58.12, 58.27; 271/220, 271/221

See application file for complete search history.

(56) References Cited

U.S. PATENT DOCUMENTS 5,419,545 A * 5/1995 Hutson ..... 271/222
5,467,974 A * 11/1995 Ishiwata et al. ..... 271/220
6,145,825 A 11/2000 Kunihiro et al. ..... 270/58.09
6,412,774 B1 * 7/2002 Saito et al. ..... 271/220
6,427,997 B1 * 8/2002 Hirota et al. ..... 270/58.12
6,601,846 B2 * 8/2003 Saito et al. ..... 271/226
6,634,641 B2 * 10/2003 Yamakawa et al. ..... 271/220
7,014,183 B2 * 3/2006 Tamura et al. ..... 270/58.09
7,152,856 B2 12/2006 Kamiya et al. ..... 270/37
2002/0113362 A1 * 8/2002 Saito et al. ..... 271/207
2005/0082735 A1 4/2005 Nakamura et al. ..... 271/1
2005/0084308 A1 4/2005 Nakamura et al. ..... 399/407
2005/0179190 A1 8/2005 Kamiya et al. ..... 270/58.07
2006/0017209 A1 1/2006 Kushida et al. ..... 270/37
2006/0017218 A1 1/2006 Kawata et al. ..... 271/207
2006/0019811 A1 1/2006 Ikeda et al. ..... 493/444
2006/0061032 A1 3/2006 Kamiya et al. ..... 271/221
2006/0208411 A1 * 9/2006 Saito et al. ..... 270/58.07
2006/0214346 A1 * 9/2006 Terao et al. ..... 270/58.08
2007/0035082 A1 2/2007 Kushida ..... 270/58.12
2007/0057425 A1 3/2007 Kamiya ..... 270/52.18

FOREIGN PATENT DOCUMENTS

JP 11-130338 5/1999

* cited by examiner

*Primary Examiner*—Gene O. Crawford
*Assistant Examiner*—Leslie Nicholson, III
(74) *Attorney, Agent, or Firm*—Fitzpatrick, Cella, Harper & Scinto

(57) ABSTRACT

A sheet stacking apparatus includes an intermediate process tray stacked with sheets, a trailing end lever movable upward from a pressing position in which to press the sheets on the intermediate process tray, a lever stopper regulating the upward movement of the trailing end lever, and an adjusting mechanism changing the regulating position of the trailing end lever by the lever stopper in accordance with a sheet stacking height of the sheets stacked on the intermediate process tray, wherein the adjusting mechanism keeps substantially constant a distance to the regulating position from the pressing position of the trailing end lever irrespective of the sheet stacking height of the sheets stacked on the intermediate process tray.

25 Claims, 49 Drawing Sheets

FIG. 43

| ELEVATION OF TRALING END LEVER (mm) | SHEET COUNTER VALUES |
|---|---|
| 6 | 0~0.43 |
| 7 | 0.43~0.85 |
| 8 | 0.85~1.78 |
| 9 | 1.78~2.55 |
| 10 | 2.63~3.48 |
| 12 | 3.48~4.25 |
| 13 | 4.25~5.18 |
| 14 | 5.18~5.95 |
| 16 | 6.03~6.88 |
| 17 | 6.88~7.65 |
| 18 | 7.33~8.5 |

SHEET COUNTER VALUES

| | |
|---|---|
| THIN SHEET | 0.06 |
| NORMAL SHEET | 0.085 |
| LIGHT THICK SHEET | 0.1 |
| THICK SHEET | 0.21 |
| HEAVY THICK SHEET | 0.28 |

※ VALUES PER ONE SHEET

PULLBACK AREA CHART

SHEET STACKING APPARATUS, SHEET PROCESSING APPARATUS AND IMAGE FORMING APPARATUS

BACKGROUND OF THE INVENTION

1. Field of the Invention

The present invention relates generally to a sheet stacking apparatus in which sheets are sequentially delivered to and stacked on a sheet stacking tray, and more particularly to a sheet stacking apparatus capable of guiding the sheets to a alignment stopper surface on the sheet stacking tray and pressing the sheets against on the sheet stacking tray by substantially constant pressing force irrespective of a sheet stacking height, also to a sheet processing apparatus of which an apparatus main body includes the present sheet stacking apparatus, and further to an image forming apparatus.

2. Related Background Art

An image forming apparatus that forms an image on a sheet, a binding device that binds a sheet bundle and a sheet processing apparatus that processes the sheets such as a punching apparatus that punches the sheet bundle, have hitherto included a sheet stacking apparatus sequentially stacked with the sheets. In this case, the majority of these apparatuses have a sheet tacking apparatus in which the sheets are stacked on the sheet stacking tray in a way that reduces floating of the sheet in consideration of curling of the sheet. Note that the image forming apparatus is exemplified such as a copying machine a laser beam printer, a facsimile and a multifunction apparatus having functions of these apparatuses.

A sheet stacking apparatus 1302 shown in FIG. 45 is provided in a binding device 1300 for binding the sheets formed with images. This sheet stacking apparatus 1302 is constructed so that a sheet bundle is formed by sequentially stacking the sheets on an intermediate process tray 1330 defined as a sheet stacking tray provided within a binding device 1300, a stapler 1301 moving along an edge of the sheet bundle staples the sheet bundle at a plurality of points, and thereafter the stapled sheet bundle is delivered to a stack tray 1622 from the intermediate process tray 1330.

An operation of binding the unillustrated sheet bundle at two points, which is stacked on the intermediate process tray 1330, will be explained with reference to FIG. 46.

The sheets discharged out of the apparatus main body of the image forming apparatus are delivered sheet by sheet to the intermediate process tray 1330, and upstream-side ends (trailing ends) of the sheets in a sheet delivery direction are made to abut on an abutment support surface 1331*a* of a trailing end stopper 1331 by a pull-in paddle 1360 rotating in an arrow-headed direction and a knurled belt 1608 of a delivery roller 1320*a* configuring a first delivery roller pair 1320, thereby aligning the trailing ends of the sheets. Further, both sides of the sheets are widthwise aligned by first and second alignment members 1340, 1341 getting close to the sheets from the both sides of the sheets.

With a repetition of these operations, the plurality of sheets stacked on the intermediate process tray 1330 becomes a sheet bundle of which the trailing ends and the side ends are aligned. Thereafter, the on-standby stapler 1301 moves to first and second stapling positions along the trailing ends of the sheet bundle, and staples the sheet bundle in the respective stapling positions.

Thus, the sheet stacking apparatus 1302 including the intermediate process tray 1330 is configured in the way that alignment of the trailing end portions of the sheet involves pulling back the sheets toward the trailing end stopper 1331 by a pullback mechanism composed of the pull-in paddle 1360, the knurled belt 1608, etc and making the sheets abut on the trailing end stopper 1331. Normally, the sheet formed with a toner image might, however, change in its water content amount when the toner image is heated, pressurized and thus fixed by a fixing unit within the apparatus main body of the image forming apparatus, or depending on a using environment. Therefore, a buckling phenomenon occurs on the sheet. Namely, the sheet might be warped (curled).

The thus-curled sheet and a sheet that is small in thickness and low in rigidity are, when abutting on the trailing end stopper 1331 on the intermediate process tray 1330, buckled and disturb the alignment of the sheet bundle. Such being the case, the following configurations of the trailing end stopper are taken as measures against a failure of alignment of the sheets on the intermediate process tray 1330.

A trailing end stopper 1332 shown in FIG. 47 includes an abutting surface 1332*a* provided with a plurality of grooves 1332*b* and a plurality of protruded strip members 1332*c*, which prevent the sheet from being pushed up along the abutting surface 1332*a*.

A trailing end stopper 1333 shown in FIG. 48 includes a downwardly-inclined elastic film 1334 provided at an upper portion thereof, thereby invariably pressing the sheet trailing end portion against on the intermediate process tray 1330 (see FIG. 46).

A trailing end stopper 1335 shown in FIG. 49 includes a movable pressing member 1336 that presses the sheet in the vicinity of the trailing end stopper 1335. The pressing member 1336, after the sheets have abutted on the trailing end stopper 1335, presses the sheet bundle against on the intermediate process tray 1330, thereby flattening the sheets in a way that presses down the curled sheets (refer to Japanese Patent Application Laid-Open No. H11-130338).

The trailing end stopper 1332 illustrated in FIG. 47 takes a low-cost/space-saving structure with a small number of components, however, is unable to positively flatten the sheet by pressing the curl, since the curled sheet is held in an as-curled state by the grooves 1332*b* and the protruded strip members 1332*c*.

Further, such poor alignment property arose that a deviation occurs in the aligning position of the trailing end of the sheet due to recessed and protruded portions of the plurality of grooves 1332*b* and the plurality-of protruded strip members 1332*c*.

Further, when the widthwise alignment of the sheet is done by the first and second alignment members 1340, 1341 (see FIG. 46), it follows that the sheet moves in the widthwise direction in a state where the trailing end of each sheet enters the recessed portion of the groove 1332*b* and the recessed portion between the protruded strip members 1332*c*. Consequently, frictional resistance occurs between the sheet railing end and the recessed portion and retards the widthwise movement of the sheet, and the sheet can not be aligned widthwise exactly. Moreover, when the number of stacked sheets increases, an excessive load is applied to a motor for moving the first and second alignment members 1340, 1341 due to the frictional resistance, which is a cause for deteriorating the widthwise alignment property.

The trailing end stopper 1333 shown in FIG. 48 has a simple structure including the elastic film 1334 and is capable of enhancing the alignment property of the trailing end of the sheet by pressing down the curled sheet. The elastic film 1334 has elasticity, and hence, when the number of the stacked sheets increases, the pressing force rises when the sheet enters. Conversely, if set so that the pressing force of the elastic film 1334 becomes proper when the number of the stacked sheets increases, the elastic film 1334 lacks the pressing force when the number of the stacked sheets decreases. Therefore, a relationship between the pressing force when the sheet enters and the pullback force of the knurled belt 1608 gets unstable.

For example, as shown in FIG. 50A, if the pressing force by the elastic film 1334 becomes larger than the pullback force of the knurled belt 1608 when the number of the stacked sheets rises, an upper sheet Pa is unable to reach the trailing end stopper 1333, and the alignment property of the sheet trailing end can not be enhanced. Further, as illustrated in FIG. 50B, when the number of the stacked sheets decreases, the pressing force by the elastic film 1334 becomes smaller than the pullback force of the knurled belt 1608, and almost no pressing force acts on the sheet. Hence, the sheet Pa might be pushed up and buckled along the abutting support surface 1333*a*. It is considered for preventing the buckling to increase the elastic force of the elastic film 1334. If the elastic force is increased, however, it follows that the phenomenon illustrated in FIG. 50A occurs also when the number of the stacked sheets decreases. Therefore, such a problem arises that a pullback optimal area depicted in a hatching portion in FIG. 51 is narrowed. Moreover, the buckling property and the pull back resistance change on a sheet-by-sheet basis depending on surface resistance based on a sheet material and on a difference in thickness, and hence it is highly difficult to have configurations flexible to various types of sheets.

Further, in the trailing end stopper 1335 shown in FIG. 49, the pressing member 1336 stands by in positions designated by Al, A2, A3 corresponding to a sheet stacking height in the vicinity of the trailing end stopper 1335 and descends, thus pressing the sheet P. Therefore, the pressing member 1336 stands by in any one of these positions, and, when a gap between the uppermost sheet and an undersurface 1336*a* of the pressing member 1336 gets narrowed due to the increase in the number of the stacked sheets, the largely curled sheet is hard to enter this gap and might be jammed therein.

Moreover, the pressing member 1336 is constructed to move up and down perpendicularly to the sheet in the vicinity of the trailing end stopper 1335. Hence, in a view of the trailing end stopper as viewed from the front surface thereof in FIG. 49, it is required that a position of the stapler 1301 (see FIG. 46) and a position of the pressing member 1336 be deviated in the right-and-left directions in FIG. 49. Accordingly, in order for the pressing member 1336 to press the most effective and closest portion to the trailing end stopper, the stapler 1301 must be retreated backward (on the right side in FIG. 49) not to interfere with the pressing member 1336 when the pressing member 1336 performs pressing or must be provided outside the stapling positions of the stapler in the direction perpendicular to the sheet surface in FIG. 49.

Moreover, the pressing member 1336 shown in FIG. 49, if scheming to press the entire sheet widthwise area, is upsized in the retreat configuration described above and is therefore often disposed at a central portion serving as a non-stapling area, wherein the pressing member 1336 is unable to press the both end portions of the sheet which correspond to the stapling positions, and there is a case of causing a decline of the alignment property about the both side ends of the trailing end of the sheet.

Further, when in a two-point stapling mode, the stapler passes through the central portion of the trailing end of the sheet and moves to the stapling positions on a deep side. Hence, if the pressing member 1336 is disposed at the central portion, after temporarily retreating backward (on the right side in FIG. 49), the stapler moves to a position that is not overlapped as viewed from the front surface and further moves on the deep side. Moreover, the operation is also the same when moving to an anterior side from the deep side. Therefore, the stapler moving mechanism is required to enable the stapler to move in biaxial (X-axis, Y-axis) directions, and consequently the structure gets complicated. Moreover, the stapler moves in the biaxial directions, so that staple processing time elongates. Still further, standby time of the image forming apparatus increases corresponding to this elongated processing time, and productivity for forming the images decreases. It should be noted that the sheet stacking apparatus illustrated in FIG. 49 configures, together with the stapler 1301, a sheet processing apparatus.

As discussed above, the conventional sheet stacking apparatus can not press the sheet bundle by the substantially constant pressing force irrespective of the sheet stacking height. The conventional sheet stacking apparatus can not restrain especially the curled sheet from floating.

Yet further, the sheet processing apparatus has such a problem that processing operation time is long in terms of a layout of the pressing member and the stapler of the sheet stacking apparatus.

SUMMARY OF THE INVENTION

It is an object of the present invention to provide a sheet stacking apparatus capable of pressing a sheet bundle by substantially constant pressuring force regardless of a sheet stacking height.

It is another object of the present invention to provide a sheet processing apparatus capable of reducing the sheet processing time by including the sheet stacking apparatus capable of surely processing the sheet bundle.

It is still another object of the present invention to provide a sheet processing apparatus that improves a sheet stacking property and a sheet alignment property of all types of sheets ranging from a thin sheet to a thick sheet without depending on thickness of the sheet by including the sheet stacking apparatus capable of surely processing the sheet bundle.

It is yet another object of the present invention to provide a sheet processing apparatus that improves the sheet stacking property and the sheet alignment property without depending on a curling direction and a size of the sheet by including the sheet stacking apparatus capable of surely processing the sheet bundle.

It is a further object of the present invention to provide an image forming apparatus that improves productivity of image formed sheets by including the sheet stacking apparatus capable of surely processing the sheet bundle.

To accomplish the above objects, a sheet stacking apparatus according to the present invention comprises a sheet stacking portion stacked with sheets, a sheet pressing member movable upward from a pressing position in which to press the sheets on the sheet stacking portion, a regulating member regulating the upward movement of the sheet pressing member, and an adjusting mechanism changing the regulating position of the sheet pressing member by the regulating member in accordance with a sheet stacking height of the sheets stacked on the sheet stacking portion, wherein the adjusting mechanism keeps substantially constant a distance to the regulating position from the pressing position of the sheet pressing member irrespective of the sheet stacking height of the sheets stacked on the sheet stacking portion.

The sheet stacking apparatus according to the present invention further comprises a stopper receiving and stopping trailing ends of the sheets stacked on the sheet stacking portion, and a sheet conveying guide provided on the side opposite to the stopper with the sheet pressing member being interposed therebetween and guiding the sheets to the stopper, wherein a distance between the sheet conveying guide and a sheet stacking surface of the sheet stacking portion is changed in linkage with a change of the regulating position of the sheet pressing member.

The sheet stacking apparatus according to the present invention further comprises a stopper receiving and stopping trailing ends of the sheets stacked on the sheet stacking portion, and a sheet conveying guide provided on the side opposite to the stopper with the sheet pressing member being interposed therebetween and guiding the sheets to the stopper, wherein a distance between the sheet conveying guide and a sheet stacking surface of the sheet stacking portion is changed in linkage with a change of the regulating position.

The sheet stacking apparatus according to the present invention further comprises a biasing member biasing the regulating member to the regulating position of the sheet pressing member, wherein the sheet pressing member can move the regulating member more upward than the regulating position, resisting the biasing member.

To accomplish the above objects, a sheet processing apparatus according to the present invention comprises a sheet stacking apparatus stacked with sheets and a binding unit binding upstream-side end portions, in a sheet delivery direction, of the sheets stacked in the sheet stacking portion of the sheet stacking apparatus, wherein the sheet stacking apparatus is any one of the sheet stacking apparatuses described above.

In the sheet stacking apparatus according to the present invention, a moving area of the sheet pressing member of the sheet stacking apparatus is set in a position that does not interfere with the binding unit.

In the sheet stacking apparatus according to the present invention, the binding unit is capable of adjusting a position in a direction intersecting the sheet delivery direction.

To accomplish the above objects, an image forming apparatus according to the present invention comprises an image forming portion forming an image on a sheet and a sheet stacking apparatus stacked with the sheets formed with the images by the image forming portion, wherein the sheet stacking apparatus is any one of the sheet stacking apparatuses described above.

To accomplish the above objects, an image forming apparatus according to the present invention comprises an image forming portion forming an image on a sheet and a sheet processing apparatus executing processing on the sheets formed with the images by the image forming portion stage, wherein the sheet processing apparatus is any one of the sheet processing apparatuses described above.

In the sheet stacking apparatus according to the present invention, the adjusting mechanism can keep substantially constant the distance from the pressing position of the sheet pressing member to the regulating position irrespective of the sheet stacking height of the sheets stacked on the sheet stacking portion. Therefore, in the sheet stacking apparatus, the sheet pressing member can press the sheet bundle by the substantially constant pressing force irrespective of the sheet stacking height.

In the sheet stacking apparatus according to the present invention, in combination with the sheet pressing member, the sheet alignment property with respect to the stopper can be enhanced by keeping substantially constant the distance between the sheet conveying guide and the sheet uppermost surface on the sheet stacking portion irrespective of the sheet height on the sheet stacking portion.

To be specific, the sheet stacking apparatus according to the present invention is configured so that for example, as shown in FIG. 44A, even if the sheet with its trailing end abutting on the stopper is upwardly curled, the sheet pressing member temporarily escapes upward, after receiving the sheet between the sheet pressing member and the sheet stacking portion, then descends and presses the sheet. Therefore, the sheet stacking apparatus according to the present invention is capable of enhancing the sheet alignment property even if the sheet is upwardly curled.

Further, the sheet stacking apparatus according to the present invention is configured so that for instance, as illustrated in FIG. 44B, even if the sheet with its trailing end abutting on the stopper is downwardly curled, in a position where the sheet conveying guide presses a vertex portion (a swollen portion) of a middle portion of the downward-curled sheet, the sheet abuts on the stopper while flattening the curled sheet. Therefore, the sheet stacking apparatus according to the present invention can enhance the sheet alignment property even if the sheet is downwardly curled.

Moreover, the sheet stacking apparatus is configured so that in the case of the sheet having a curling amount that is larger than an upward escapement (clearance) amount of the sheet pressing member, the sheet pressing member is regulated from moving upward and, after receiving the sheet being between the sheet pressing member and the sheet stacking portion in a way that restrains the sheet from being curled, presses the sheet. Hence, the sheet stacking apparatus according to the present invention can enhance the sheet alignment property even if the sheet has a large curling amount.

In the sheet stacking apparatus according to the present invention, the sheet pressing member is movable together with the regulating member more upward than the regulating position, resisting the biasing member. Therefore, the curl of the sheet having the large curling amount, since the sheet pressing member is moved more upward than the regulating position of the sheet pressing member, resisting the biasing member, is mended by resilience of the biasing member. Hence, the sheet stacking apparatus according to the present invention can enhance the sheet alignment property even if the sheet has the large curling amount.

The sheet processing apparatus according to the present invention includes the sheet stacking apparatus that enhances the sheet alignment property and can therefore execute the process of precisely binding the sheet bundle by the binding unit.

The image forming apparatus according to the present invention includes the sheet stacking apparatus that enhances the sheet alignment property and can therefore increase the productivity of forming the images on the sheets.

BRIEF DESCRIPTION OF THE DRAWINGS

FIG. 43 is a table showing a count value per sheet that is set according to a thickness of the sheet, and a displacement value of the lever stopper;

DETAILED DESCRIPTION OF THE PREFERRED EMBODIMENTS

Figure 1:
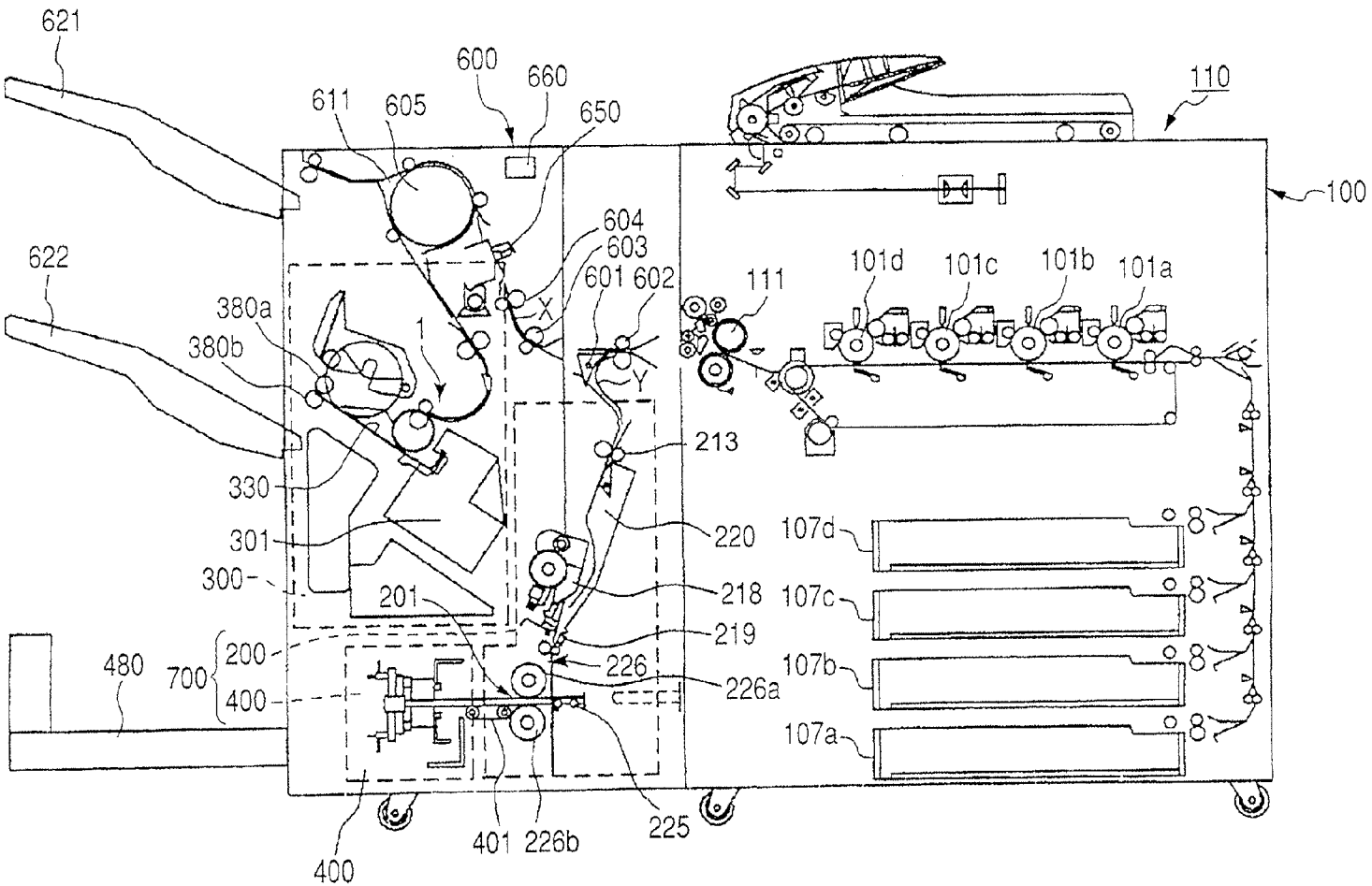
FIG. 1 is a sectional view of an image forming apparatus in an embodiment of the present invention as viewed in a sheet delivery direction.

A sheet stacking apparatus, a sheet processing apparatus and an image forming apparatus incorporating this sheet apparatus into an apparatus body in embodiments of the present invention, will hereinafter be described with reference to the drawings. It should be noted that numerical values taken in the description are reference numerical values but do not limit the present invention. Further, the components marked with the same reference numerals and symbols have the same configurations, and repetitive explanations thereof shall properly be omitted.

(Image Forming Apparatus)

A black-and-white/color copying machine 110 defined as an image forming apparatus will be explained with reference to FIG. 1. The black-and-white/color copying machine 110 includes a main body 100 of the black-and-white/color copying machine (which will hereinafter simply be termed [the copying machine]) and a finisher 600. The finisher 600 is connected to the main body 100 of the copying machine, and has a saddle stitch processing device 200, a side stitch processing device 300 defined as the sheet processing apparatus, and a sheet-bundle spine processing device 400. The saddle stitch processing device 200 and the sheet-bundle spine processing device 400 configure a saddle stitch bookbinding processing apparatus 700. Therefore, a sheet discharged from the copying machine main body 100 can be processed online. Note that the finisher 600 might be employed as an option. Hence, the copying machine main body 100 can be used as a single unit. Further, the finisher 600 and the main body 100 may be integrally configured (one united body).

Photosensitive drums 101*a* to 101*d* serving as image forming portions respectively for yellow, magenta, cyan and black, transfer four-color toner images onto the sheets supplied from cassettes 107*a* to 107*d* within the main body 100, and the image-transferred sheets are conveyed to a fixing unit 11 in which to fix the toner images and then discharged outside the copying machine.

(Finisher)

Referring to FIG. 1, the sheets discharged from the main body 100 of the copying machine are conveyed to the finisher 600. The finisher 600 executes a variety of sheet post-processes such as a process (a alignment process) of sequentially taking in the sheets discharged from the main body 100 of the copying machine and aligning the plurality of taken-in sheets into one bundle of sheets, a stapling process of stapling a rear edge (an upstream-side edge in a sheet conveying direction) of the sheet bundle by use of a stapler 301, a punching process of punching holes in the vicinity of the rear edge of the taken-in sheets, a sorting process, a non-sorting process, a folding process of folding the sheet bundle and a bookbinding process. The finisher 600 in the first embodiment is capable of executing at least the alignment process.

The finisher 600 has an entrance roller pair 602 for guiding the sheets discharged from the main body 100 of the copying machine 110 to the interior. A changeover flapper 601 for selectively guiding the sheets to a side stitch bookbinding path X or a saddle stitch bookbinding path Y is provided on a downstream side of this entrance roller pair 602.

The sheets guided to the side stitch bookbinding path X are fed toward a buffer roller 605 via a conveying roller pair 603. The conveying roller pair 603 and the buffer roller 605 are capable of rotating in forward and reversed directions. A punch unit 650 is provided between the conveying roller pair 603 and the buffer roller 605. The punch unit 650 operates as the necessity may arise and punches the holes in the vicinity of the rear edge of the conveyed sheet.

The buffer roller 605 is a roller wound with a predetermined number of stacked sheets fed to an outer periphery of this buffer roller 605. The sheets fed to the buffer roller 605 are stacked on a sample tray 621 or stacked on an intermediate processing tray (which will hereinafter be simply referred to as a processing tray) 330 within the side stitch processing device 300 through a changeover flapper 611 disposed downstream.

The sheets stacked as a sheet bundle on the process tray 330, after being subjected to the alignment process, the stapling process, etc according to the necessity, are delivered onto a stack tray 622 by delivery rollers 380*a*, 380*b*. The stapling process of stapling the sheet bundle stacked on the process tray 330 involves using the stapler 301. The stapler 301 staples portions corresponding to an angular portion (corner) and a rear portion of the sheet bundle. Note that the side stitch processing device 300 will be explained later on.

On the other hand, the sheet guided by the changeover flapper 601 is accommodated in an accommodation guide 220 by a conveying roller pair 213, and is further conveyed till the front edge of the sheet abuts on an unillustrated elevation type sheet positioning member. Further, two pairs of staplers 218 (only one stapler is illustrated because of their being viewed in superposition) are provided in the middle of the accommodation guide 220. The stapler 218 staples the center of the sheet bundle in cooperation with an anvil 219 facing the stapler 218.

A pair of folding rollers 226*a*, 226*b* is provided downstream the staplers 218. A protruding member 225 is provided in a position that faces the folding roller pair 226. A front edge of the protruding member 225 faces a nip of the folding roller pair 226. The pair of folding rollers 226*a*, 226*b* and the protruding member 225 configure a sheet bundle folding apparatus 201 for folding the sheet bundle.

When folding the sheet bundle stapled by the stapler 218, the unillustrated sheet positioning member descends so that a stapling position of the sheet bundle comes to face a central position (nip) of the folding roller pair 226 after finishing the stapling process. Next, the protruding member 225 protrudes toward the sheet bundle, whereby the sheet bundle is pushed in between the folding roller pair 226 (in between the nip), then conveyed while being nipped by the folding roller pair 226 and is folded by two. Accordingly, the sheet bundle becomes a saddle-stitched booklet. It is to be noted that the sheet bundle might also be folded without being saddle-stitched.

The sheet bundle, which has been saddle-stitched in the booklet, is conveyed as it is to the sheet-bundle spine processing device 400 by the protruding member 225 and by a bookbinding bundle conveying belt 401. The sheet-bundle spine processing device 400 neatly sets the sheet bundle so that the crease thereof takes an exactly folded shape by pressing a folding portion of the rear surface of the sheet bundle from both of the surfaces, and flattens the rear portion of the rear surface folded portion. Finally, the sheet bundle is delivered to and thus placed in the folding sheet bundle stack tray 480.

Next, the side stitch processing device 300 serving as the sheet processing apparatus in the first embodiment of the present invention will be described.

A stapler 301 serving as a binding unit and components peripheral to this stapler 301 will be explained with reference to FIGS. 2 and 3.

The stapler 301 is fixed onto a slide support anvil 303. Rolling rollers 304, 305 are provided under the slide support anvil 303. The slide support anvil 303 is guided by the rollers 304, 305 and a guide rail groove 307 on a stapler moving base 306, thus moving along the rear edges of the sheets stacked in the intermediate process tray 330 (as indicated in a direction of an arrowhead Y).

Figure 2:
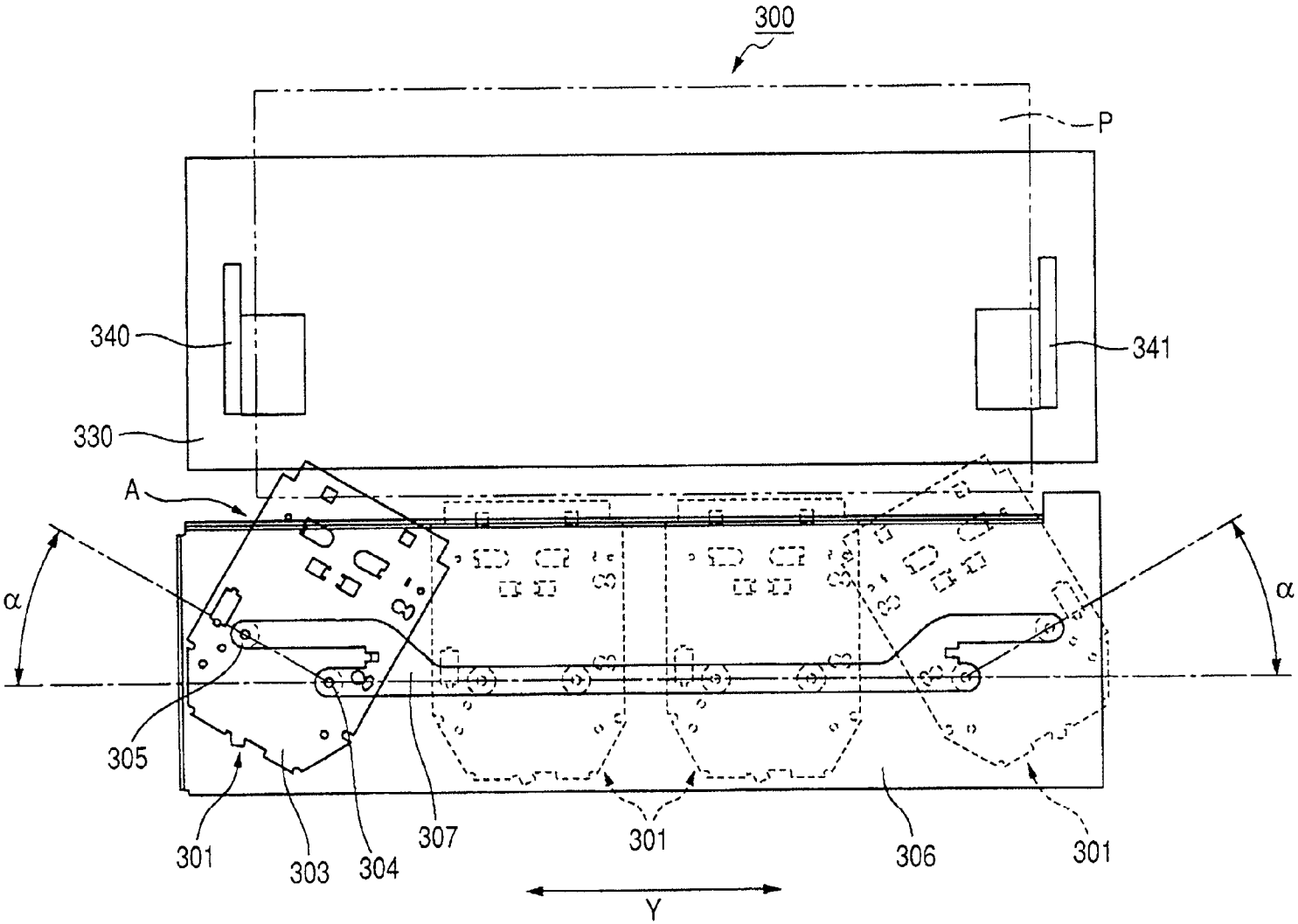
FIG. 2 is a plan schematic view of a side stitch processing apparatus.
Figure 3:
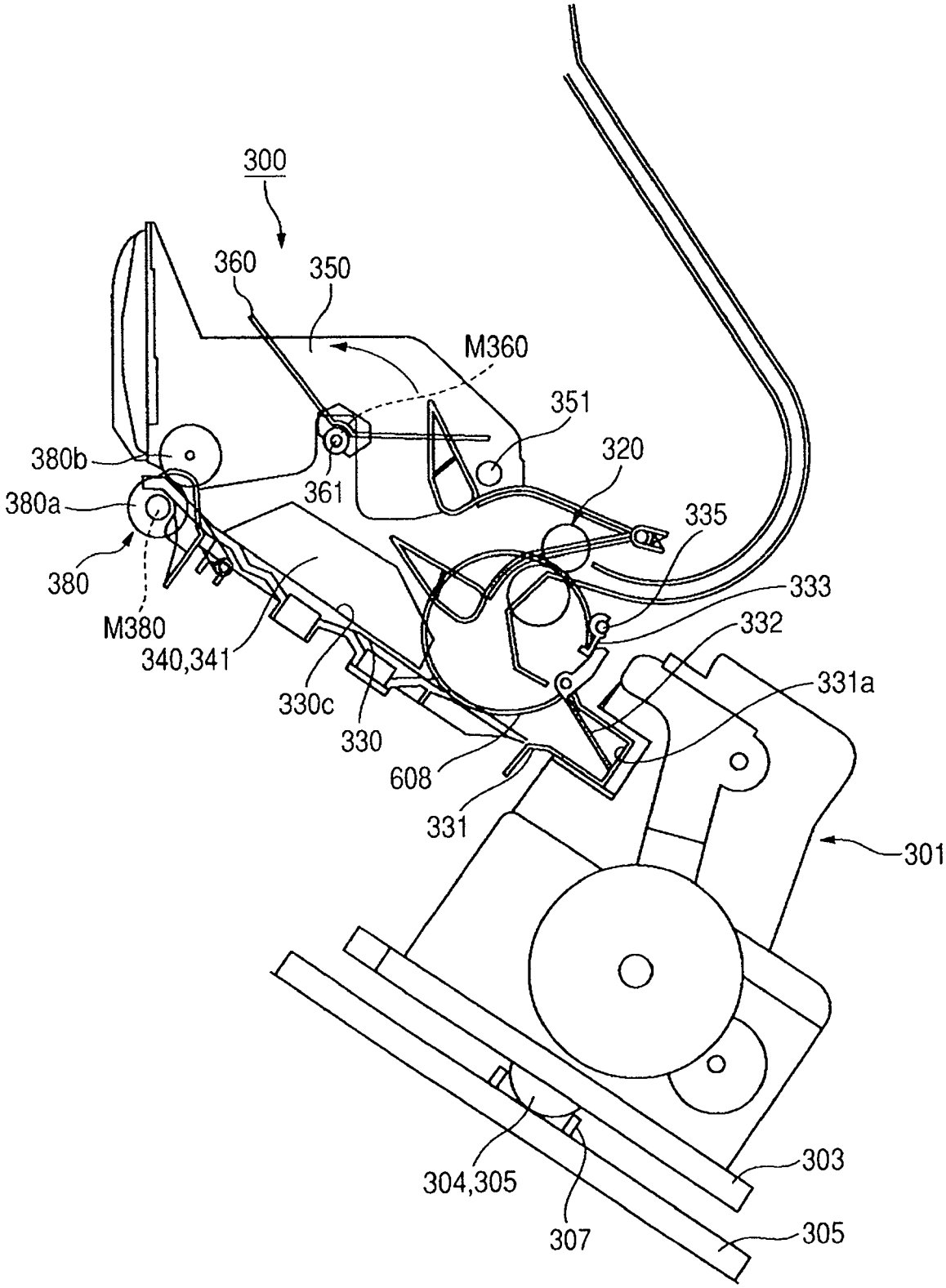
FIG. 3 is a front view of the side stitch processing apparatus.

The stapler 301 is, as shown in FIG. 2, kept in a posture inclined at a predetermined angle a at the corner of the sheets stacked in the intermediate process tray 330. The inclined angle $\alpha$ is set at approximately 30 degrees but can be varied by changing the shape of the guide rail groove 307. Further, the stapler moving base 306 is provided with an unillustrated position sensor for detecting a home position of the stapler 301. Normally, the stapler 301 stands by in the home position designated by a symbol A, which is anterior to the apparatus (as viewed from a user).

Figure 4:
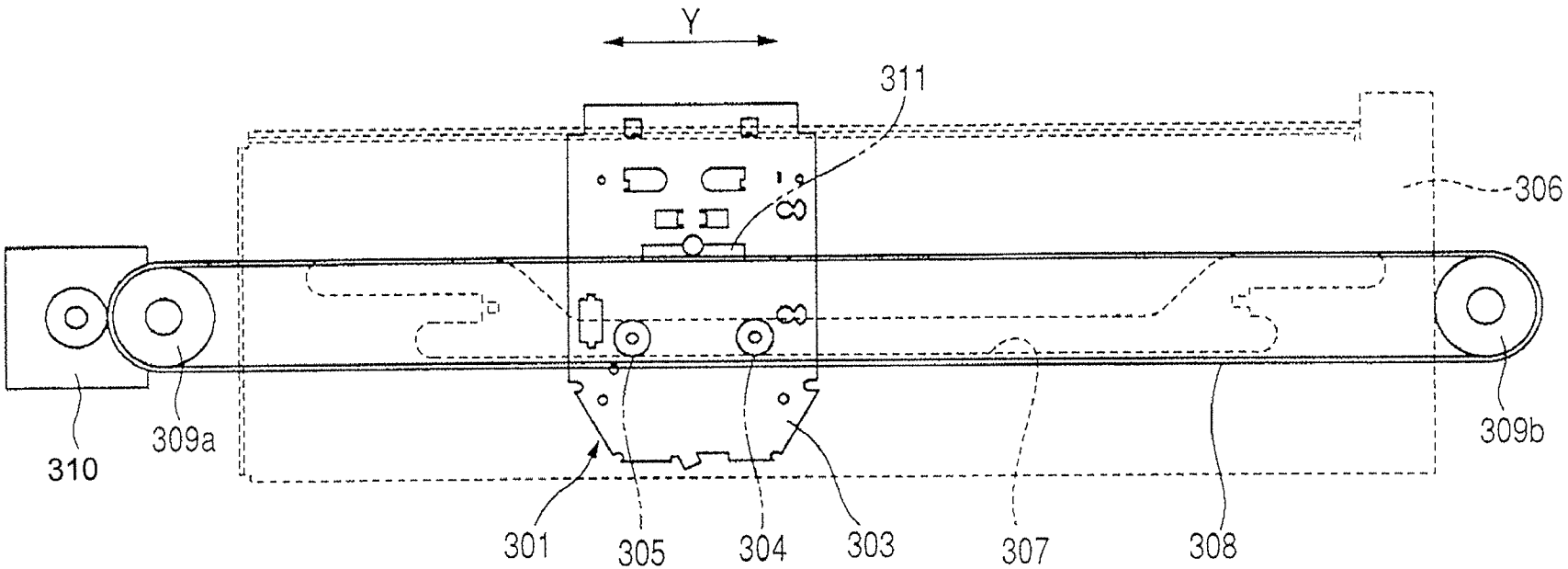
FIG. 4 is a schematic plan view of a mechanism for moving a stapler.

A moving mechanism for moving the stapler 301 in the Y-direction will be described with reference to FIG. 4.

A belt support portion 311 is provided under the slide support anvil 303. The belt support portion 311 is attached to a moving belt 308 extending in the peripheral direction between belt pulleys 309*a*, 309*b* disposed at side end portions of a moving area for the stapler 301. Further, a drive motor 310 connected to the belt pulley 309*a* is disposed under the slide support anvil 303. Accordingly, the stapler 301 is supported on the slide support anvil 303 and is therefore reciprocated together with the slide support anvil 303 in the Y-directions while being tugged by the moving belt 308 of which a circulating direction is changed depending on forward and reversed rotations of the drive motor 310.

A processing tray unit will be explained with reference to FIGS. 1 and 3.

The processing tray unit is constructed of the intermediate process tray 330, the conveying guide 312, a trailing end stopper 331, first and second alignment portions 340, 341, a rocking arm (guide) 350, a pull-in paddle 360, a sheet-bundle delivery roller pair 380, a trailing end lever 332 and a lever stopper 333.

The intermediate process tray 330 is obliquely disposed with its downstream side (the left side in FIG. 3) directed upward and with its upstream side directed downward (the right side in FIG. 3) with respect to the sheet bundle delivery direction. The trailing end stopper 331 is disposed at the lower end portion, defined as the upstream side, of the intermediate process tray 330. The pull-in paddle 360 and the first and second alignment portions 340, 341 are disposed at the middle portion of the intermediate process tray 330. Moreover, the pull-in paddle 360, the sheet-bundle delivery roller pair 380 and the rocking arm 350, which will be described later on, are disposed at the upper end portion, defined as the downstream side, of the intermediate process tray 330, specifically substantially in an upper area portion of the of the unit configuration.

Then, a sheet P delivered from the first delivery roller pair 320 (see FIG. 3) slides on a stacking surface 330*c* of the intermediate process tray 330 or on the sheet stacked on the intermediate process tray 330 till a trailing end (the upstream end in the delivery direction) of the sheet P abuts on an abutting support surface 331*a* of the trailing end stopper 331 by dint of the inclination of the intermediate process tray 330 and by action of the pull-in paddle 360 that will be described hereafter.

Further, one lower delivery roller 380*a* configuring the sheet-bundle delivery roller pair 380 is disposed at the end portion of the intermediate process tray 330 on the downstream side, and the other upper delivery roller 380*b* thereof is disposed at the tip portion of the lower surface of the rocking arm 350. The upper delivery roller 380*b* gets apart from and gets close to the lower delivery roller 380*a*. The pair of delivery rollers 380*a*, 380*b* is rotated in the forward and reversed direction by a drive motor M380.

The first and second alignment portions 340, 341 and the components peripheral thereto are explained with reference to FIG. 5.

The first and second alignment portions 340, 341 have a couple of first and second side stoppers 340*a*, 341*a* that align the both side ends (which are the edges in the sheet delivery direction) of the sheets stacked in the intermediate process tray 330. Further, the first and second alignment portions 340, 341 have a moving mechanism 345 for moving the sheet bundle of which the trailing end side and the lateral end sides are aligned in the crosswise direction of the sheet with respect to the intermediate process tray 330.

Figure 5:
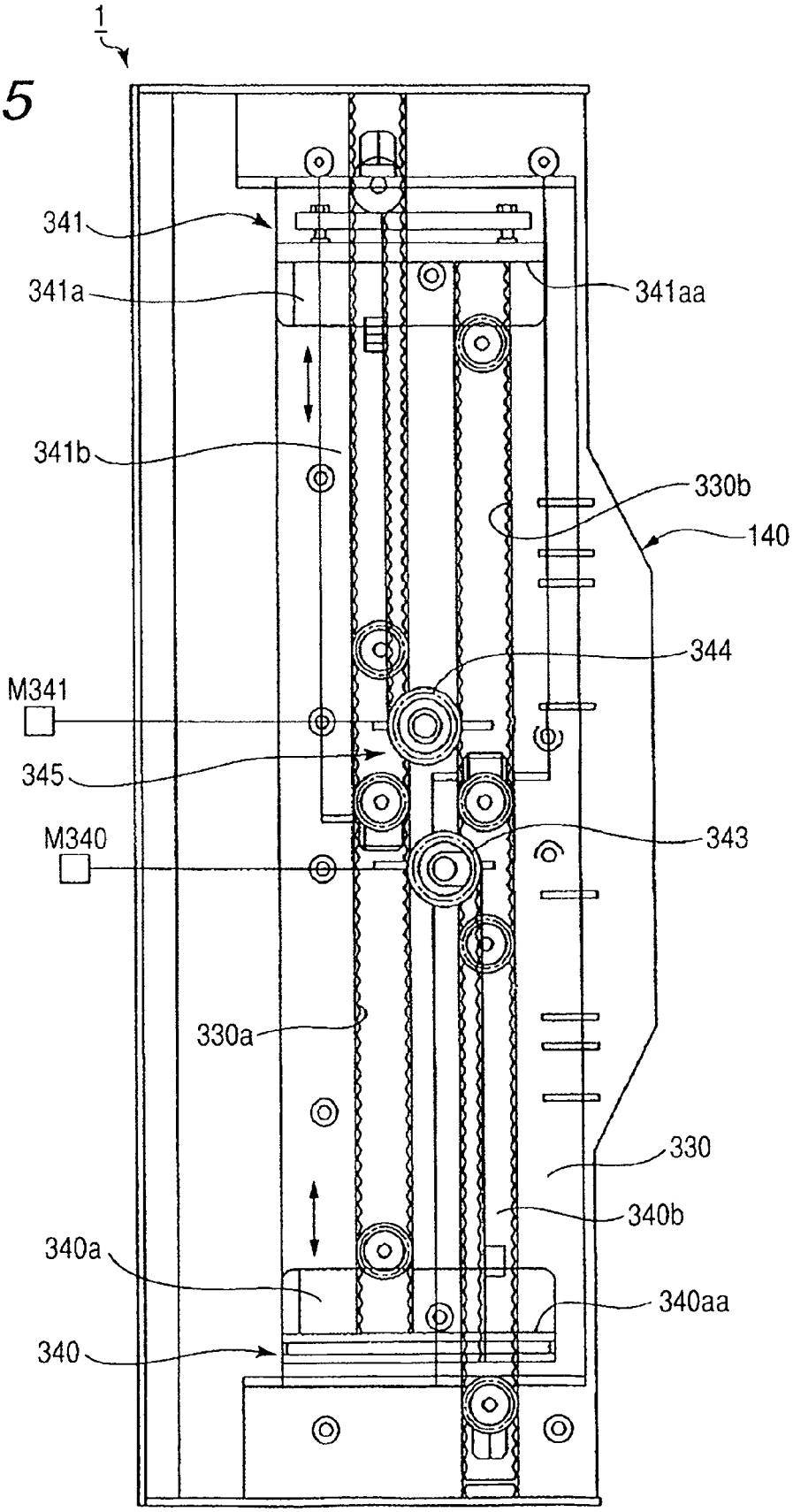
FIG. 5 is a plan view showing an intermediate process tray and an alignment member moving mechanism in the side stitch processing apparatus.

The first and second side stoppers 340*a*, 341*a* are disposed in a face-to-face relationship independently at the lower portion and the upper portion (which correspond to the both side ends of the sheet P) in FIG. 5 above the intermediate process tray 330. The first and second side stoppers 340*a*, 341*a* include alignment surfaces 340*aa*, 341*aa* that press the sheet side end perpendicularly against the surface of the intermediate process tray 330, and rack-and-gear portions 340*b*, 341*b* that sustain the undersurface of the sheet. The rack-and-gear portions 340*b*, 341*b* are respectively disposed on the lower surface side of the intermediate process tray 330 through a couple of guide grooves 330*a*, 330*b* parallel with each other. The guide grooves 330*a*, 330*b* extend through the intermediate process tray 330 in the widthwise direction of the sheet P.

The moving mechanism 345 has a first rack-and-gear portion 340*b* linked to the first side stopper 340*a*, a pinion gear 343, the second rack-and-gear portion 341*b* linked to the second side stopper 341*a*, a pinion gear 344, and first and second drive motors M340, M341 capable of each independently driving these first and second rack-and-gear portions 340*b*, 341*b* and the pinion gears 343, 344.

Then, the first and second rack-and-gear portions 340*b*, 341*b* mesh with the pinion gears 343, 344, whereby the first and second alignment portions 340, 341 can move independently in the widthwise direction of the sheet P with respect to the intermediate process tray 330. Namely, the alignment surfaces 340*aa*, 341*aa* are disposed in the face-to-face relationship on the upper surface side of the intermediate process tray 330, and the respective rack-and-gear portions 340*b*, 341*b* are so assembled as to be movable in the alignment direction on the lower surface side of the intermediate process tray 330.

Then, the individual pinion gears 343, 344 driven so as to be rotatable in the forward and reversed directions by the respective drive motors M340, M341 mesh with the rack-and-gear portions 340*b*, 341*b*. The first and second side stoppers 340*a*, 341*a* are moved in the alignment direction by the drive motors M340, M341. Herein, unillustrated position-sensors for detecting the home position are disposed at the first and second side stoppers 340*a*, 341*a*. With the position sensors, in a normal case, the first side stopper 340*a* stands by in the home position set at the lower end portion, while the second side stopper 341*a* stands by in the home position set at the upper end portion.

The rocking arm 350 will be explained with reference to FIG. 3.

The rocking arm 350 rotates in the up-and-down directions while being supported on a support shaft 351. The rocking arm 350 is provided with the upper delivery roller 380*b* abutting on the lower delivery roller 380*a* of the sheet-bundle delivery roller pair 380. The sheet-bundle delivery roller pair 380 is disposed on the downstream side in the sheet delivery direction from the support shaft 351. When a position in which the upper delivery roller 380*b* abuts on the lower delivery roller 380*a* is the home position, the rocking arm 350 is detected by the unillustrated position sensor.

Then, the rocking arm 350, normally when each individual sheet P is delivered onto the intermediate process tray 330, rotates upward, and the upper delivery roller 380*b* comes to an open state away from the lower delivery roller 380*a*. As a result, the sheet-bundle delivery roller pair 380 hinders neither the delivery operation of the sheet P to the intermediate process tray 330 by the pull-in paddle 360 that will be described later on nor a widthwise alignment operation by the first and second alignment portions 340, 341.

In such a structure, when the sheet is delivered onto the intermediate process tray 330, the rocking arm 350 rotates upward and separates the upper delivery roller 380*b* from the lower delivery roller 380*a*, thereby setting the sheet-bundle delivery roller pair 380 in the open state. When finishing the process for the sheets on the intermediate process tray 330, the rocking arm 350 rotates downward, and, when the upper delivery roller 380*b* and the lower delivery roller 380*a* nips the sheet bundle, the sheet-bundle delivery roller pair 380 can deliver the sheet bundle to the stack tray 622. Thereafter, the sheet-bundle delivery roller pair 380 rotates, whereby the sheet bundle is delivered to the stack tray 622.

The pull-in paddle 360 will be explained with reference to FIG. 3.

The plurality of pull-in paddles 360 is fixed along the drive shaft 361 disposed upwardly of the intermediate process tray 330. Referring to FIG. 3, the pull-in paddles 360 appear to be one in superposition. The drive shaft 361 is rotated by the drive motor M360. Accordingly, the pull-in paddle 360 is rotated counterclockwise as viewed in FIG. 3 at proper timing by the drive motor M360. The pull-in paddle 360 is formed slightly longer than a distance up to the upper surface of the intermediate process tray 330. Further, the home position of the pull-in paddle 360 is set in the position shown in FIG. 3 so as not to obstruct the sheet delivered into the intermediate process tray 330 from the first delivery roller pair 320.

With this configuration, the pull-in paddle 360, when the sheet is delivered onto the intermediate process tray 330, comes into contact with the upper surface of the sheet while rotating counterclockwise, and makes the sheet butt against a butting support surface 331*a* of the trailing end stopper 331 by pulling the sheet toward the trailing end stopper 331. Thereafter, the pull-in paddle 360 waits for a predetermined period of time and then stops at well timing in the home position detected by the unillustrated position sensor.

The sheet stacking apparatus in the first embodiment of the invention will hereinafter be described with reference to FIGS. 6 through 30.

The sheet stacking apparatus 1 includes the intermediate process tray 330 defined as the sheet stacking portion, the trailing end stopper 331 as the stopper, the trail end lever 332 as the sheet pressing member, the lever stopper 333 as the regulating member, and the conveying guide 312 as the sheet conveying guide.

Figure 6:
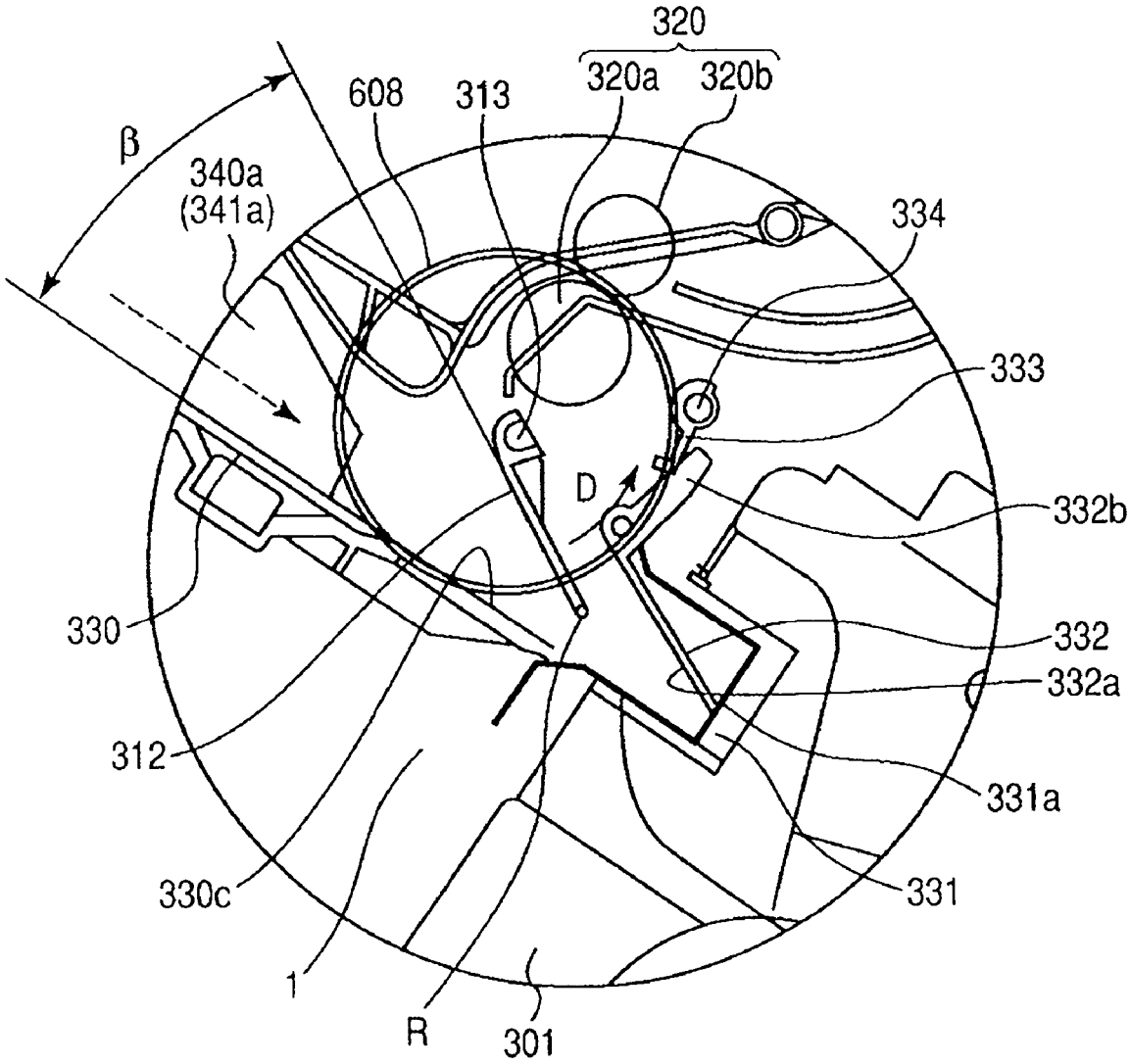
FIG. 6 is a plan view showing a sheet stacking apparatus in a first embodiment of the present invention.
Figure 44A:
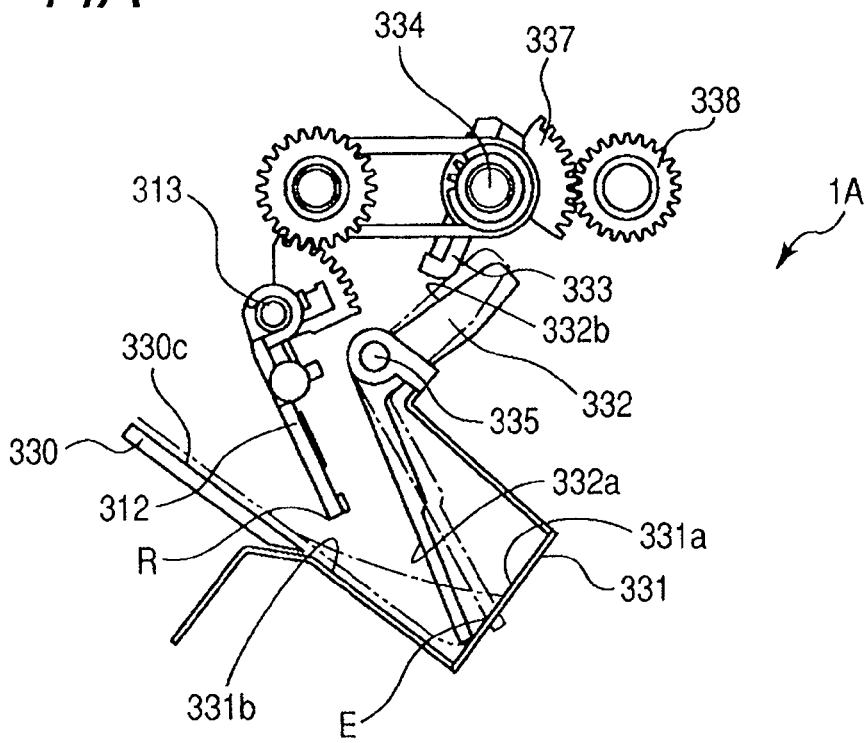
FIG. 44A is an explanatory view representing an effect of the embodiment of the present invention, showing a case where the trailing end of the sheet is curled upward.
Figure 44B:
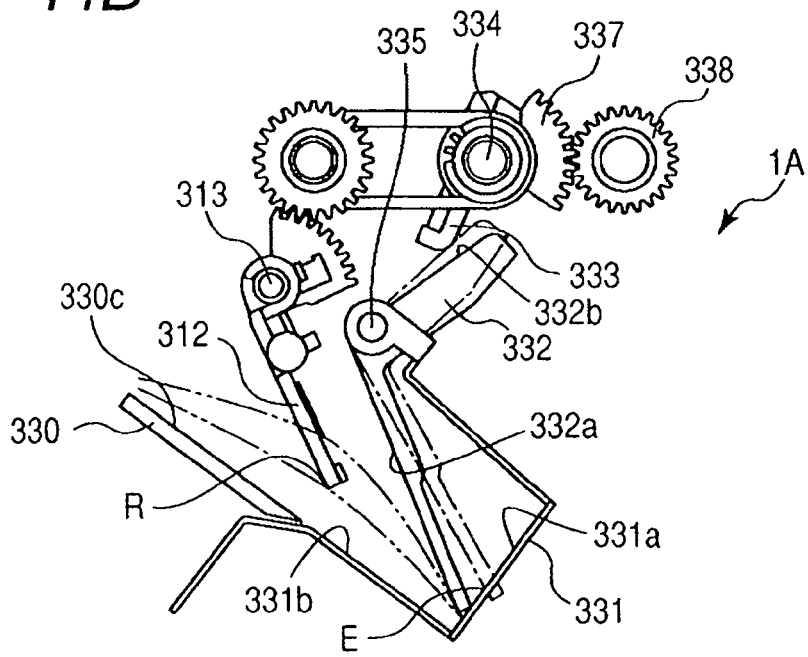
FIG. 44B is an explanatory view showing a case where the trailing end of the sheet is curled downward.
Figure 45:
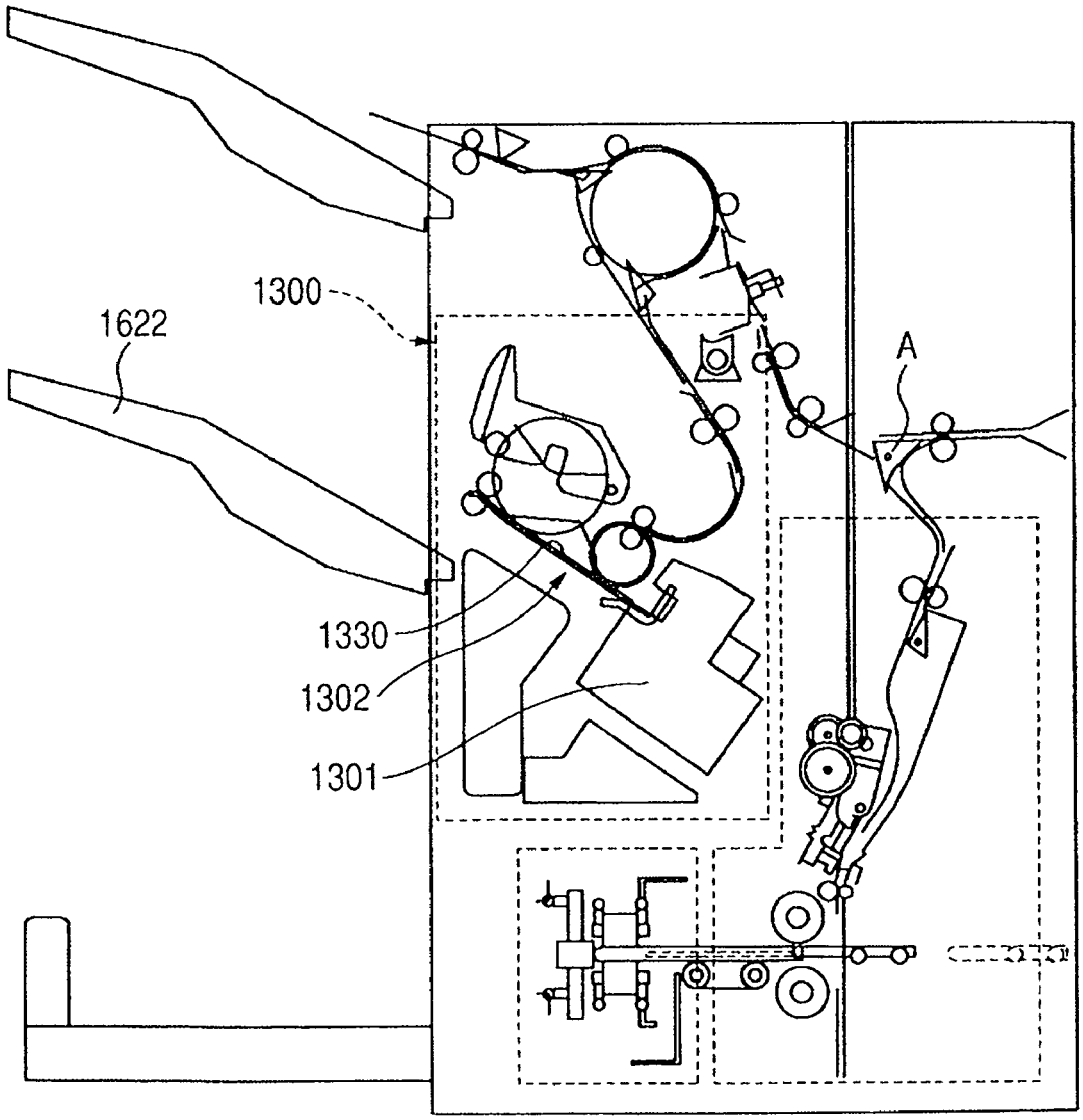
FIG. 45 is a sectional view showing a conventional finisher.
Figure 46:
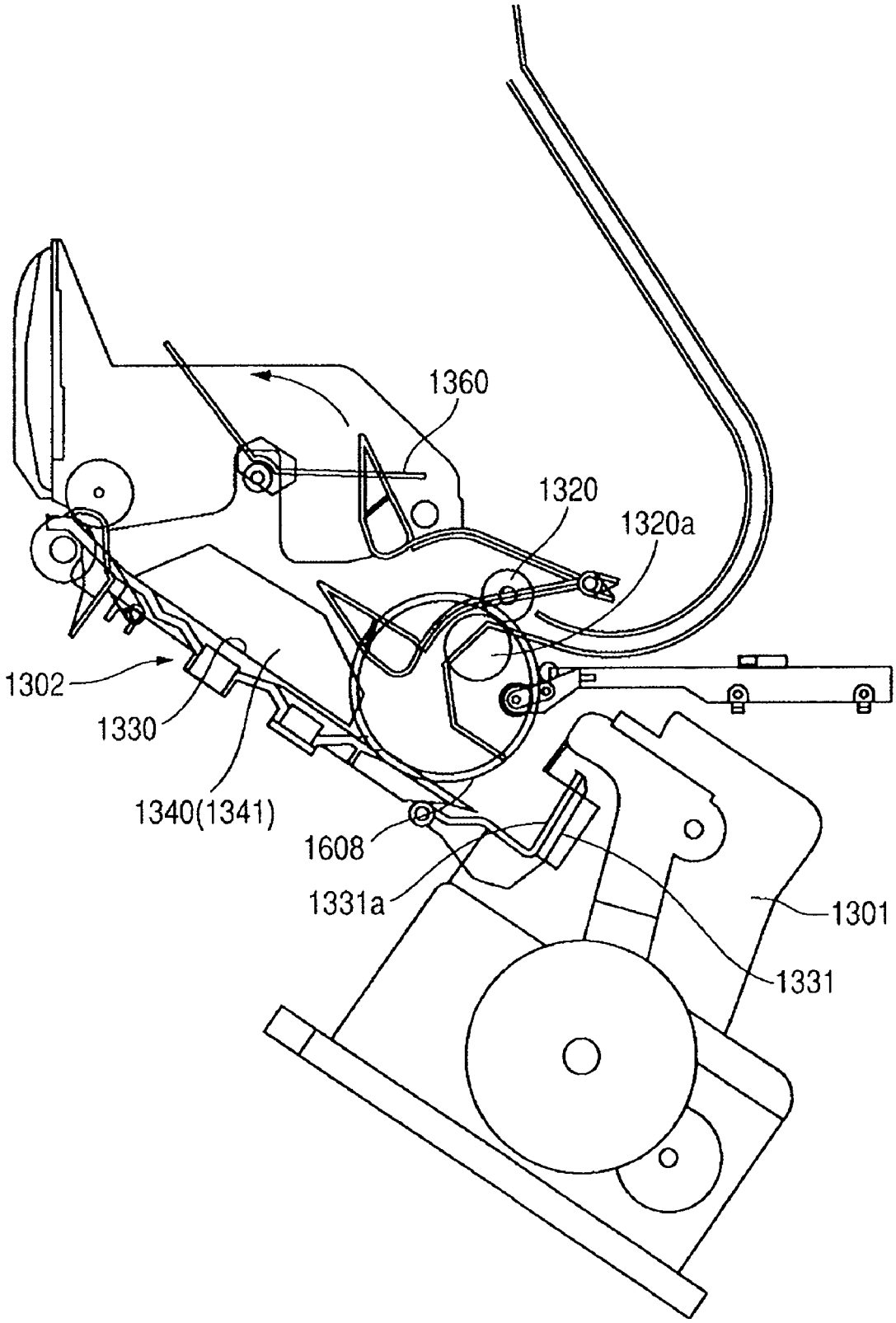
FIG. 46 is a schematic front view of the sheet processing apparatus.
Figure 47:
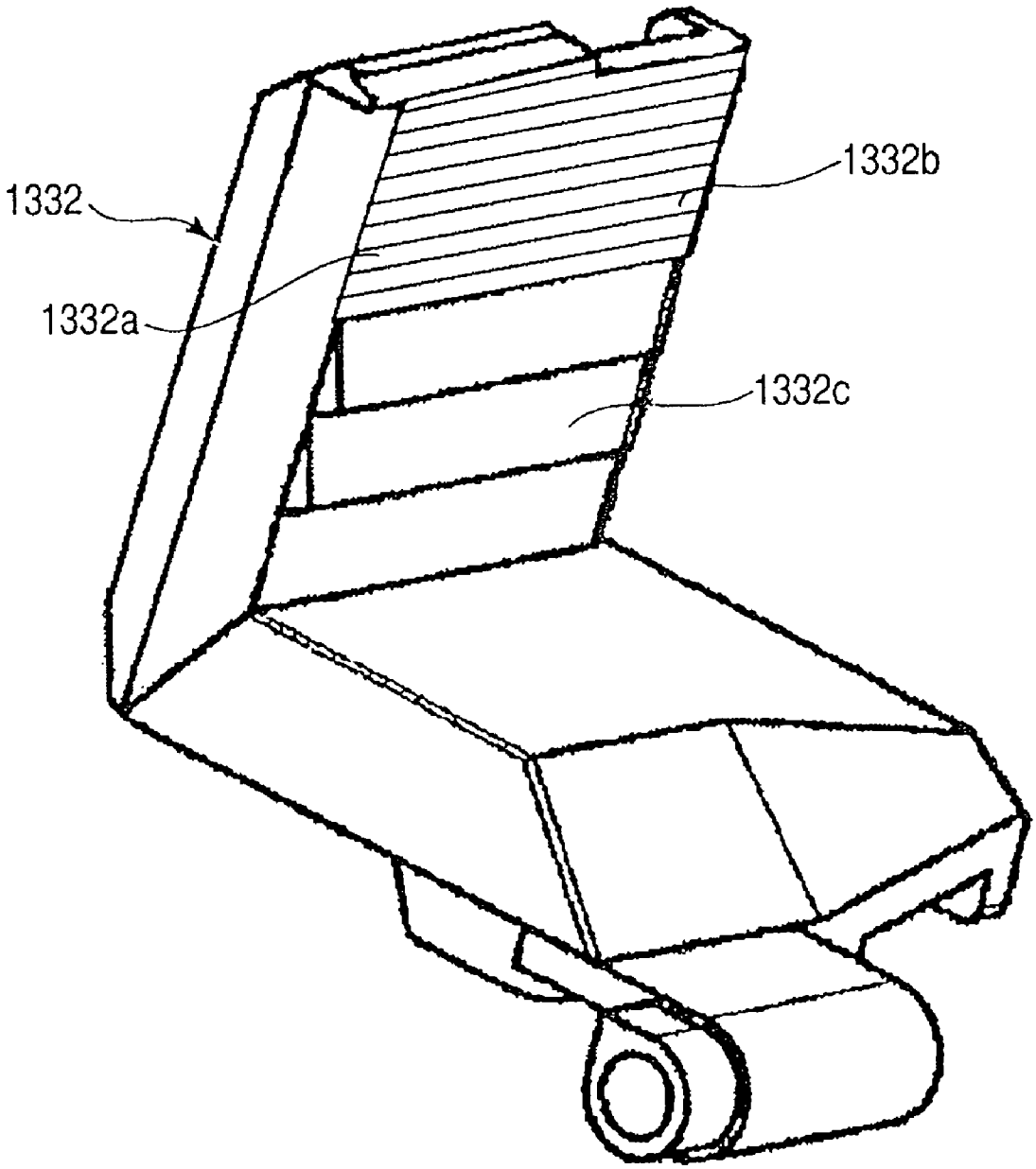
FIG. 47 is a perspective view of an external configuration of a conventional trailing end stopper.
Figure 48:
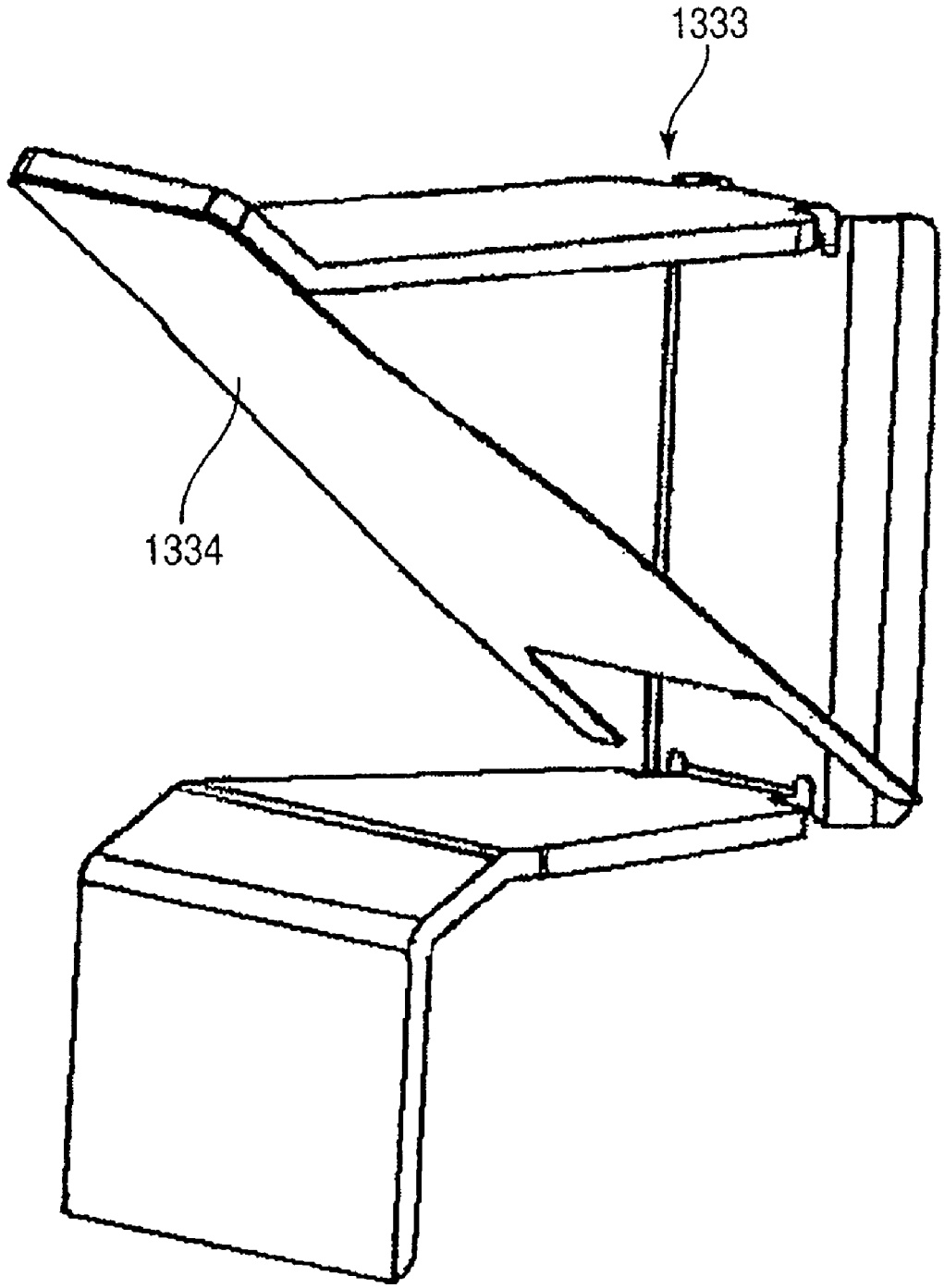
FIG. 48 is a perspective view of the external configuration of the conventional trailing end stopper.
Figure 49:
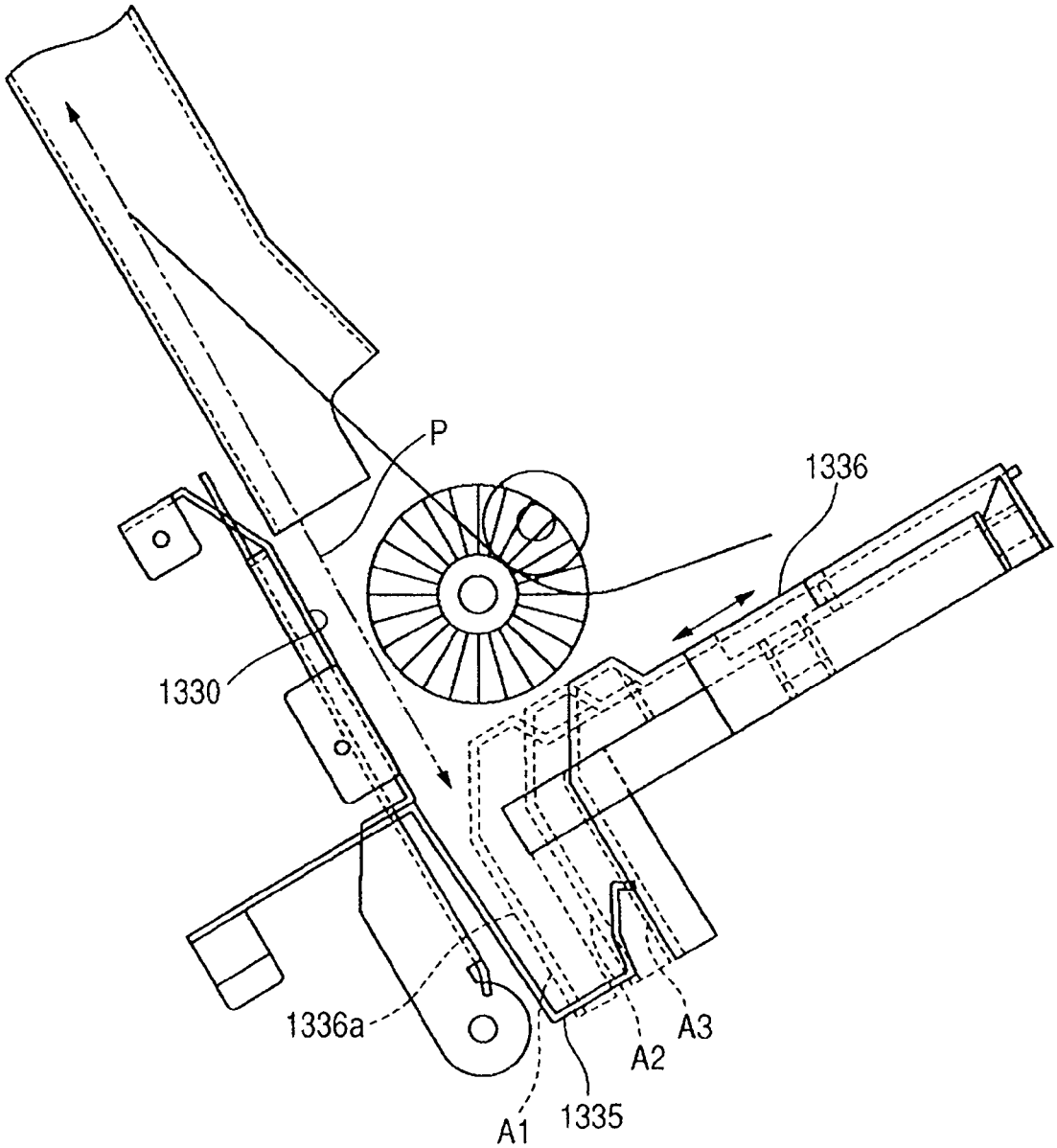
FIG. 49 is a front view of a conventional sheet processing apparatus.
Figure 50A:
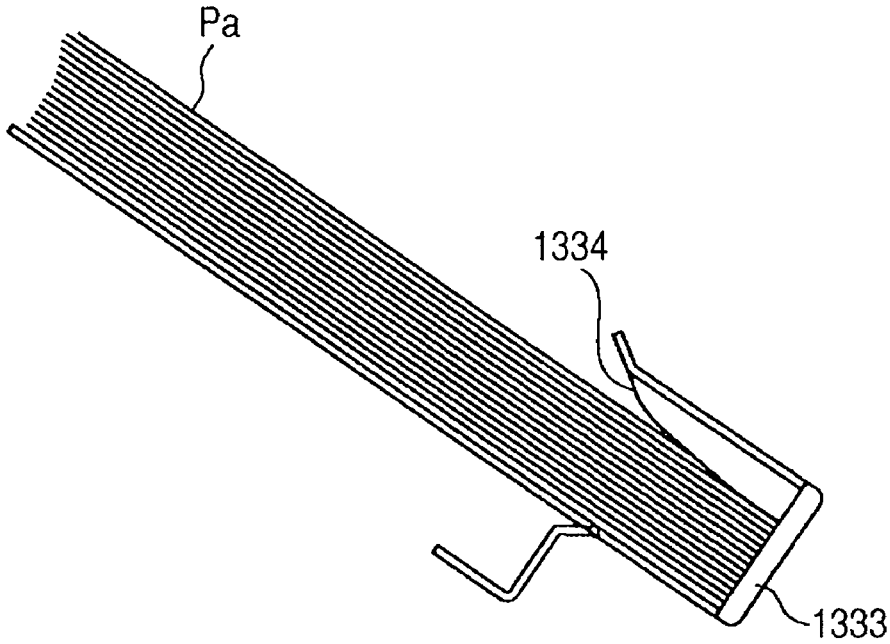
FIGS. 50A and 50B are front views showing a trouble in the trailing end stopper of the conventional sheet processing apparatus.
Figure 50B:
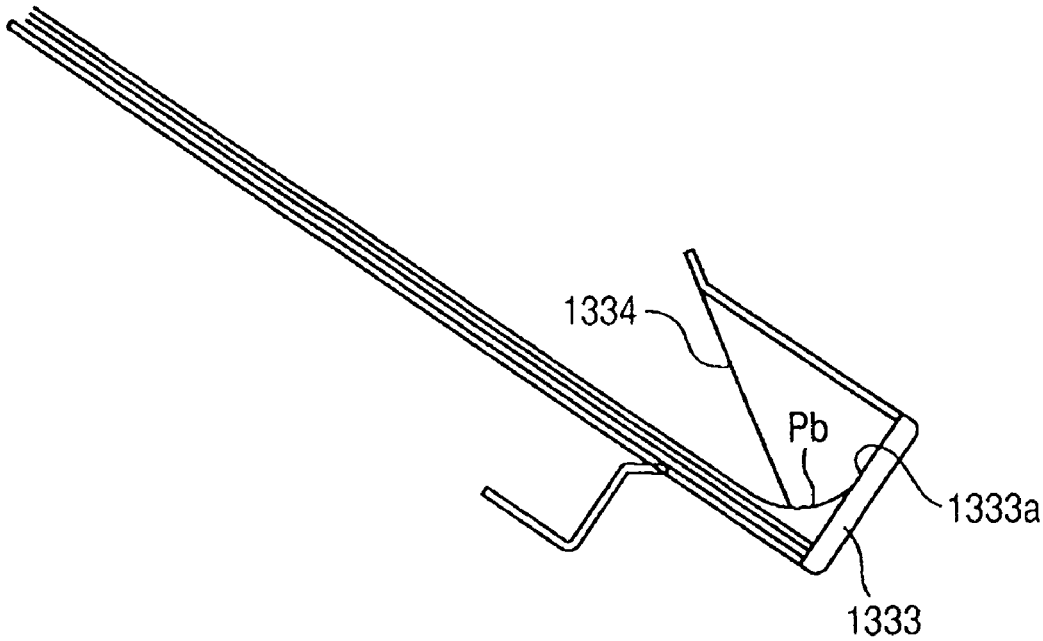
Figure 51:
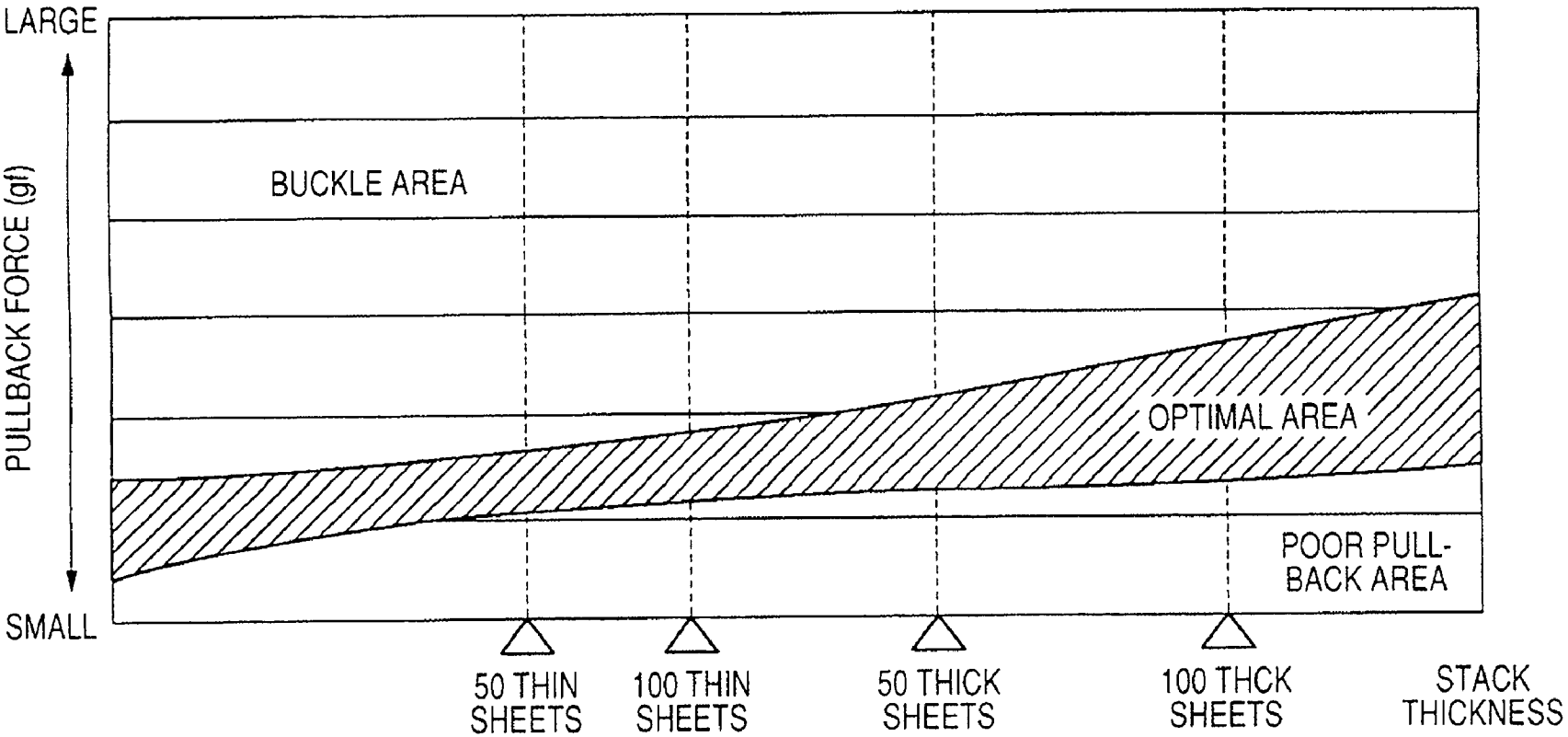
FIG. 51 is a view showing a pullback area in the conventional sheet processing apparatus.

The intermediate process tray 330 is inclined downward to the right hand in FIG. 6 so that the delivered sheet is moved on the upstream side in the sheet delivery direction. Note that the intermediate process tray 330 may also be set horizontal. In this case, the sheet needs moving in a direction of a right arrow-headed dotted line in FIG. 6 by a knurled belt 608. The conveying guide 312 is so provided as to be rotatable about the support shaft 313 and serves as a guide surface for conveying the delivered sheet toward the trailing end stopper 331. Further, the conveying guide 312 is disposed at an angle equal to or smaller than β with respect to the intermediate process tray 330. Moreover, the conveying guide 312, corresponding to a sheet stacking height on the intermediate process tray and as the sheet stacking height increases, rotates about the support shaft 313 in the direction of an arrowhead D, and invariably makes constant a distance from the uppermost sheet surface on the intermediate process tray to a tip portion R of the conveying guide 312. It should be noted that the angle β is set at approximately 30 degrees (β=about 30 degrees) in the first embodiment but is not limited to this value. With this contrivance, the conveying guide 312, for example, as shown in FIG. 44B, even in a case where the downward-curled sheet is delivered, can flatten the downward-curled sheet conformably with the stacking surface 330*c* of the intermediate process tray 330 by pressing a crest-swelled vertex portion of the downward-curled sheet with the tip portion R of the conveying guide 312. As a result, the downward-curled sheet is flattened and can be made conformable with the trailing end stopper 331. Further, for instance, in the case of a thin sheet on the intermediate process tray 330, even when the sheet is pulled in by strong force in the direction of the trailing end stopper 331 by the knurled belt 608 and the pull-in paddle 360 illustrated in FIG. 6, the conveying guide 312 can surely make the sheet conformable with the trailing end stopper 331 in a way that presses the sheet down with the tip portion R without being buckled.

The trailing end stopper 331 is disposed on the upstream side of the intermediate process tray 330 in the sheet delivery direction and receives the sheet that is delivered onto the intermediate process tray 330 and is thereafter moved on the upstream side. The trailing end stopper 331 has the support surface 331*a* so formed as to be erect perpendicularly to the stacking surface 330*c* of the intermediate process tray 330 and receiving the trailing end of the sheet P.

The trailing end lever 332 is so provided as to be rotatable about the support shaft 335 and rotates in the up-and-down directions. With this construction, the trailing end lever 332 presses the sheets stacked on the intermediate process tray 330 in such as direction as to be pressed against the stacking surface 330*c* of the intermediate process tray 330. Further, the trailing end lever 332 is pushed up by the sheet moving (sliding) on the stacking surface 330*c* of the intermediate process tray 330 or moving (sliding) toward the trailing end stopper 331 on the sheet stacked on the intermediate process tray 330.

Moreover, the trailing end lever 332 has a lever guide surface 332*a* for pressing the sheet on the intermediate process tray 330 or guiding the sheet moving toward the trailing end stopper 331, and an abutting portion 332*b* that abuts on the lever stopper 333 supported on a rotary shaft 334.

Thus, the lever guide surface 332*a*, when pressing the sheet in the vicinity of the trailing end stopper 331, can surely get conformable with the upstream end of the sheet without the sheet's abutting in a floating state upon the trailing end stopper 331. Even in such a case that the sheet is curled upward, the sheet can be surely pressed at the intermediate process tray 330.

The lever stopper 333 is constructed to regulate an upper limit position of the trailing end lever 332 by receiving (stopping) the trailing end lever 332 rotating upward, and can adjust the upper limit position of the trailing end lever 332, corresponding to the stacking height of the sheets stacked on the intermediate process tray 330. This positional adjustment is conducted for getting the pressing force for pressing the sheet to become substantially constant by making substantially constant a height difference between the upper limit position of the trailing end lever 332 and the position in which the trailing end lever 332 presses the sheet irrespective of the sheet stacking height.

Figure 7A:
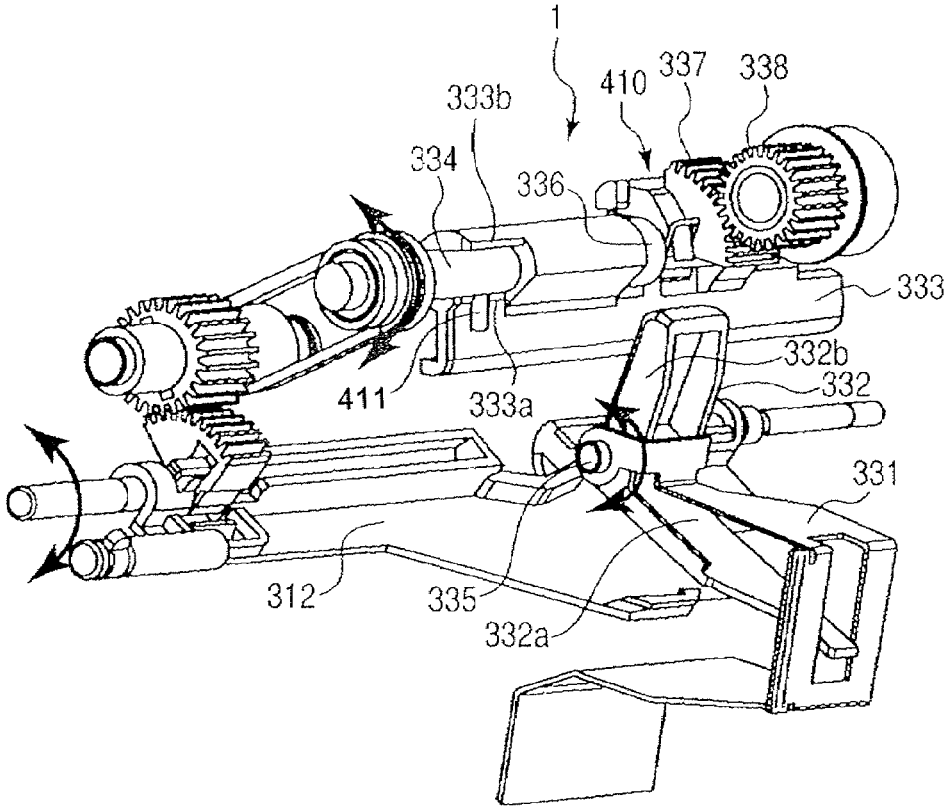
FIG. 7A is a perspective view showing an external configuration of the sheet stacking apparatus in the first embodiment.

The rotary shaft 334 is provided upwardly of the trailing end stopper 331. The rotary shaft 334 is, as shown in FIG. 7A, rotated through a desired angle by a gear 337 building up an adjusting mechanism 410 and by a drive gear 338 meshing with this gear 337 and is held in this position. A rotational angle of the rotary shaft 334 changes in accordance with a sheet pressing height of the trailing end lever 332. Namely, the upper limit position of the trailing end lever 332 changes corresponding to the sheet stacking height of the sheets on the intermediate process tray 330 under rotational control that will be explained later on.

The lever stopper 333 is rotatably provided at the rotary shaft 334. The lever stopper 333 receives (stops) the trailing end lever 332 pushed upward by the sheet to be stacked on the intermediate process tray 330. The rotary shaft 334 is provided with a protruded piece 411. The lever stopper 333 is formed with abutting surfaces 333*a*, 333*b* that abut on the protruded piece 411 provided on the rotary shaft 334.

Figure 7B:
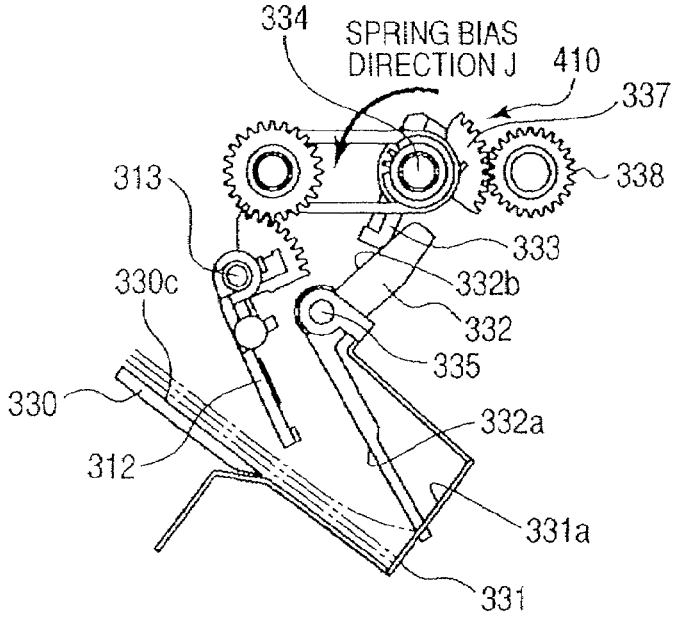
FIG. 7B is a front view thereof.

A torsional coil spring 336 is so provided as to be wound around the rotary shaft 334, and both side ends of the torsional coil spring 336 are fixed to the rotary shaft 334 and the lever stopper 333. The torsional coil spring 336 as a biasing member applies biasing force to the lever stopper 333 in an arrow-headed direction J as shown in FIG. 7B. The rotation of the lever stopper 333 receiving the biasing force of the torsional coil spring 336 is regulated when the abutting surface 333*a* of the lever stopper 333 abuts on the protruded piece 411.

It is to be noted that in the construction described above, since the torsional coil spring 336 applies the rotary force to the lever stopper 333, the rotation of the lever stopper 333 is regulated by making the abutting surface 333*a* of the lever stopper 333 abut on the protruded piece 411 integral with the rotary shaft 334. Therefore, the construction provided with the torsional coil spring 336 does not necessarily require the abutting surface 333*b*. The protruded piece 411 and the abutting surface 333*a* configure a rotation regulating mechanism.

Further, in the case of constructing the rotary shaft 334 and the lever stopper 333 into one united body, the torsional coil spring 336 is not likewise necessarily required. In this construction, it follows that the position in which the lever stopper 333 receives (stops) the trailing end lever 332 can be changed corresponding to the sheet stacking height by adjusting the rotational position of the rotary shaft 334. It is required that the position in which the lever stopper 333 receives (stops) the trailing end lever 332 be set as the upper limit position of the trailing end lever 332 so that the difference between the position in which the trailing end lever 332 presses the sheet and the position in which the trailing end lever 332 is received (stopped) by the lever stopper 333 becomes substantially constant regardless of the sheet stacking height. On this occasion, the upper limit position of the trailing end lever 332 is set with rotational allowance. The rotational allowance is provided for restraining the sheet from getting afloat by, when the curled sheet is fed in, receiving this curled sheet without causing any paper jam. For example, in FIG. 27, when the sheet stacking height comes to approximately 1 mm by stacking ten sheets each having a thickness of approximately 0.1 mm, the position in which the lever stopper 333 rotates and receives (stops) the trailing end lever 332 is changed in a way that gives the rotational allowance on the order of approximately 4 mm to 5 mm to the trailing end lever 332. The position of the rotational angle of the rotary shaft 334 is adjusted so that the rotational allowance on the order of approximately 4 mm to 5 mm becomes substantially constant regardless of the sheet stacking height.

Figure 8:
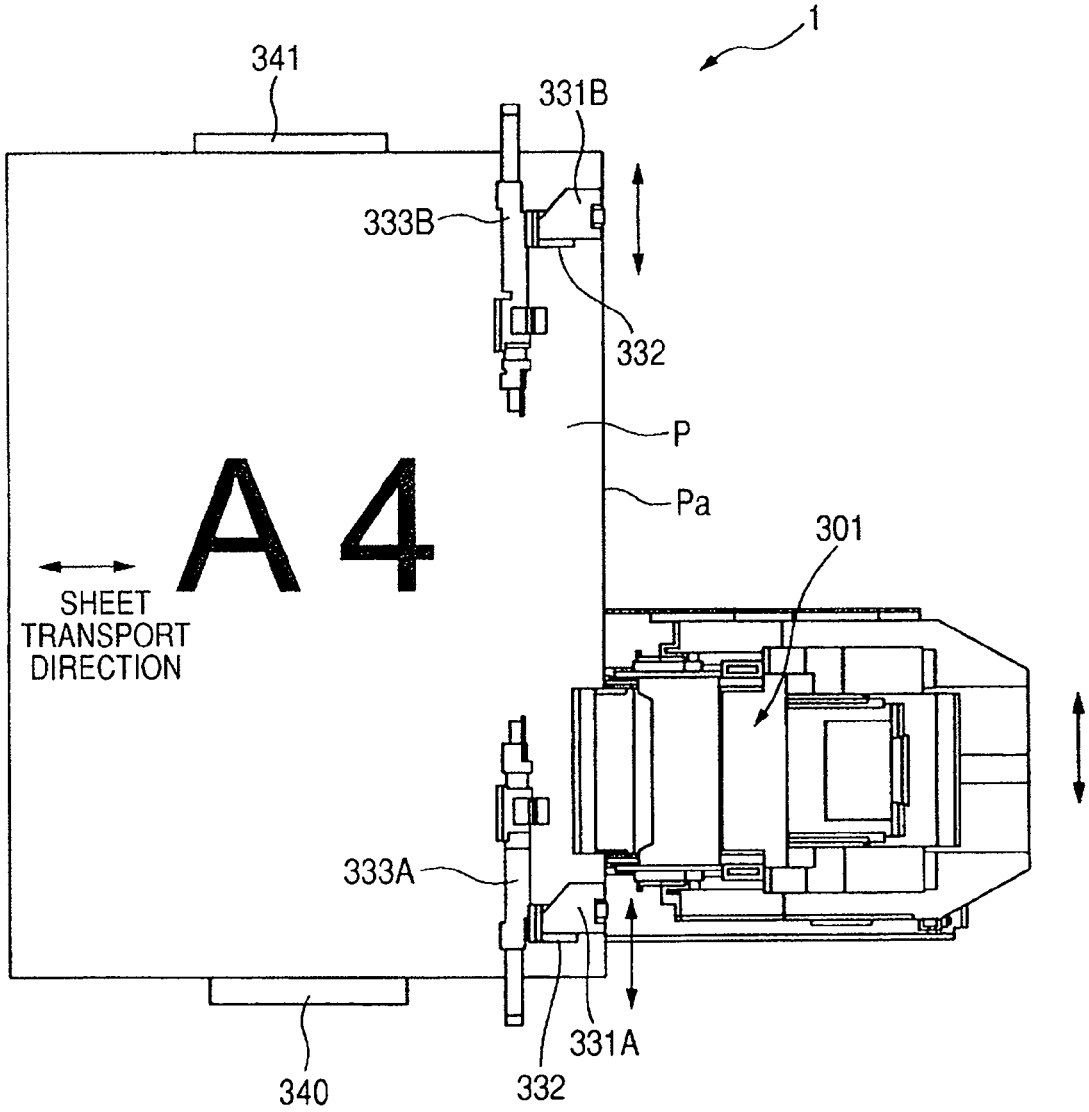
FIG. 8 is a plan view of the sheet stacking apparatus.

Further, as shown in FIG. 7, the trailing end stopper 331 and the trailing end lever 332 are connected via the support shaft 335, and the conveying guide 312 and the lever stopper 333 are rotated by the same driving source via the rotary shaft 334. Moreover, the trailing end stoppers are, as illustrated in FIG. 8, provided in separation in positions indicated by the reference symbols 331A, 331B at a boundary of the center of the (widthwise) direction intersecting the sheet delivery direction in the intermediate process tray 330. Similarly, the lever stoppers are disposed in positions indicated by the reference symbols 333A, 333B. When having such a layout relation, the stapler 301 can move along the trailing end of the sheet bundle without interfering with the trailing end stopper 331, the trailing end lever 332 and the lever stopper 333, whereby the sheet bundle can be stapled in desired positions.

Furthermore, the trailing end stopper 331 and the trailing end lever 332 can be moved symmetrically by the same driving motor (unillustrated) along a trailing end Pa of the sheet P.

Figure 9A:
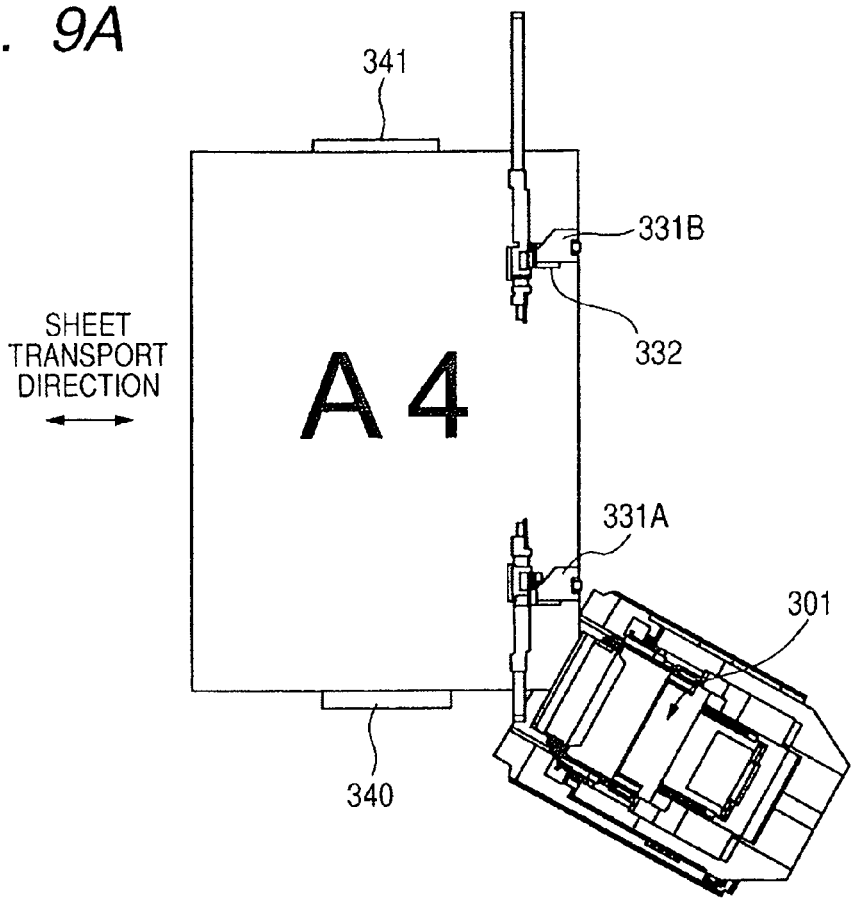
FIG. 9A a plan view of a positional relationship between a stapler and a trailing end stopper, showing a case of stapling corners of a sheet bundle.
Figure 9B:
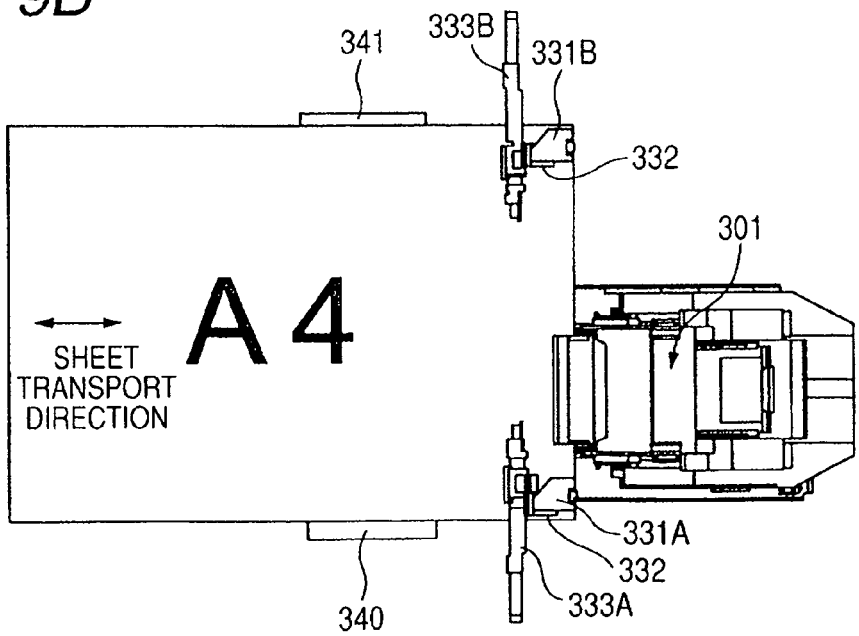
FIG. 9B is a plan view showing a case of stapling a trailing end of the sheet bundle.
Figure 10:
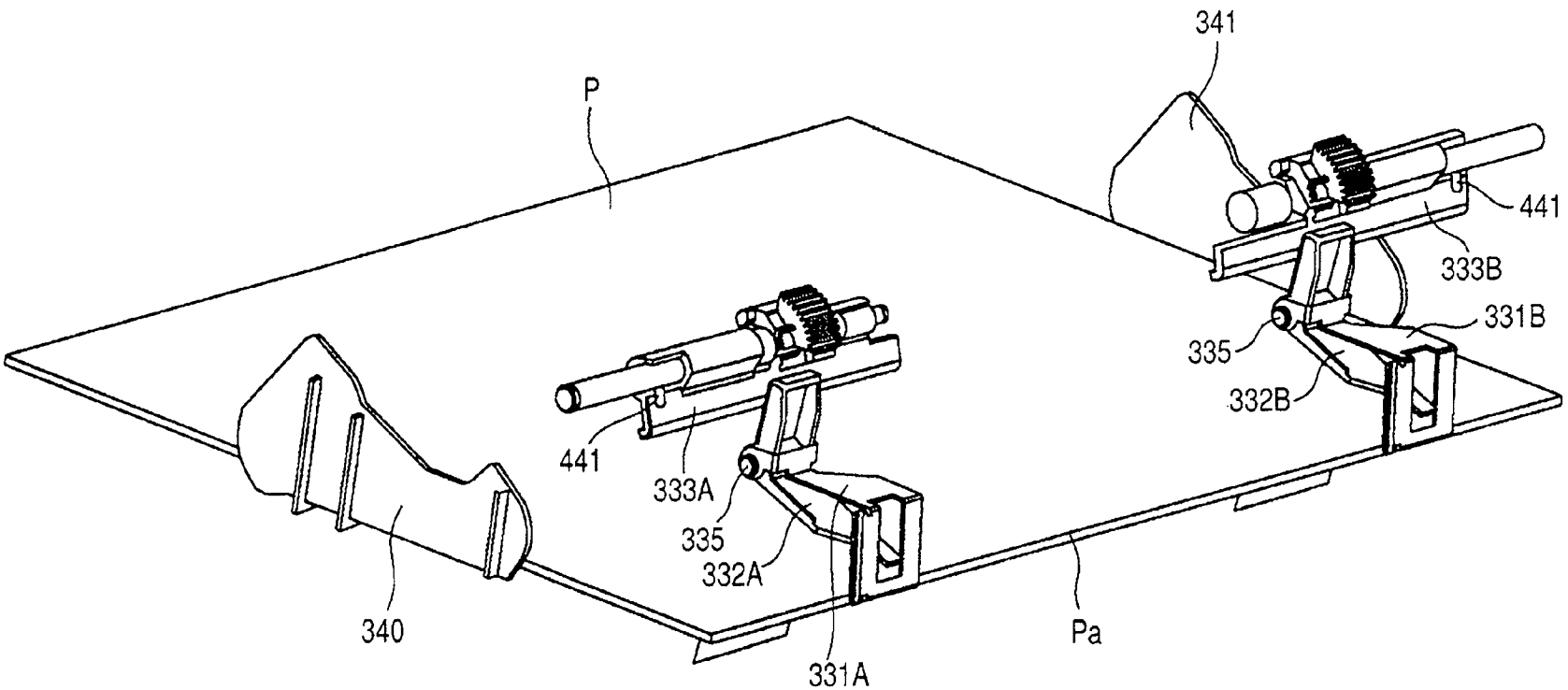
FIG. 10 is a perspective view showing a layout relationship between the trailing end stopper and a trailing end level.

When in a sheet bundle stapling mode, the trailing end stoppers 331A, 331B can, as shown in FIGS. 9A and 9B, align the trailing ends of the sheets while receiving the trailing ends of the sheets in positions off a clinch area of the stapler 301 also with respect to the sheets having different sizes or different stapling positions. This is because if the trailing end stopper 331 and the trailing end lever 332 exist in the same stapling position of the stapler 301, the trailing end stopper 331 might be nipped in by a clinch of the stapler 301. Along with this, whichever position in the moving area the trailing end stopper 331 and the trailing end lever 332 exist, the lever stoppers 333A, 333B are long enough to receive the rotation of the trailing end lever 332. With this configuration, as shown in FIG. 10, even when the trail end stoppers 331A, 331B and the trailing end levers 332A, 332B in the widthwise direction of the sheet, trailing end levers 332A, 332B abut on the lever stoppers 333A, 333B. Note that the lever stoppers 333A, 333B may also move in the widthwise direction of the sheet. In this case, the lever stoppers 333A, 333B may move with the trailing end levers 332A, 332B while facing the trailing end levers 332A, 332B. If these configurations are adopted, it is possible to decrease the length of each of the lever stoppers 333A, 333B.

Next, an operation of the finisher 600 will be explained. Note that an example of setting A4 as a sheet size will be exemplified.

A flow of the sheet P when in a non-sort mode will be described.

Figure 11:
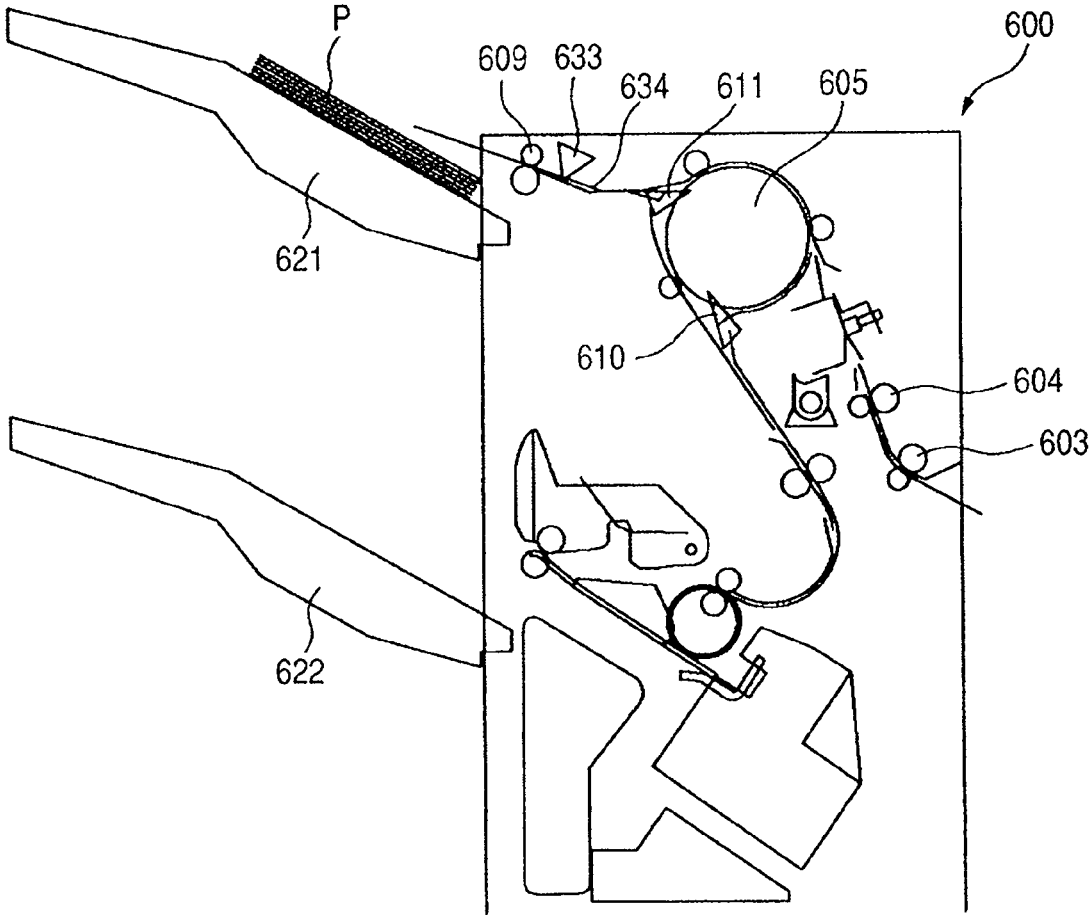
FIG. 11 is an explanatory view showing an operation when in a non-sort mode in a finisher.

When a user designates non-sort setting for a sheet discharge mode in the image forming apparatus, as shown in FIG. 11, the first changeover flapper 611 is changed over in order to guide the sheet to a non-sort path 634. In this state, the entrance roller pair 603, the first conveying roller pair 604 and the buffer roller 605 are each rotationally driven and take into the apparatus the sheets P discharged from the apparatus main body 100 of the image forming apparatus and convey the sheets P toward the non-sort path 634.

Then, when the leading end of the sheet P is detected by a non-sort path sensor 633, a second delivery roller pairs 609 is rotationally driven at a speed suited to stacking the sheets, and delivers and stacks the sheets P onto the sample tray 621.

A flow of the sheet P when in a staple sort mode will be explained.

Figure 12:
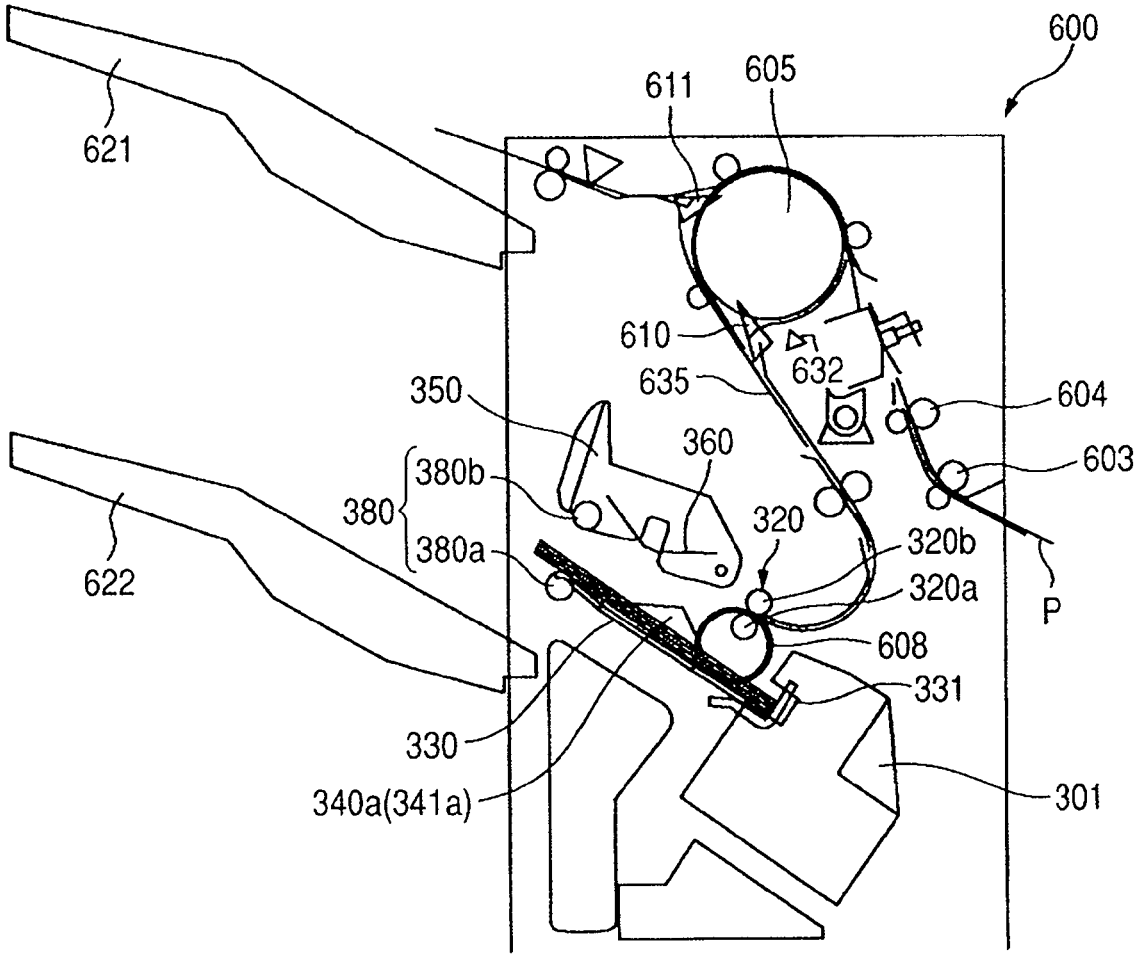
FIG. 12 is an explanatory view showing an operation of delivering the sheet to the intermediate process tray when in a staple mode in the finisher.

When the user designates staple sort setting for the sheet discharge mode in the image forming apparatus, as show in FIG. 12, the first changeover flapper 611 and the second changeover flapper 610 are changed over in order for the sort path 635 to receive the sheet P. In this state, the entrance roller pair 603, the first conveying roller pair 604 and the buffer roller 605 are each rotationally driven and take into the apparatus the sheets P discharged from the apparatus main body 100 of the image forming apparatus and convey the sheets P toward the sort path 635. Then, the sheets P are delivered onto the intermediate process tray 330 by the knurled belt 608 of the delivery roller 320*a* configuring the first delivery roller pair 320 and by the delivery roller 320*b*. Thereafter, the rocking arm 350 opens upward, whereby the upper delivery roller 380*b* of the sheet-bundle delivery roller pair 380 gets apart from the lower delivery roller 380*a*.

The sheets P delivered onto the intermediate process tray 330 start returning to the side of the trailing end stopper 331 by their self-weight, and, in addition to the self-weight, the return action is accelerated as the pull-in paddle 360 stopping in the home position rotates counterclockwise. When the trailing end of the sheet P abuts on the trailing end stopper 331 while being guided by the trailing end lever 332 and then stops, the pull-in paddle 360 also stops rotating. Subsequently, the first and second side stoppers 340*a*, 341*a* align the side ends of the sheets P (widthwise alignment). Thereafter, the stapler 301 staples the sheet bundle, and the sheet-bundle delivery roller pair 380 delivers the sheet bundle in the closed state of the rocking arm 350, through which operations the sheet bundle is delivered to and placed onto the stack tray 622. The pull-in paddle 360 returns to the original position after the sheet bundle has been stapled.

Figure 13:
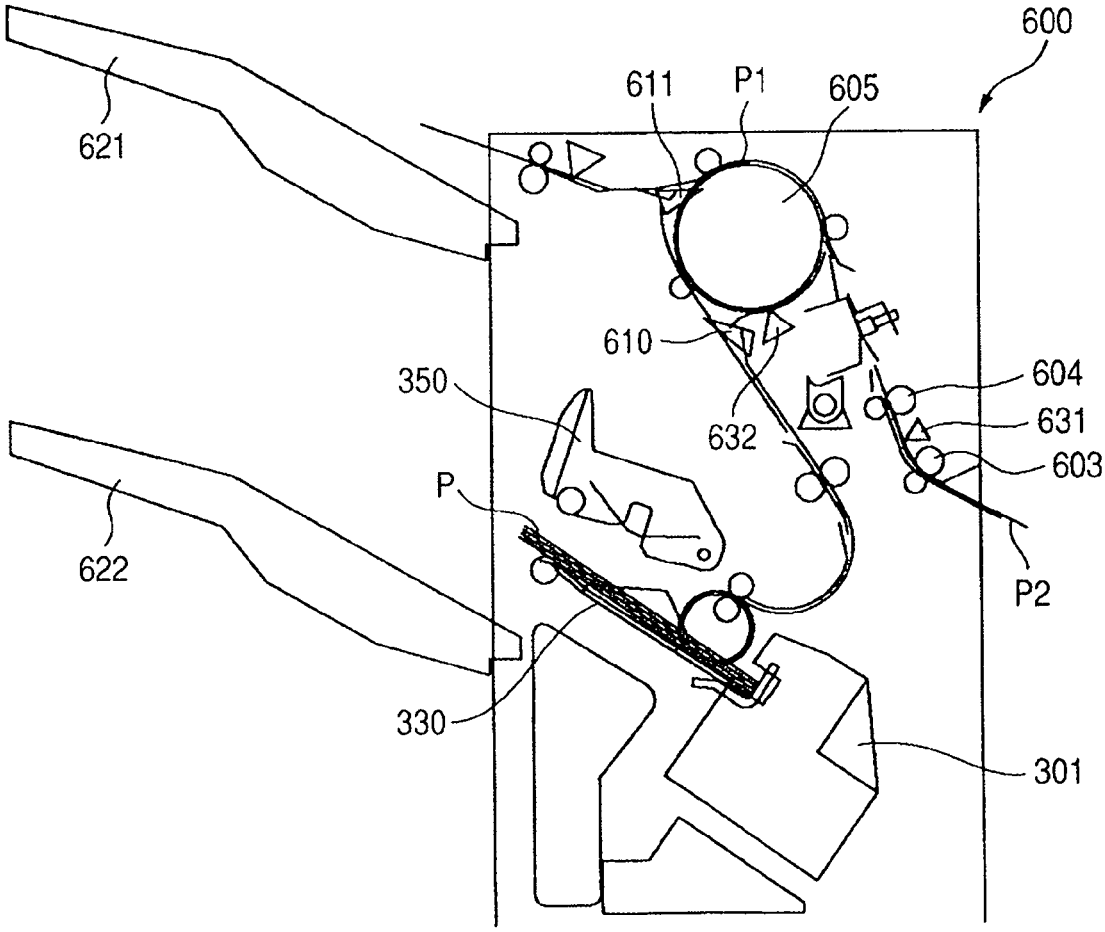
FIG. 13 is an explanatory view showing an operation after delivering the sheet to the intermediate process tray when in a staple sort mode in the finisher.
Figure 14:
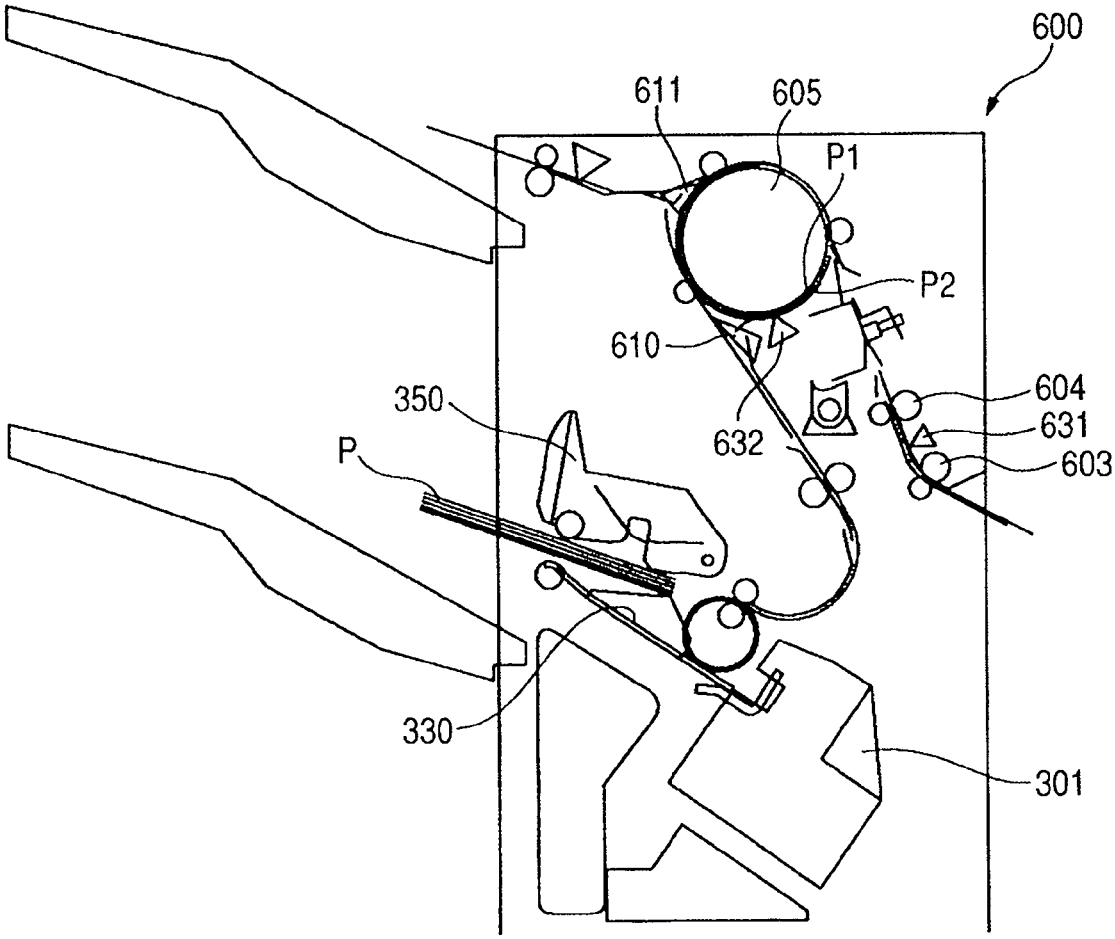
FIG. 14 is an explanatory view showing an operation pf delivering the sheet bundle from the intermediate process tray when in the staple sort mode in the finisher.
Figure 15:
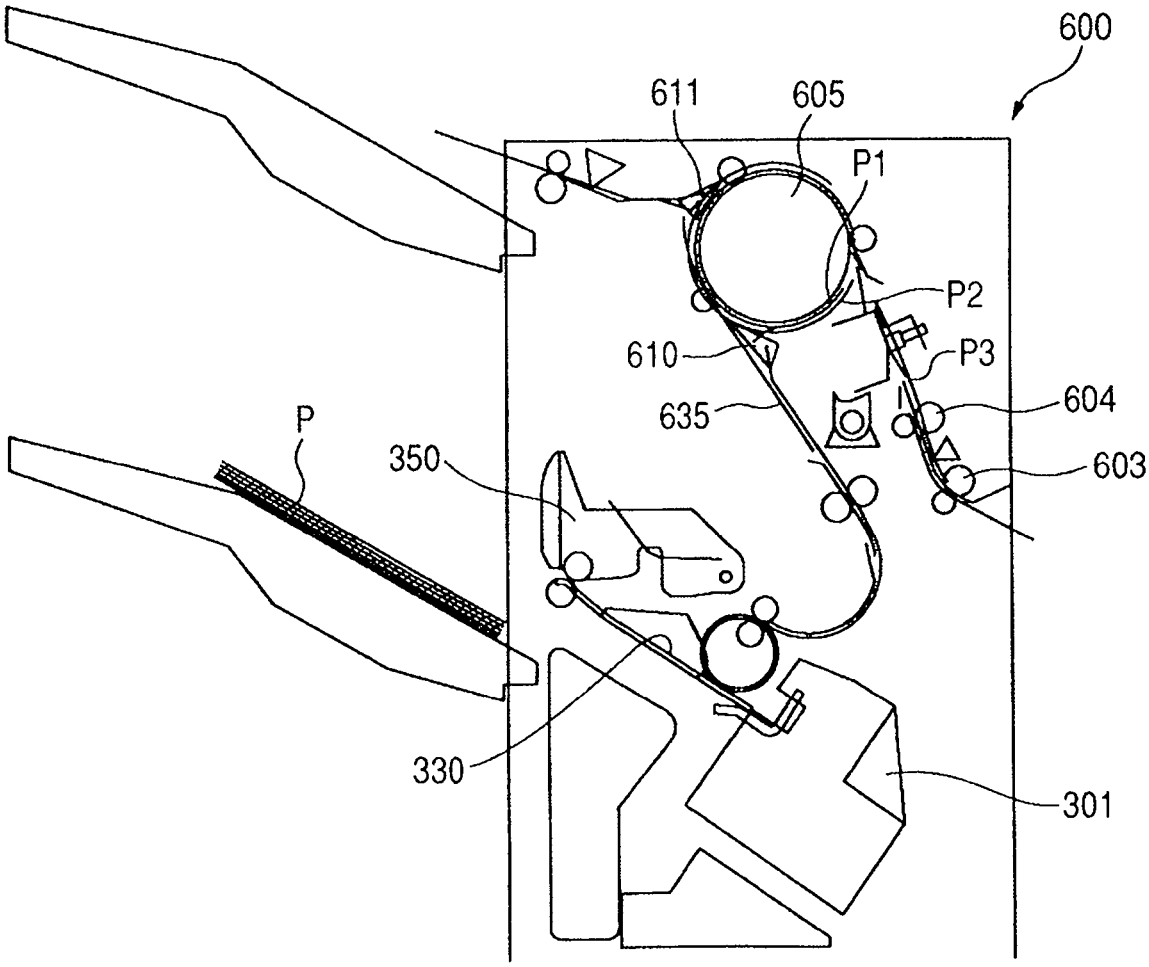
FIG. 15 is an explanatory view showing a superposed state of the sheets in a buffer roller of the finisher.
Figure 16:
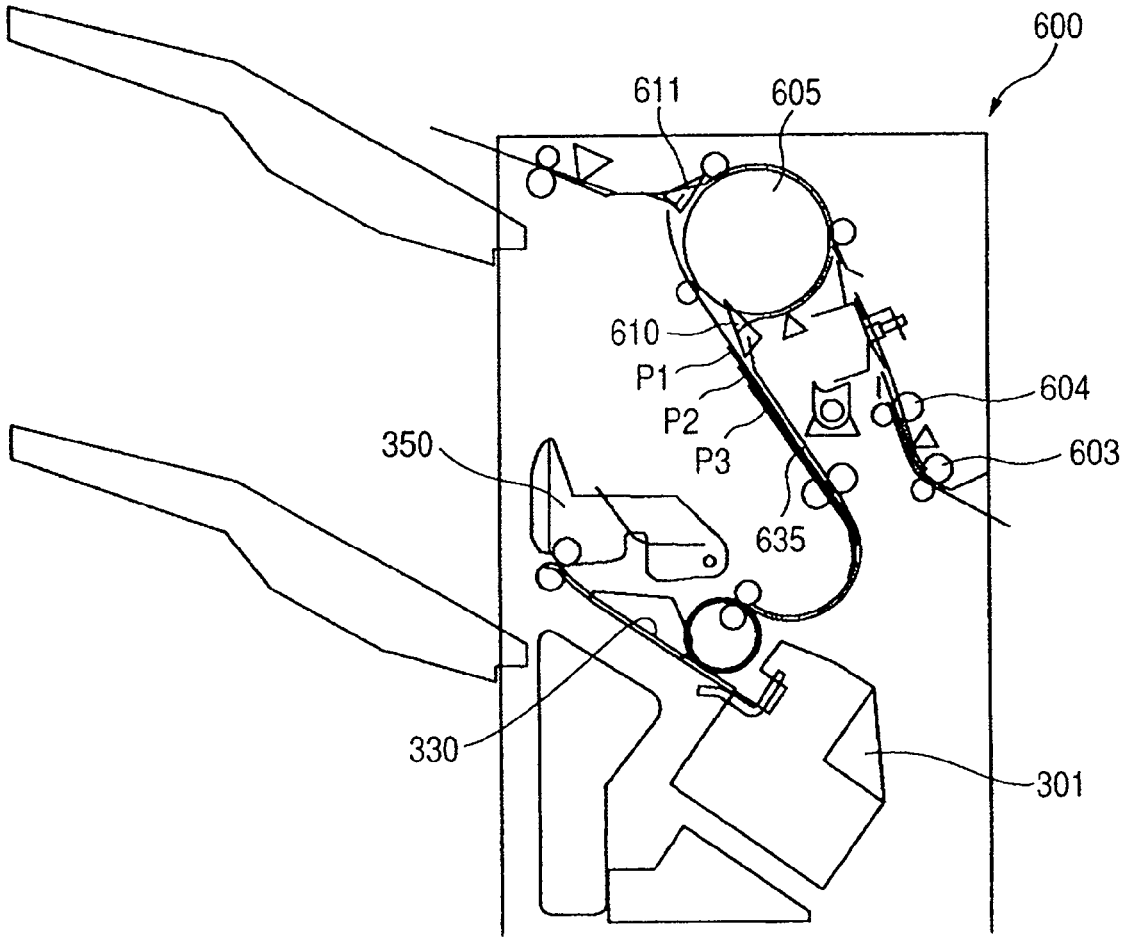
FIG. 16 is an explanatory view showing the superposed state of the sheets in the finisher.

On the other hand, as shown in FIG. 13, when the preceding sheet bundle P is subjected to the stapling process, a subsequent sheet P1 discharged from the apparatus main body 100 of the image forming apparatus is wound around the buffer roller 605 by the changeover operation of the second changeover flapper 610 and, in a position of advancing a predetermined distance from a buffer path sensor 632, stands by as the buffer roller 605 stops. At a point where the leading end of a next sheet P2 advances a predetermined distance from an entrance sensor 631, as shown in FIG. 14, according as the buffer roller 605 rotates, in a state where the second subsequent sheet P2 is superposed on the first subsequent sheet P1 in such a way that the sheet P2 gets more ahead by a predetermined length than the sheet P1, as illustrated in FIG. 14, the second subsequent sheet P2 is again wound around the buffer roller 605. Further, as shown in FIG. 15, a third sheet P3 is similarly wound around the buffer roller 605. As illustrated in FIG. 16, thereafter, the second changeover flapper 610 is changed over again and guides, to the sort path 635, the three sheets P1, P2, P3 superposed on each other in the way that the leading ends of theses sheets deviate (offset) by a predetermined length.

Figure 17:
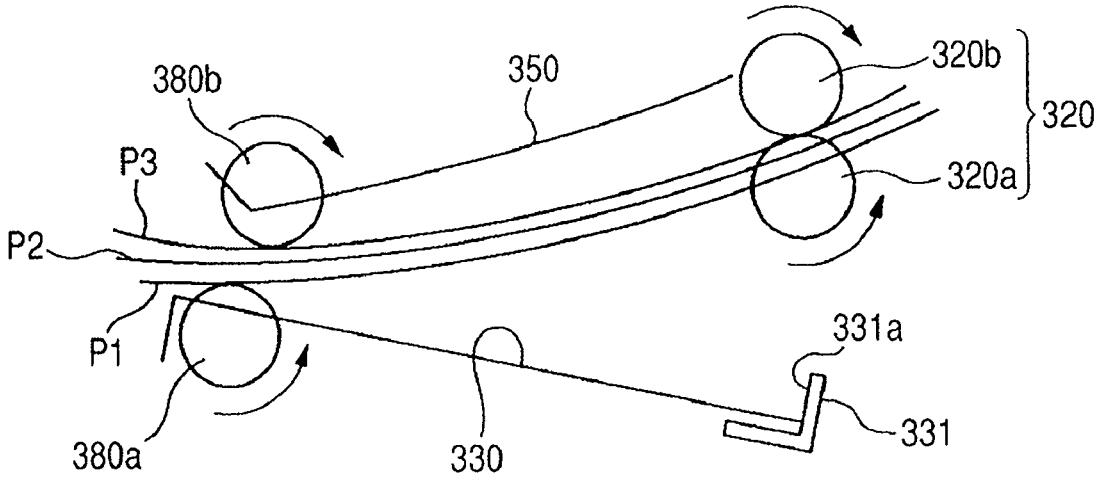
FIG. 17 is an explanatory view showing an operation of delivering the superposed sheets to the intermediate process tray in the finisher.
Figure 18:
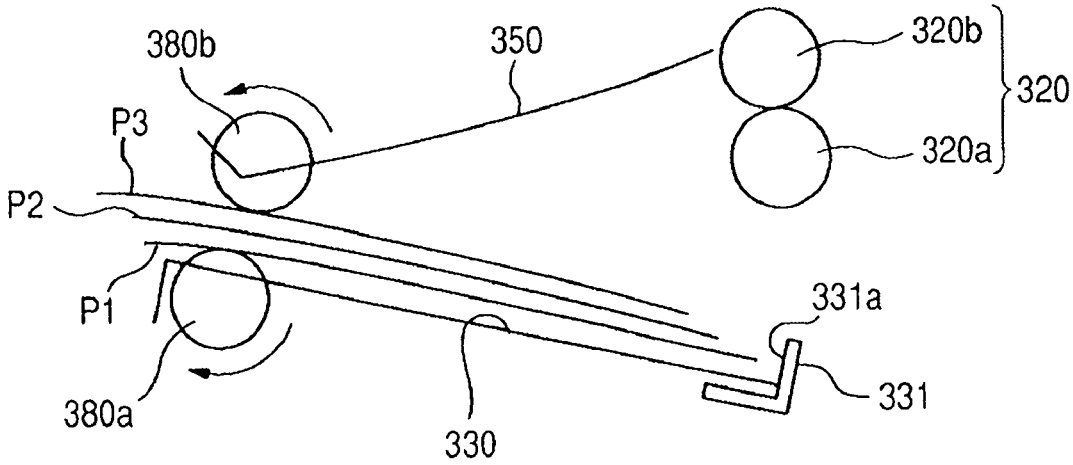
FIG. 18 is an explanatory view showing an operation when the superposed sheets are stacked on the intermediate process tray in the finisher.
Figure 19:
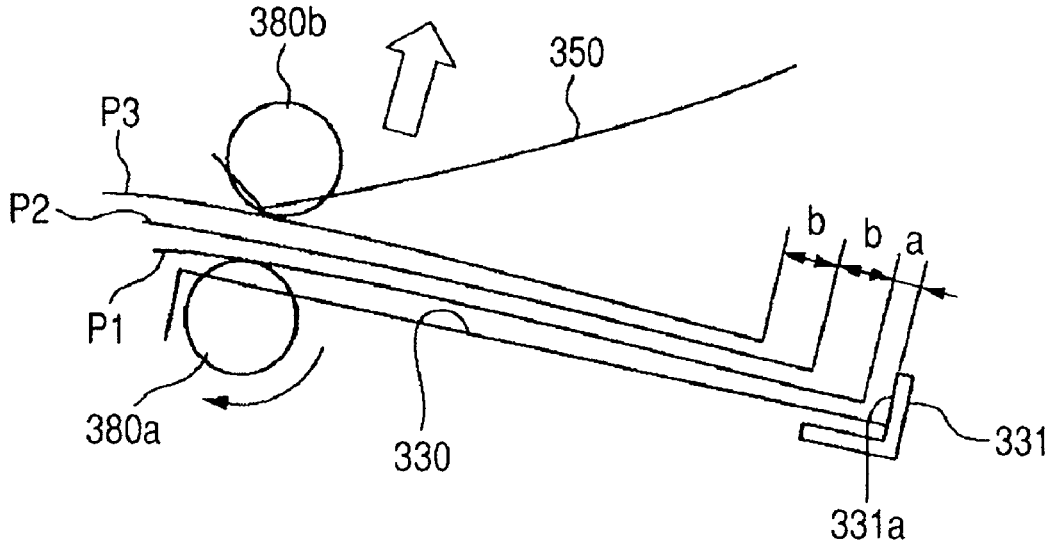
FIG. 19 is a view showing a deviation between the sheets.
Figure 20:
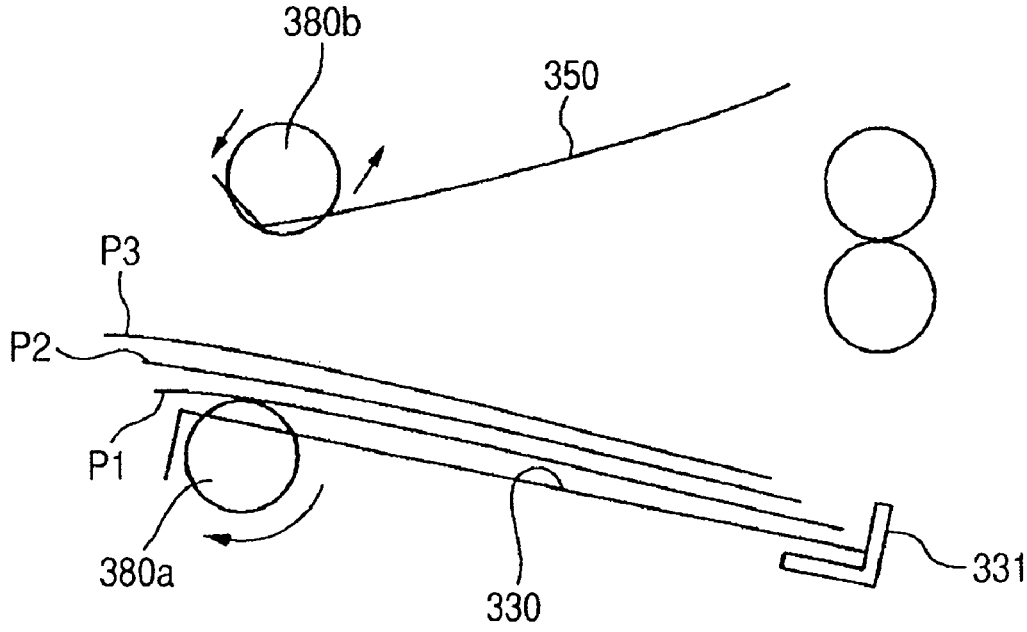
FIG. 20 is a view showing a state enabling the fourth sheet to be received.

At this point of time, the preceding sheet bundle P has been delivered in bundle. As shown in FIG. 17, while the rocking arm 350 remains closed, the pair of sheet-bundle delivery rollers 380*a*, 380*b* rotating forward in the delivery direction temporarily receive the three sheets P1, P2, P3 that are delivered thereto. Then, as illustrated in FIG. 18, when the terminating ends of the three sheets P1, P2, P3 pass through the delivery rollers 320*a*, 320*b* of the first delivery roller pair 320 and are stacked onto the intermediate process tray 330, the pair of sheet-bundle delivery rollers 380*a*, 380*b* pulls the three sheets P1, P2, P3 back on the upstream side. Before the terminating ends of the three sheets P1, P2, P3 abut on the support surface 331*a* of the trailing end stopper 331, for example, as shown in FIG. 19, at a point of time when getting as close as having an interval a between the support surface 331*a* of the trailing end stopper 331 and the trailing ends (strictly speaking, the trailing end of the sheet P1) of the three sheets P1, P2, P3 each mutually having an interval b, as shown in FIG. 20, the rocking arm 350 opens so as to separate the pair of sheet-bundle delivery rollers 380*a*, 380*b* from each other. Then, the fourth and subsequent sheets P are delivered onto the intermediate process tray 330 via the sort path in the same way as the operation for the first sheet bundle. As to the third and subsequent sheet bundles, the predetermined number of sheets are stacked on the stack tray 622 by repeating the same operations for the second sheet bundle, thus finishing the process.

As described above, in conveying the plurality of sheets supposed on each other, the individual sheet P is offset in the delivery direction. Namely, the sheet P2 is offset from the sheet P1 on the downstream side, and the sheet P3 is offset from the sheet P2 on the downstream side. An offset amount between the sheets P and the roller pair separation (ascendance) start timing of the rocking arm 350, depend on the settling time of the sheets P based on the return speed between the pair of sheet-bundle delivery rollers 380*a*, 380*b*. Namely, these elements are determined based on a processing capacity (throughput) of the apparatus main body 100 of the image forming apparatus 100. In the first embodiment, under such conditions that a conveying speed of the sheet P is on the order of 1000 mm/s, an offset amount b=approximately 3 mm and sheet-bundle delivery roller return speed is on the order of 500 mm/s, the sheet-bundle delivery roller separation start position or timing is set at a point of time when the terminating end of the sheet P1 reaches a point as close to the surface of the trailing end stopper 331 as about 30 mm (the value of the interval a) just before the terminating end thereof abuts on the surface of this stopper 331.

The description of the sort mode will be given.

Figure 21:
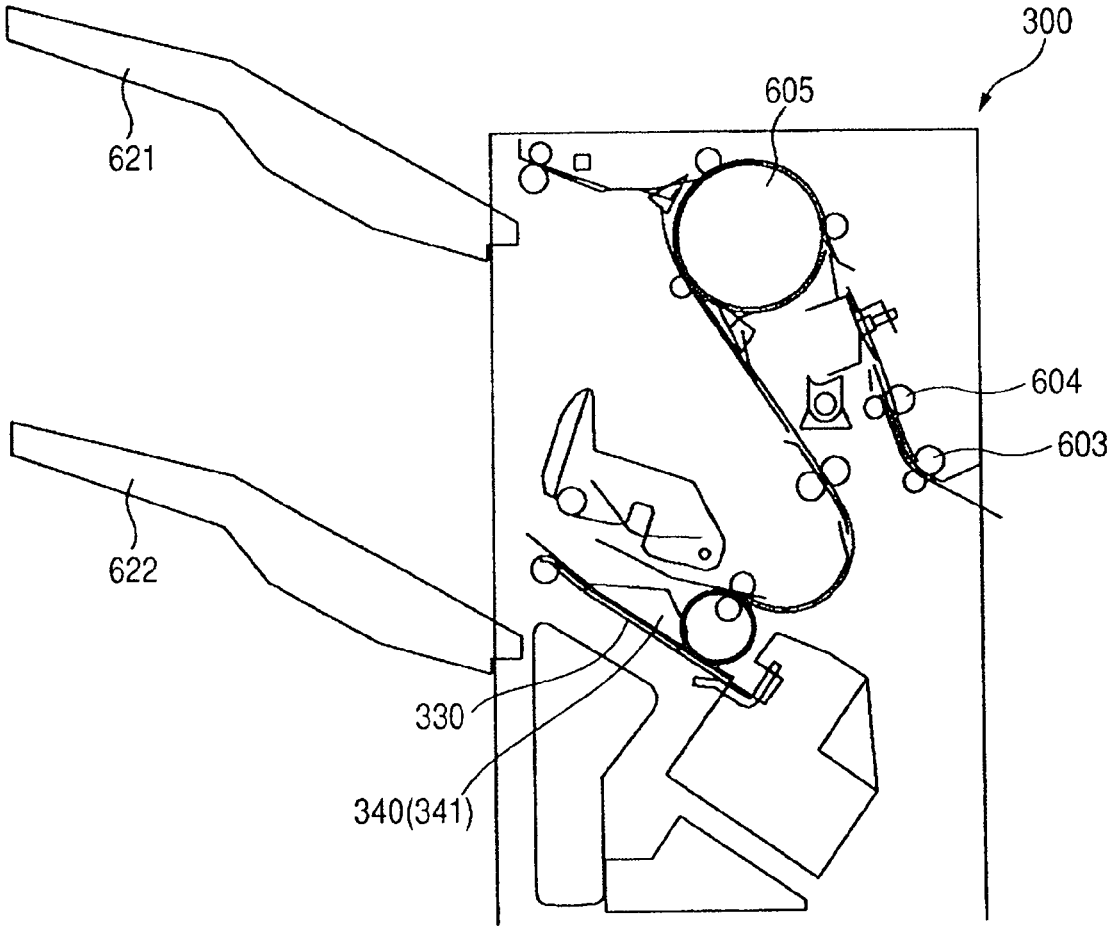
FIG. 21 is an explanatory view showing an operation of delivering the sheets to the intermediate process tray when in the sort mode of the finisher.
Figure 22:
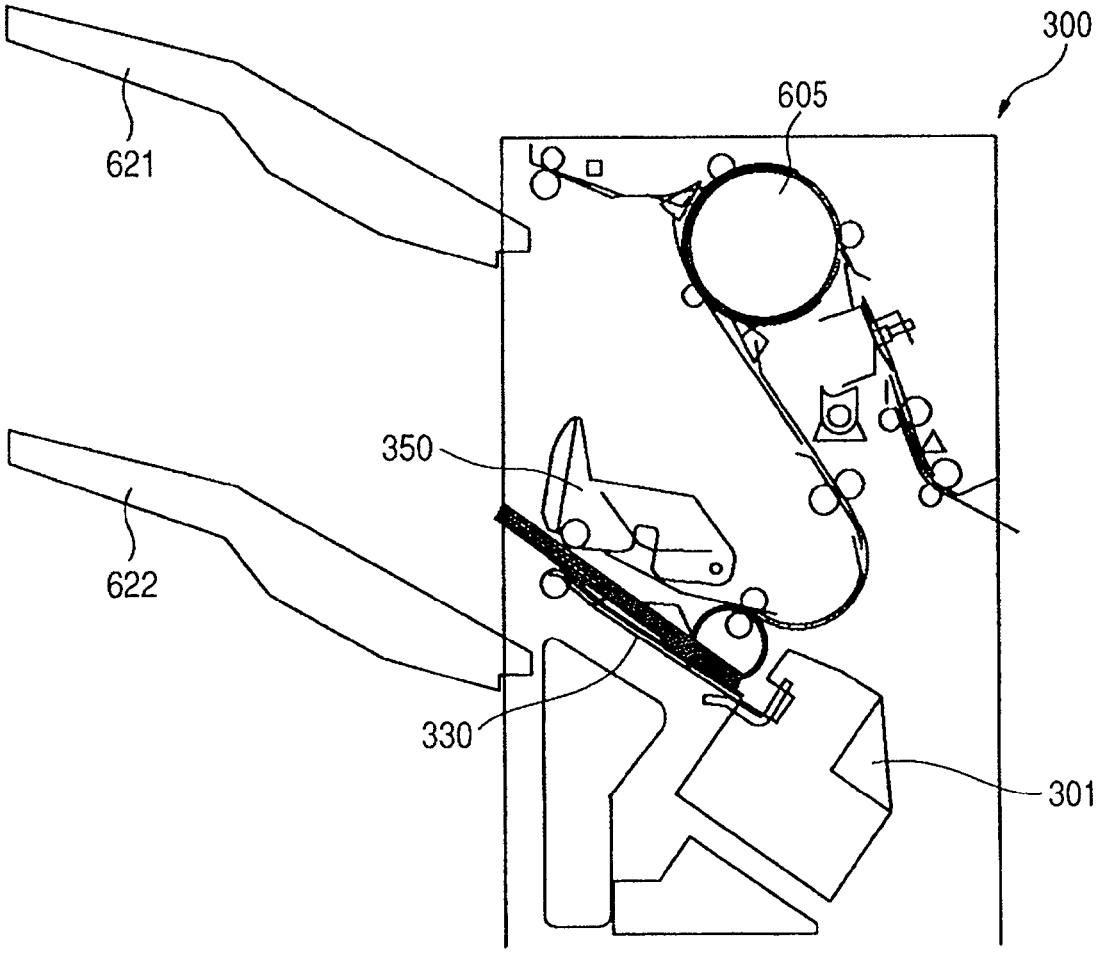
FIG. 22 is a view showing a state where the sheets are stacked on the intermediate process tray when in the sort mode of the finisher.

The user, after setting an original on an original reading portion of the apparatus main body 100 of the image forming apparatus, designates the sort mode through on an unillustrated operating portion, and turns ON an unillustrated start key. With this operation, the entrance roller pair 603 and the first conveying roller pair 604, as shown in FIG. 21, convey and stack the sheets P onto the intermediate process tray 330 in the same manner as in the case of the staple sort mode. The first and second alignment portions 340, 341 align the sheet bundle in terms of its width on the intermediate process tray 330. When a small number of sheets are stacked on the intermediate process tray 330, as shown in FIG. 22, the rocking arm 350 descends in the closing direction, thus conveying the small number of sheets in bundle.

Next, the sheets P, which are conveyed, are herein also, in the same way as in the case of the staple sort mode, temporarily wound around the buffer roller 605 and delivered onto the intermediate process tray 330 after finishing the delivery of the preceding sheet bundle.

Figure 23:
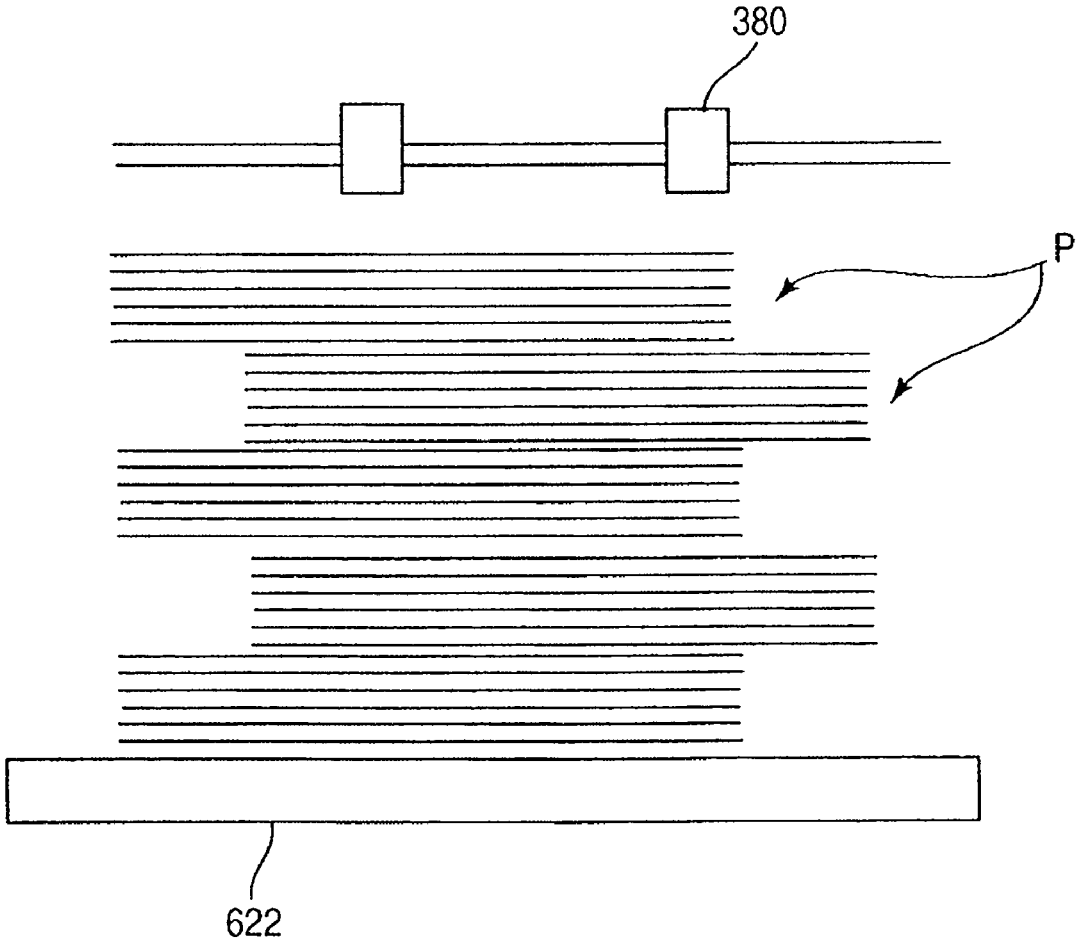
FIG. 23 is a view when the sheet stacks are offset-stacked.

When the delivery of the first sheet bundle has all been finished, one alignment portion 340 moves together with the other alignment portion 341 and makes the alignment position for the second sheet bundle offset from the alignment position for the first sheet bundle (an in-depth description of this operation will be given later on). The second sheet bundle is aligned in the offset position and is delivered by a small number of sheets in the same manner as the first sheet bundle was. When finishing offsetting the second sheet bundle, the first and second alignment portions 340, 341 return to the position in which to align the first preceding sheet bundle and align the third sheet bundle. Thus, as illustrated in FIG. 23, all the set number of sheet bundles are completed in a way that makes the sheet bundles offset from each other.

A alignment operation for the sheets on the intermediate process tray 330 will be explained.

(Explanation of Sheet Widthwise Alignment Operation by First and Second Alignment Portions)

Figure 24:
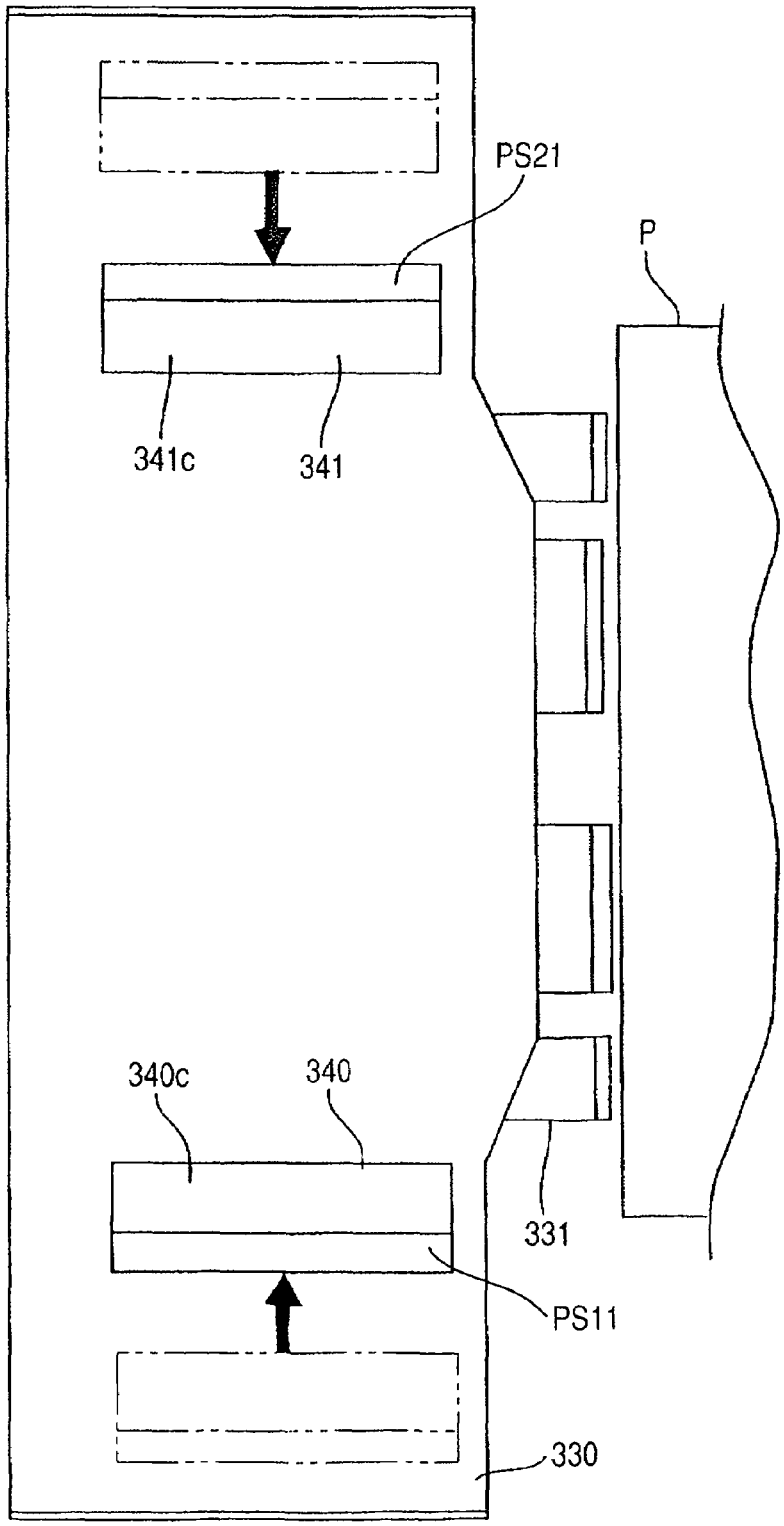
FIG. 24 is a plan view of the intermediate process tray, showing positions of first and second alignment members in a two-point stapling mode of the stapler.

To begin with, if there is none of the sheet P on the intermediate process tray 330, i.e., when the first sheet bundle P (three sheets) in the job concerned is delivered, as shown in FIG. 24, the first and second alignment portions 340, 341 standing by in the home position move previously to positions PS11, PS21 each slightly deviating outside from the width of the sheet P to be delivered.

Figure 25:
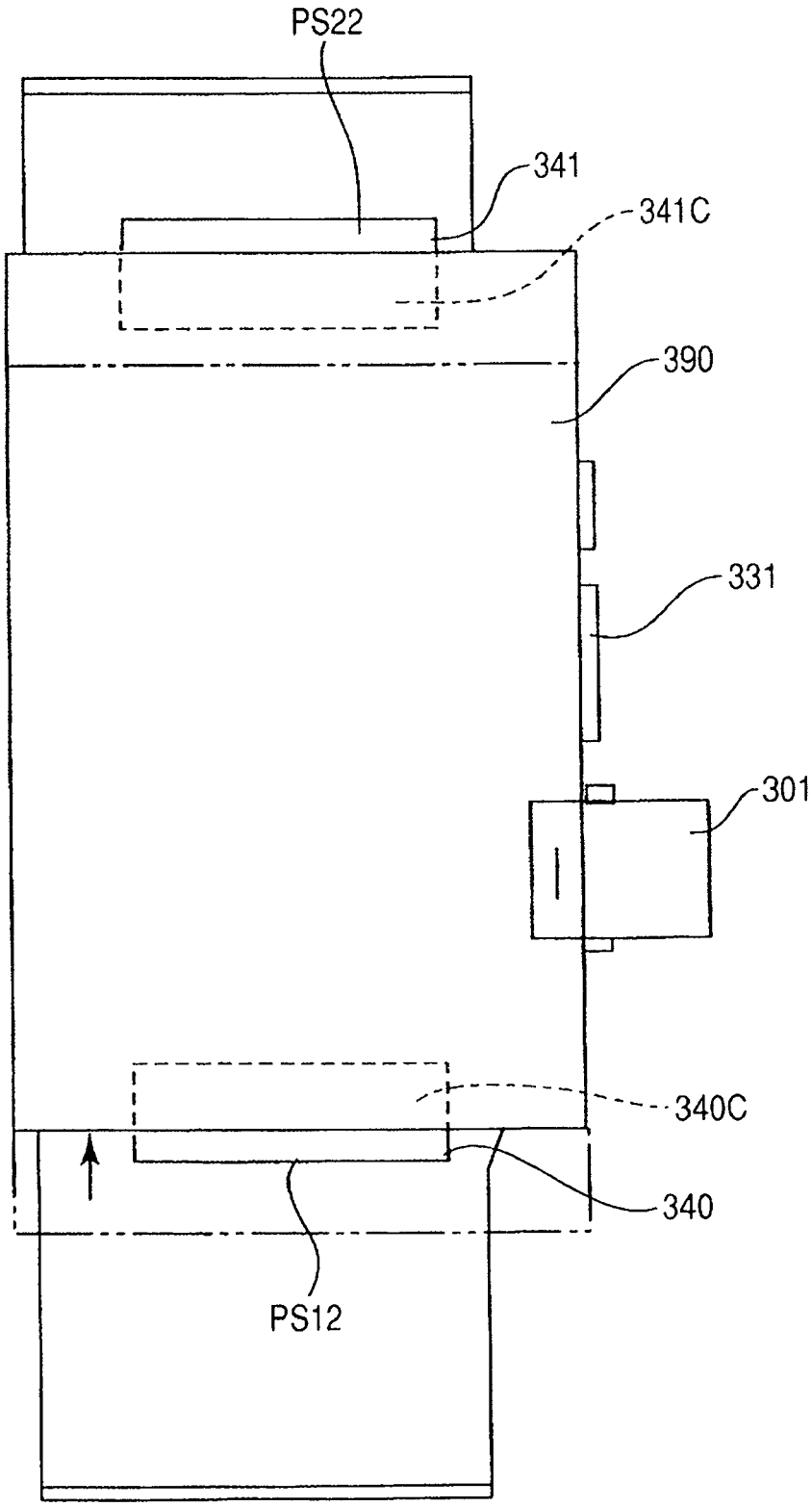
FIG. 25 is a plan view of the intermediate process tray when the sheets are aligned widthwise by the first and second alignment members.

As described above, when the trailing ends of the three sheets P are supported by the trailing end stopper 331 and the undersurfaces of these sheets P are supported by the support surfaces 340*c*, 341*c* of the first and second alignment portions 340, 341 respectively, the first and second alignment portions 340, 341, as shown in FIG. 25, shift to the positions PS12, PS22, then move the sheets P to a first alignment position 390 and align their widths. Thereafter, the first alignment portion 340 returns to the position P511 and stands by in preparations for the sheets P to be delivered subsequently. Then, the first alignment portion 340, when delivering the sheets, shifts again to the position PS12 and moves the delivered sheets P to the first alignment position 390 and align the sheets P.

Hereat, the second alignment portion 341 continues to stop in the position PS22, thereby performing a role of a reference position. The operations described so far continue till reaching the last sheet P of the sheet bundle.

The first sheet bundle, of which the alignment has been completed, is subjected to the sheet-bundle shifting process and stapling process as the necessity may arise and is delivered to and stacked on the stack tray 622 shown in FIG. 1.

Figure 26:
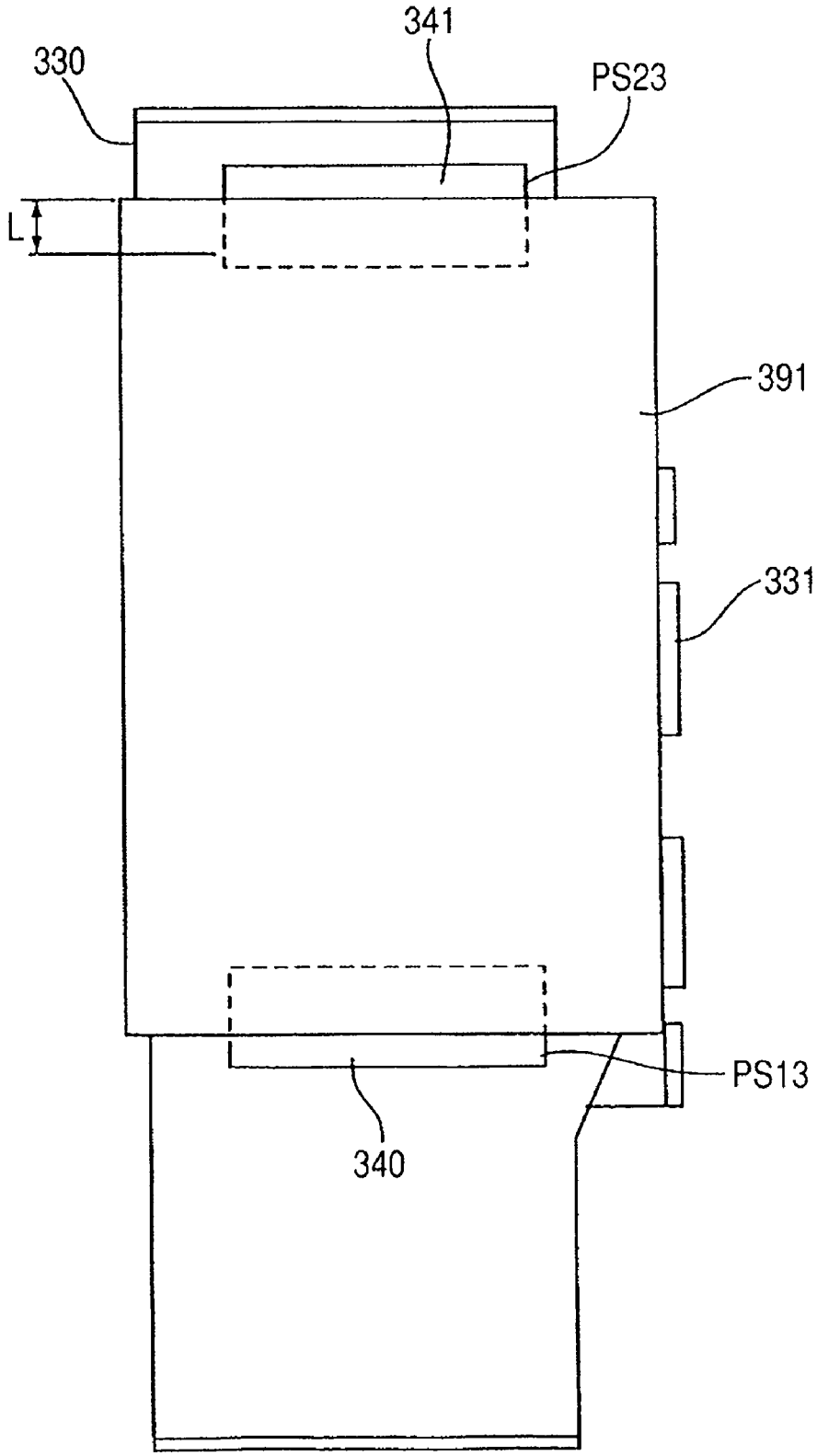
FIG. 26 is a plan view of the intermediate process tray when the sheets are aligned widthwise by the first and second alignment members in the case of offset-stacking.

Subsequently, the second sheet bundle P (three sheets) is delivered to the intermediate process tray 330, however, at this time, even though the first and second alignment portions 340, 341 stand by in the positions PS11, PS21 in the same way as for the first sheet bundle, the alignment position thereof shifts to a second alignment position 391 (see FIG. 26). The second alignment position 391 deviates by a predetermined amount L on one side from the first alignment position 390 (see FIG. 25).

Namely, from this onward, the sheet bundles are stacked on the stack tray 622 in a way that changes the alignment position each time a sheet bundle discharges, thereby enabling the sheet bundles to be sorted and stacked according to the offset amount L.

Herein, the offset amount L may be changed depending on the sort mode and the staple mode. For instance, the offset amount L is, when in the staple mode, set to an amount L1 (approximately 15 mm) enabling the stitch needles for the adjacent sheet bundles after stacking the sheet bundles from being overlapped, and is, when in the sort mode, set to an amount L2 (approximately 20 mm-30 mm) that improves visual recognizability for distinguishing between the sheet bundles. This offset amount setting can reduce a alignment moving distance when in the staple mode and can improve the processing speed.

(Explanations of Operations of Trailing End Stopper and Sheet Conveying Guide (Explanation of Sheet Trailing End Alignment Operation))

Figure 27:
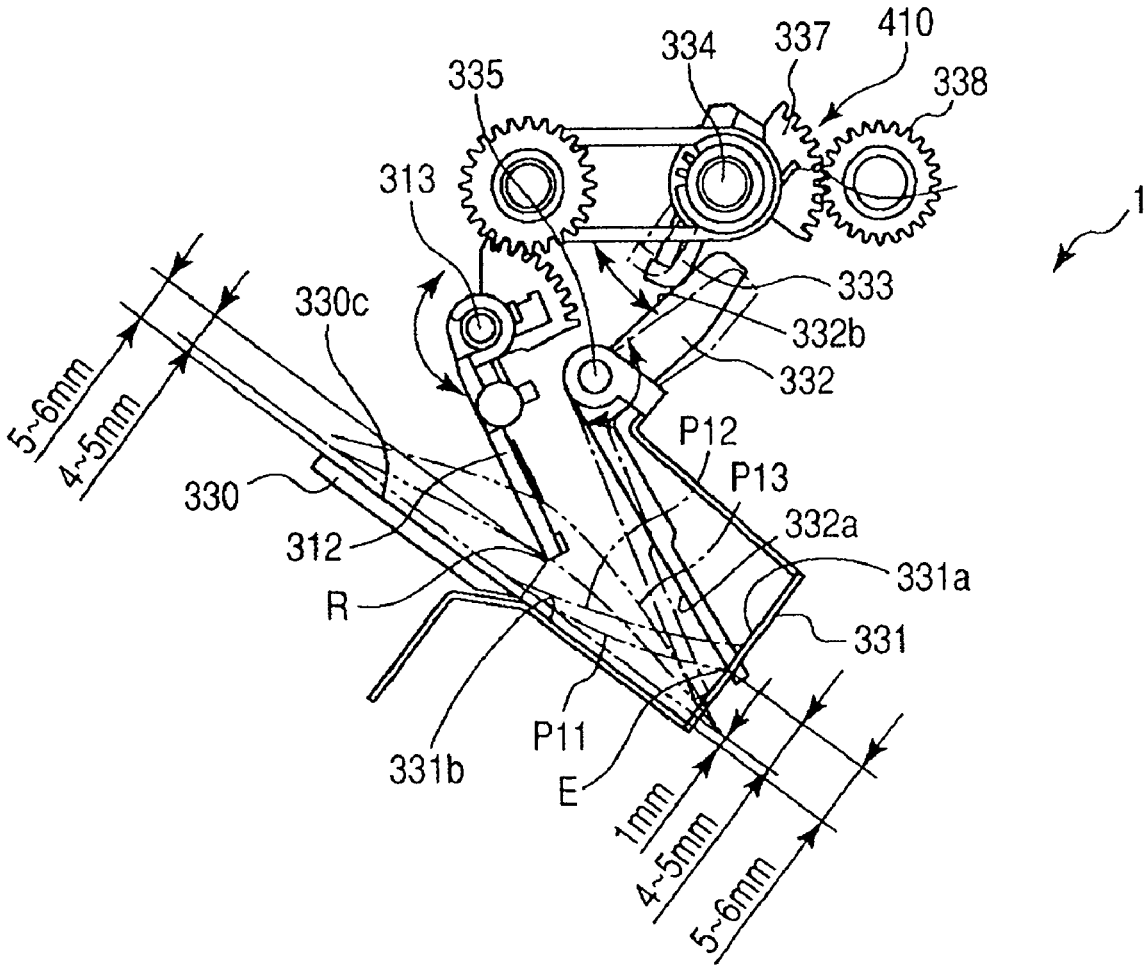
FIG. 27 is an explanatory view of an operation till ten sheets are stacked in the sheet stacking apparatus in the first embodiment of the present invention.

Explained next with reference to FIGS. 27 through 30 is an operation in which the trailing end stopper 331 aligns the trailing ends of the sheets when the user sets, for example, a 100-sheet side stitch mode. Note that the sheet stacking apparatus 1 has, as shown in FIGS. 7 and 27, the torsional coil spring 336. The lever stopper 333 is rotatably provided at the rotary shaft 334. The lever stopper 333 is, however, made to abut on the protruded piece 411 shown in FIG. 7 by the torsional coil spring 336, thereby regulating the rotation of the lever stopper 333. The torsional coil spring 336, of which one end is provided at the lever stopper 333 and the other end is provided at the rotary shaft 334, rotates integrally with the rotary shaft 334 and the lever stopper 333 in the rotating direction. In the sheet stacking apparatus 1 also, the sheets are pressed by the self-weight of the trailing end lever 332.

It should be noted that in a sheet stacking apparatus 1A in a second embodiment which will hereinafter be described, the lever stopper 333 receives and hinders the rotation of the trailing end lever 332, however, in the sheet stacking apparatus 1 in the first embodiment, the lever stopper 333, after the trailing end lever 332 has abutted on the lever stopper 333, rotates resisting the torsional coil spring 336.

As shown in FIG. 27, when none of the sheet P is stacked on the intermediate process tray 330, the rotary shaft 334 stops rotating in an initial position. The lever stopper 333 is rotationally biased (energized) by the torsional coil spring 336 and received by the protruded piece 411 protruding from on the rotary shaft 334, thus regulating the rotation of the lever stopper 333 in the initial position.

Such setting is done that a gap of, e.g., approximately 5 mm to 6 mm is formed between a tip E of the trailing end lever 332 and the sheet stacking surface 331*b* of the trailing end stopper 331 when the trailing end lever 332 abuts on the lever stopper 333. The gap between the trailing end lever 332 and the sheet stacking surface becomes a conveying path space. Another setting is that gaps of approximately 5 mm to 6 mm are formed between the tip R of the conveying guide 312 serving as the sheet conveying guide, the stacking surface 330*c* of the intermediate process tray 330 and the sheet stacking surface 331*b* of the trailing end stopper 331. Namely, the trailing end lever 332 has rotational allowance corresponding to the gap (approximately 5 mm to 6 mm), and the gap (approximately 5 mm to 6 mm) between the conveying guide 312 and the sheet stacking surface also becomes a conveying path space.

When the sheets are not stacked on the intermediate process tray 330, the trailing end lever 332 rotates rightward by dint of the self-weight, then the tip E thereof abuts on the sheet stacking surface 331*b* of the trailing end stopper 331, and the abutting portion 332*b* gets apart from the lever stopper 333. Namely, a clearance is formed between the trailing end lever 332 and the lever stopper 333.

The sheet, when sliding on the stacking surface 330*c* of the intermediate process tray 330 and abutting on the support surface 331*a* of the trailing end stopper 331, pushes up the trailing end lever 332 to a degree corresponding to a thickness of the sheet. When the ten sheets are stacked on the intermediate process tray 330, supposing that each sheet is approximately 0.1 mm in thickness, the sheet stacking height becomes approximately 1 mm, and the trailing end lever 332 rotates leftward to a degree corresponding to the sheet stacking height. As a result, gaps of about 4 mm to 5 mm are formed between the tip E of the trailing end lever 332, the tip R of the conveying guide 312 and the tenth sheet. Namely, each of the rotational allowance of the trailing end lever 332 and the conveying path space comes to have a value of approximately 4 mm to 5 mm. This rotational allowance is provided for, when a sheet P11 with its trailing end curled upward is fed in, receiving this upward-curled sheet P11 without causing any paper jam, and for restraining upward floating of the sheet. If the sheet is a curled sheet P12 causing the trailing end lever 332 to rotate more than the rotational allowance of the trailing end lever 332, the curled sheet P12 pushes up and makes the trailing end lever 332 abut on the lever stopper 333, thereby forcing the lever stopper 333 to rotate resisting the torsional coil spring 336 in such a right direction-as to separate from the protruded piece 411 shown in FIG. 7. The curled sheet P12 acts to force the trailing end lever 332 and the lever stopper 333 to rotate resisting the torsional coil spring 336, and hence the floating can be restrained by reaction of the torsional coil spring 336. Further, the conveying path space between the tip R of the conveying guide 312 and the tenth sheet serves to, when a sheet P13 with its trailing end curled downward is fed in, convey the downward-curled sheet P13 toward the trailing end stopper 331 while restraining a crest-shaped vertex portion of the middle portion of the downward-curled sheet P13 and to align this sheet P13. Accordingly, stiffness of the sheet in the delivery direction is increased by flattening the sheet, whereby a property of alignment with the support surface 331*a* of the trailing end stopper 331 can be enhanced. In the manner described above, the sheet, whether curled upward or downward, abuts on the trailing end stopper 331, thereby aligning the trailing end of the sheet.

Figure 28:
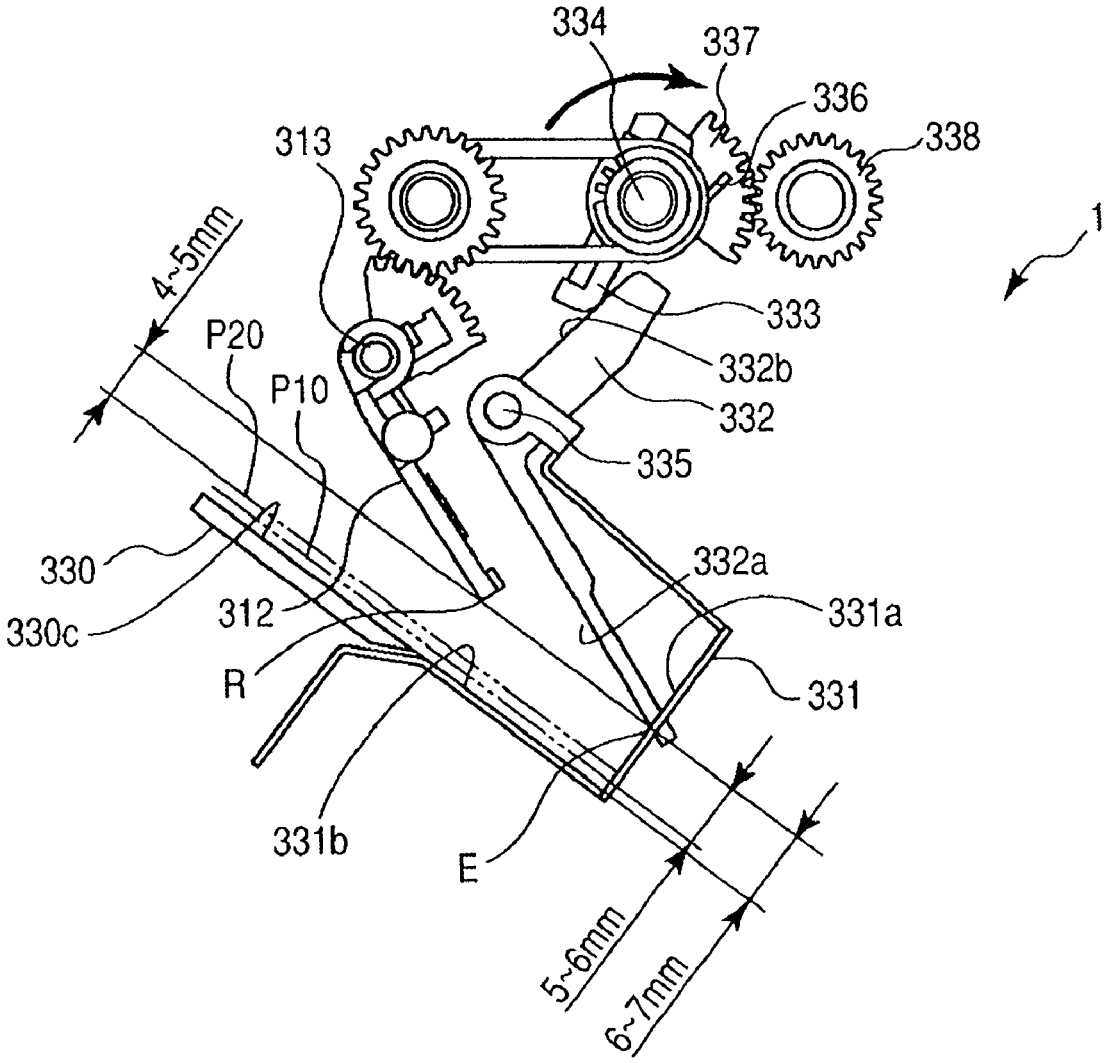
FIG. 28 is an explanatory view of an operation till twenty sheets are stacked in the sheet stacking apparatus in FIG. 27.

When finishing the abutting alignment of the tenth sheet, as shown in FIG. 28, the rotary shaft 334 is rotated through approximately 2 degrees clockwise (in the arrow-headed direction). The lever stopper 333, following up the rotary shaft 334, rotates through about 2 degrees clockwise. Namely, the rotary shaft 334, the lever stopper 333 and the torsional coil spring 336 integrally rotate through about 2 degrees clockwise. Along with this operation, gaps of approximately 5 mm to 6 mm can be formed between the tenth sheet P10, the tip E of the trailing end lever 332 and the tip R of the conveying guide 312. That is to say, the rotational allowance of the trailing end lever 332 and the conveying path space are recovered to about 5 mm to 6 mm. Further, distances between the sheet stacking surface 331*b* of the trailing end stopper 331, the tip E of the trailing end lever 332 and the tip R of the conveying guide 312 each become approximately 6 mm to 7 mm. In this state, the eleventh sheet through the twentieth sheet P20 are stacked and aligned in their trailing ends. In the meantime, if the curled sheets exist among these sheets, the floating of the upward-curled sheet is restrained by the trailing end lever 332, while the crest-shaped vertex portion of the downward-curled sheet is restrained by the conveying guide 312. The floating of the largely curled sheet is also well restrained by the reaction of the torsional coil spring 336. When the twentieth sheet P20 is stacked, the rotational allowance of the trailing end lever 332 and the conveying path space become approximately 4 mm to 5 mm.

Figure 29:
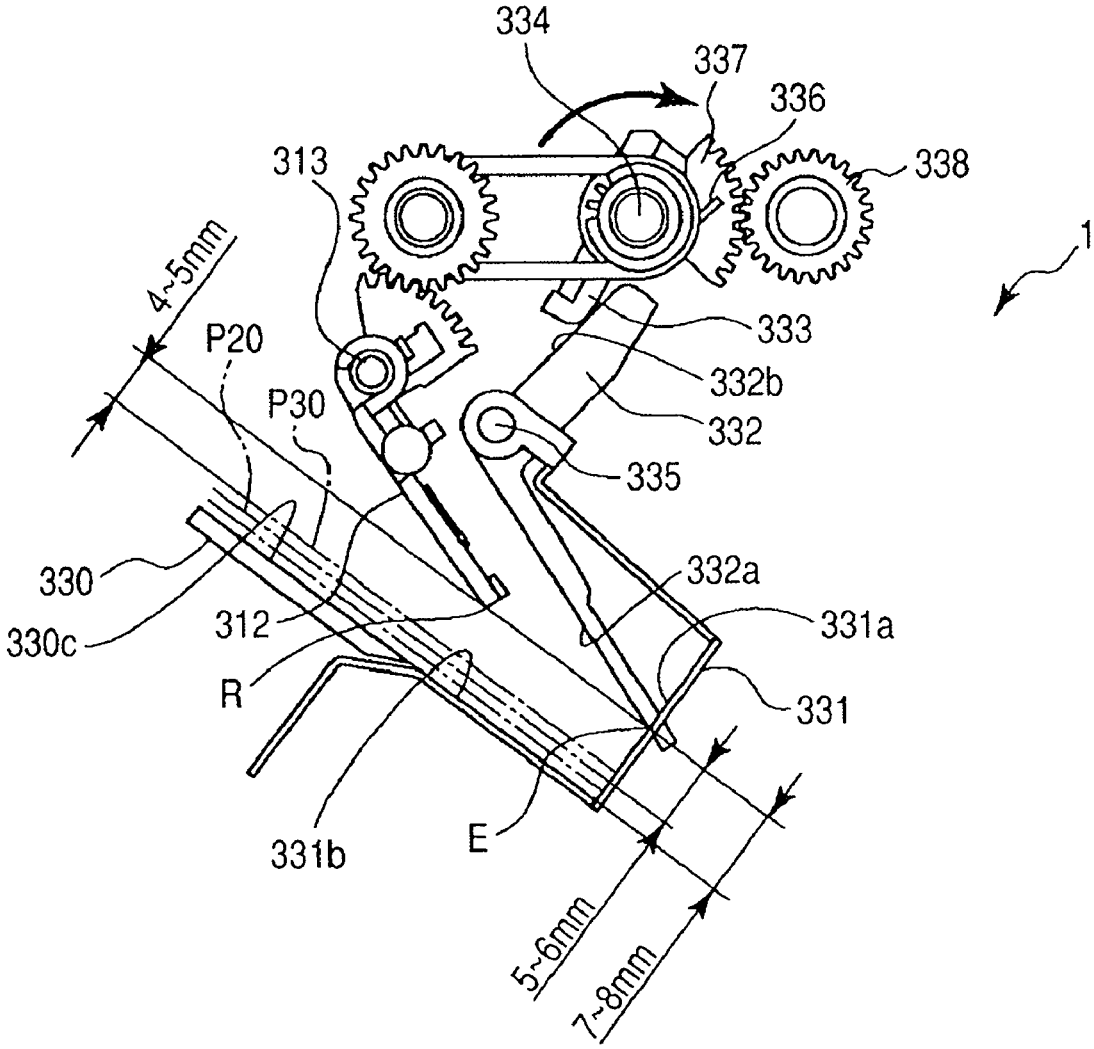
FIG. 29 is an explanatory view of an operation till thirty sheets are stacked in the sheet stacking apparatus in FIG. 27.
Figure 30:
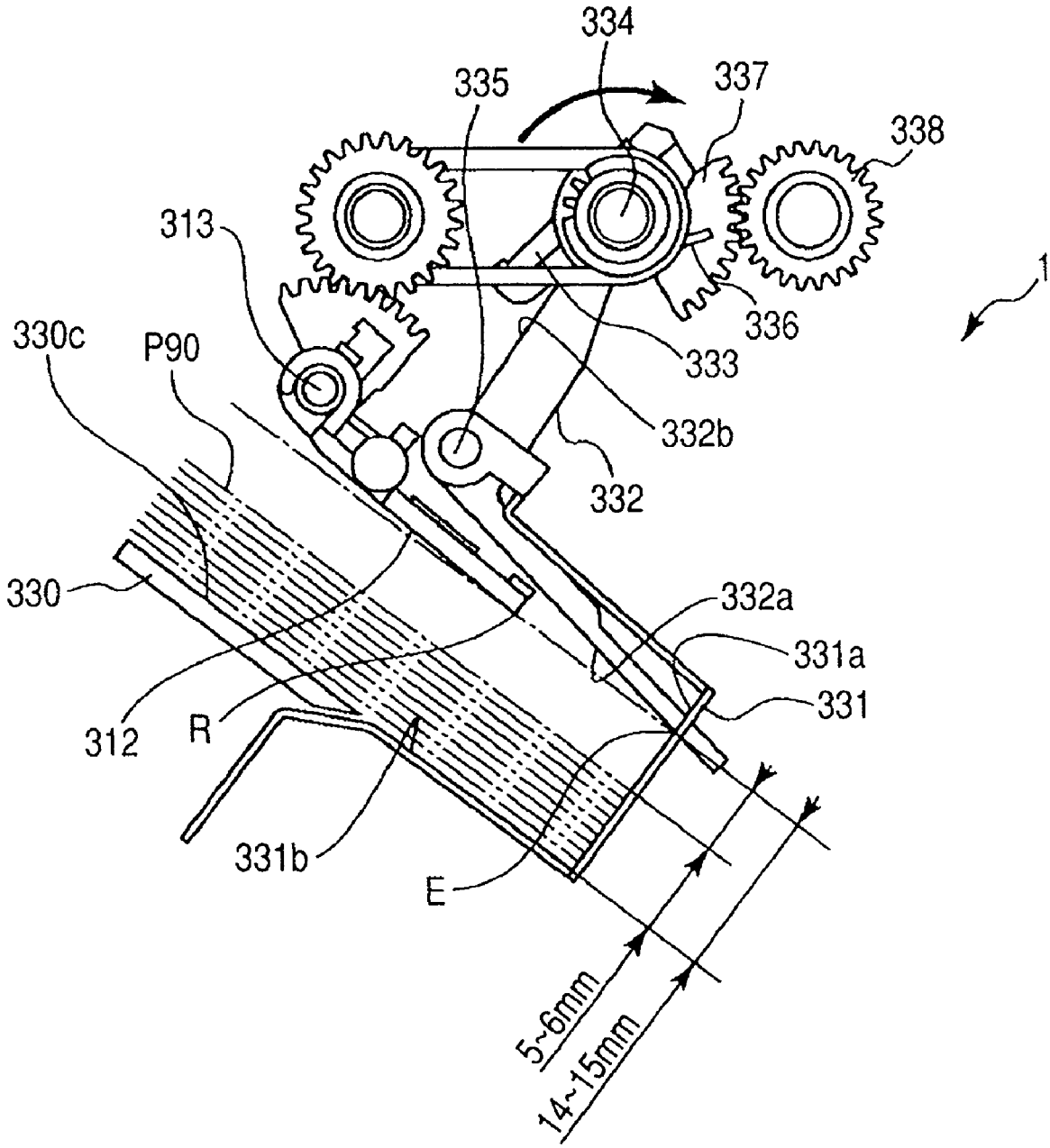
FIG. 30 is an explanatory view of an operation till ninety sheets are stacked in the sheet stacking apparatus in FIG. 27.

Then, as shown in FIG. 29, the rotary shaft 334 is again rotated through about 2 degrees clockwise (in the arrow-headed direction). The lever stopper 333, following up the rotary shaft 334, rotates through approximately 2 degrees clockwise. Namely, the rotary shaft 334, the lever stopper 333 and the torsional coil spring 336 integrally rotate through about 2 degrees clockwise. The rotational allowance of the trailing end lever 332 and the conveying path space are recovered to about 5 mm to 6 mm. The distances between the sheet stacking surface 331*b* of the trailing end stopper 331, the tip E of the trailing end lever 332 and the tip R of the conveying guide 312 each become approximately 7 mm to 8 mm. Then, when the twenty first sheet through the thirtieth sheet P30 are stacked, the rotational allowance of the trailing end lever 332 and the conveying path space become about 4 mm to 5 mm. Then, further, the rotational allowance of the trailing end lever 332 and the conveying path space are recovered to about 5 mm to 6 mm by rotating the rotary shaft 334 and the lever stopper 333 through approximately 2 degrees clockwise. Finally, as illustrated in FIG. 30, when 90 sheets are stacked, a tenth operation of shifting the position of the lever stopper 333 is conducted.

The operations described above are repeated till 100 sheets are stacked on the intermediate process tray 330. Thereafter, the 100 sheets are stapled by the stapling operation of the stapler that will be explained-later on.

Thus, the sheet stacking apparatus 1 can always set the rotational allowance of the trailing end lever 332 and the conveying path space within the range of about 5 mm to 6 mm through about 4 mm to 5 mm, and therefore the sheet can be pressed by substantially the same pressing force and under substantially the same conditions almost irrespective of the sheet stacking height. Moreover, the sheet stacking apparatus 1, in the case of the largely curled sheet, restrains the floating of the sheet by the resilient force of the torsional coil spring 336. For these reasons, the sheet stacking apparatus 1 is capable of reducing a failure of the sheet pullback and a buckling phenomenon that have hitherto been occurred.

Next, a sheet stacking apparatus 1A in a second embodiment will hereinafter be described with reference to FIGS. 31 to 34. Note that the description will be made about such an operation that the trailing end stopper 331 aligns the trailing ends of the sheets when the user sets, for example, a 100-sheet side stitch mode. The sheet stacking apparatus 1A does not include the torsional coil spring 336, wherein the sheets are pressed by the self-weight of the trailing end lever 332. Further, the rotary shaft 334 and the lever stopper 333 are configured into one united body and rotate integrally.

Figure 31A:
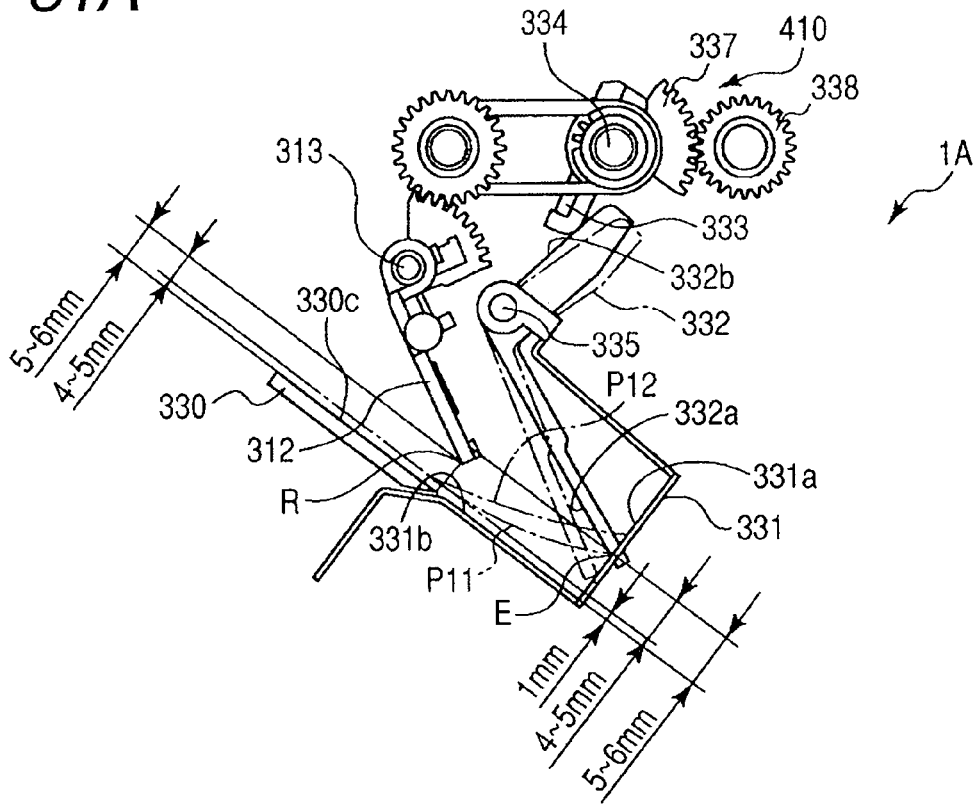
FIG. 31A is an explanatory view of the operation till the ten sheets are attacked in the sheet stacking apparatus in a second embodiment of the present invention, showing a case where the trailing end of the sheet is curled upward.

As shown in FIG. 31A, when none of the sheet P is stacked on the intermediate process tray 330, there are settled an initial upward position of the trailing end lever 332 settled in the initial position of the lever stopper 333 integral with the rotary shaft 334 and regulated in rotation by the lever stopper 333 and also settled an initial upward position of the conveying guide 312. The initial upward positions of the conveying guide 312 and the trailing end lever 332 are set so that gaps of approximately, e.g., 5 mm to 6 mm are formed between the tip R of the conveying guide 312, and the stacking surface 330*c* of the intermediate process tray 330 and the sheet stacking surface 331*b* of the trailing end stopper 331, and between the tip E of the trailing end lever 332, the stacking surface 330*c* of the intermediate process tray 330 and the sheet stacking surface 331*b* of the trailing end stopper 331. Namely, it follows that the trailing end lever 332 has the rotational allowance corresponding just to the gap (approximately 5 mm to 6 mm) between the conveying guide 312 and the sheet stacking surface becomes the conveying path space. The rotational allowance and the conveying path space are provided as the configuration flexible to the curled sheets as described above.

Thus, in a state where the regulating position of the trailing end lever 332 is set in the initial regulating position, when the sheet is not stacked on the intermediate process tray 330, the trailing end lever 332-rotates rightward by its self-weight, the tip E abuts on the sheet stacking surface 331*b* of the trailing end stopper 331, and the abutting portion 332*b* separates from the lever stopper 333. Namely, a clearance occurs between the trailing end lever 332 and the lever stopper 333.

The sheet, when sliding on the stacking surface 330*c* of the intermediate process tray 330 and abutting on the support surface 331*a* of the trailing end stopper 331, pushes up the trailing end lever 332 to a degree corresponding to a thickness of the sheet. When the ten sheets are stacked on the intermediate process tray 330, supposing that each sheet is approximately 0.1 mm in thickness, the sheet stacking height becomes approximately 1 mm, and the trailing end lever 332 rotates leftward to a degree corresponding to the sheet stacking height. As a result, gaps of about 4 mm to 5 mm are formed between the tip E of the trailing end lever 332, the tip R of the conveying guide 312 and the tenth sheet. Namely, each of the rotational allowance of the trailing end lever 332 and the conveying path space comes to have a value of approximately 4 mm to 5 mm. This rotational allowance is provided for, when a sheet P11 with its trailing end curled upward is fed in, receiving this upward-curled sheet P11 without causing any paper jam, and for restraining upward floating of the sheet. If the sheet is a curled sheet P12 causing the trailing end lever 332 to rotate more than the rotational allowance of the trailing end lever 332, the trailing end lever 332 is regulated in its rotation by the lever stopper 333 and receives this curled sheet P12, and therefore the curled sheet P12 can be pressed by great pressing force.

Figure 31B:
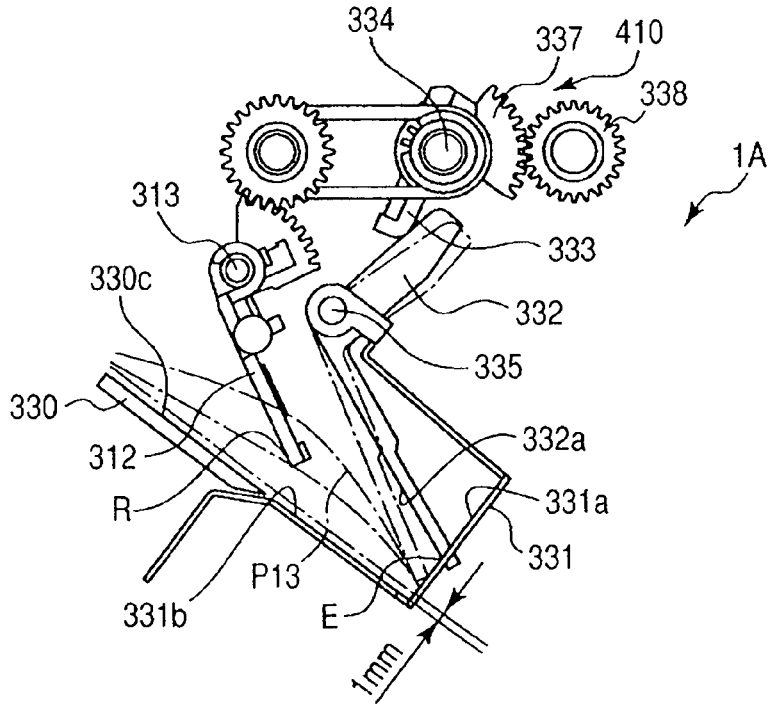
FIG. 31B is an explanatory view showing a case where the middle portion of the sheet is curled upward.

Further, as shown in FIG. 31B, the conveying path space between the tip R of the conveying guide 312 and the tenth sheet serves to, when a sheet P13 with its trailing end curled downward is fed in, convey the downward-curled sheet P13 toward the trailing end stopper 331 while restraining a crest-shaped vertex portion of the middle portion of the downward-curled sheet P13 and to align this sheet P13. The stiffness of the sheet in the delivery direction is increased by flattening the sheet, whereby the property of alignment with the support surface 331*a* of the trailing end stopper 331 can be enhanced.

In the manner described above, the sheet, whether curled upward or downward, abuts in a good state on the trailing end stopper 331, thereby aligning the trailing end of the sheet.

Figure 32:
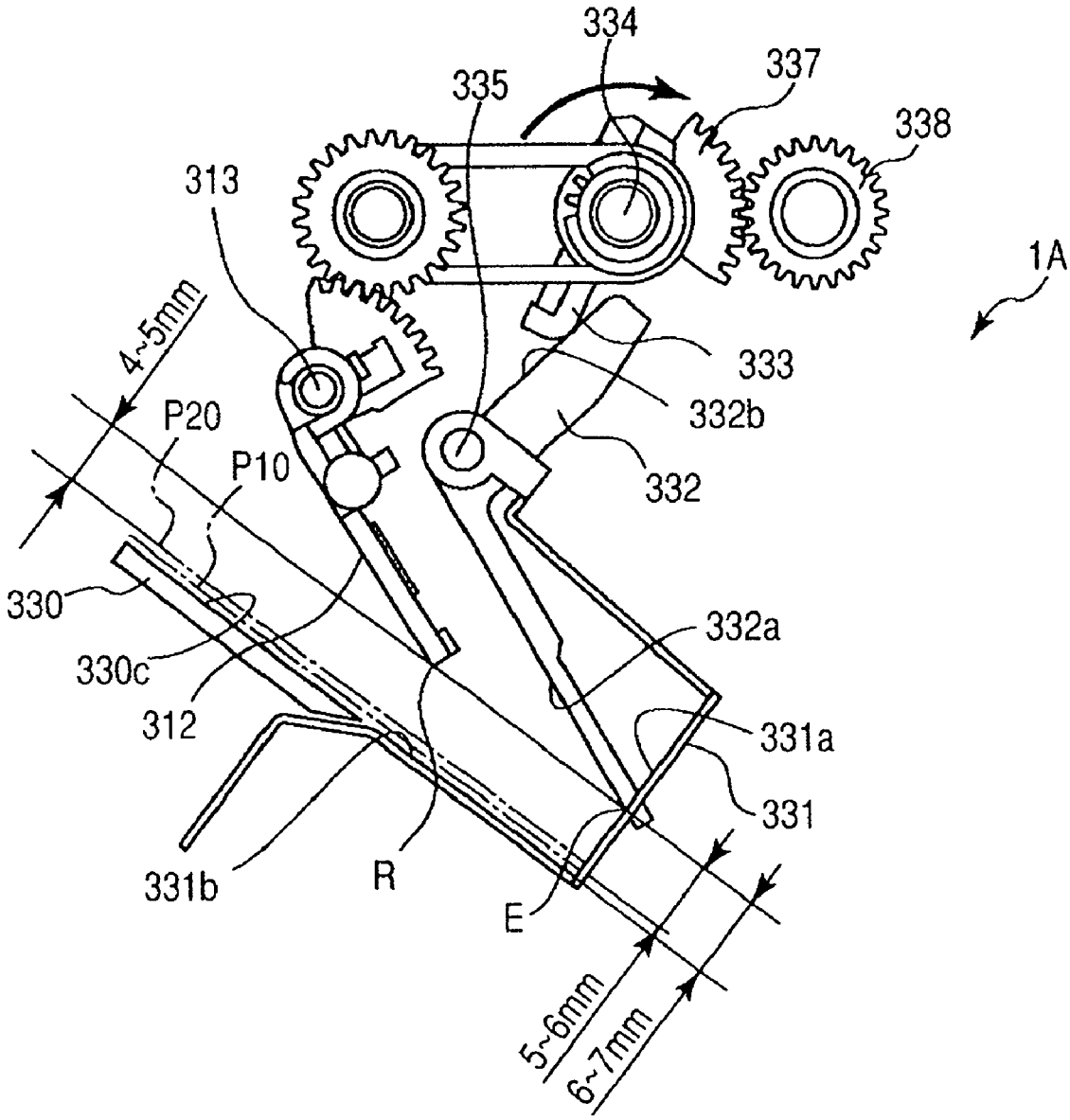
FIG. 32 is an explanatory view of an operation till twenty sheets are stacked in the sheet stacking apparatus in FIG. 31.

When finishing the abutting alignment of the tenth sheet, as shown in FIG. 32, the rotary shaft 334 and the lever stopper 333 are rotated through approximately 2 degrees clockwise (in the arrow-headed direction). Along with this operation, the gaps of approximately 5 mm to 6 mm can be formed between the tenth sheet P10, the tip R of the conveying guide 312 and the tip E of the trailing end lever 332. That is to say, the rotational allowance of the trailing end lever 332 and the conveying path space are recovered to about 5 mm to 6 mm. Further, the distance between the sheet stacking surface 331*b* of the trailing end stopper 331 and the tip E of the trailing end lever 332 becomes approximately 6 mm to 7 mm. In this state, the eleventh sheet through the twentieth sheet P20 are stacked and aligned in their trailing ends. In the meantime, if the curled sheets exist among these sheets, the floating of the sheet is restrained by the trailing end lever 332. When the twentieth sheet P20 is stacked, the rotational allowance of the trailing end lever 332 and the conveying path space become approximately 4 mm to 5 mm.

Figure 33:
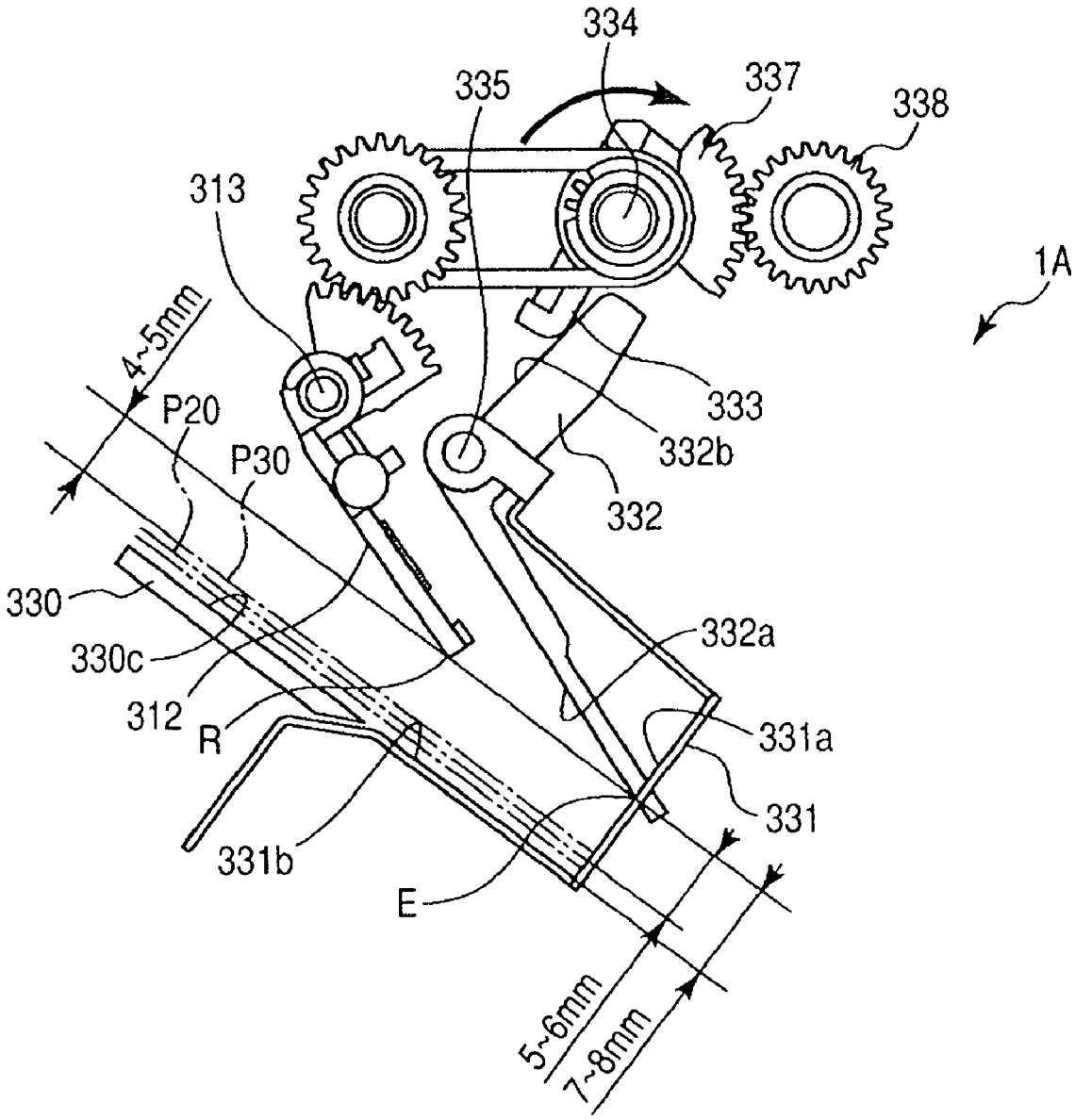
FIG. 33 is an explanatory view of an operation till thirty sheets are stacked in the sheet stacking apparatus in FIG. 31.

Then, as shown in FIG. 33, the rotary shaft 334 and the lever stopper 333 are again rotated through about 2 degrees clockwise (in the arrow-headed direction), whereby the rotational allowance of the trailing end lever 332 and the conveying path space are recovered to approximately 5 mm to 6 mm. The distance between the sheet stacking surface 331*b* of the trailing end stopper 331 and the tip E of the trailing end lever 332 becomes approximately 7 mm to 8 mm. Then, when the twenty first sheet through the thirtieth sheet P30 are stacked, the rotational allowance of the trailing end lever 332 and the conveying path space become about 4 mm to 5 mm. Then, further, the rotational allowance of the trailing end lever 332 and the conveying path space are recovered to about 5 mm to 6 mm by rotating the rotary shaft 334 and the lever stopper 333 through approximately 2 degrees clockwise.

Figure 34:
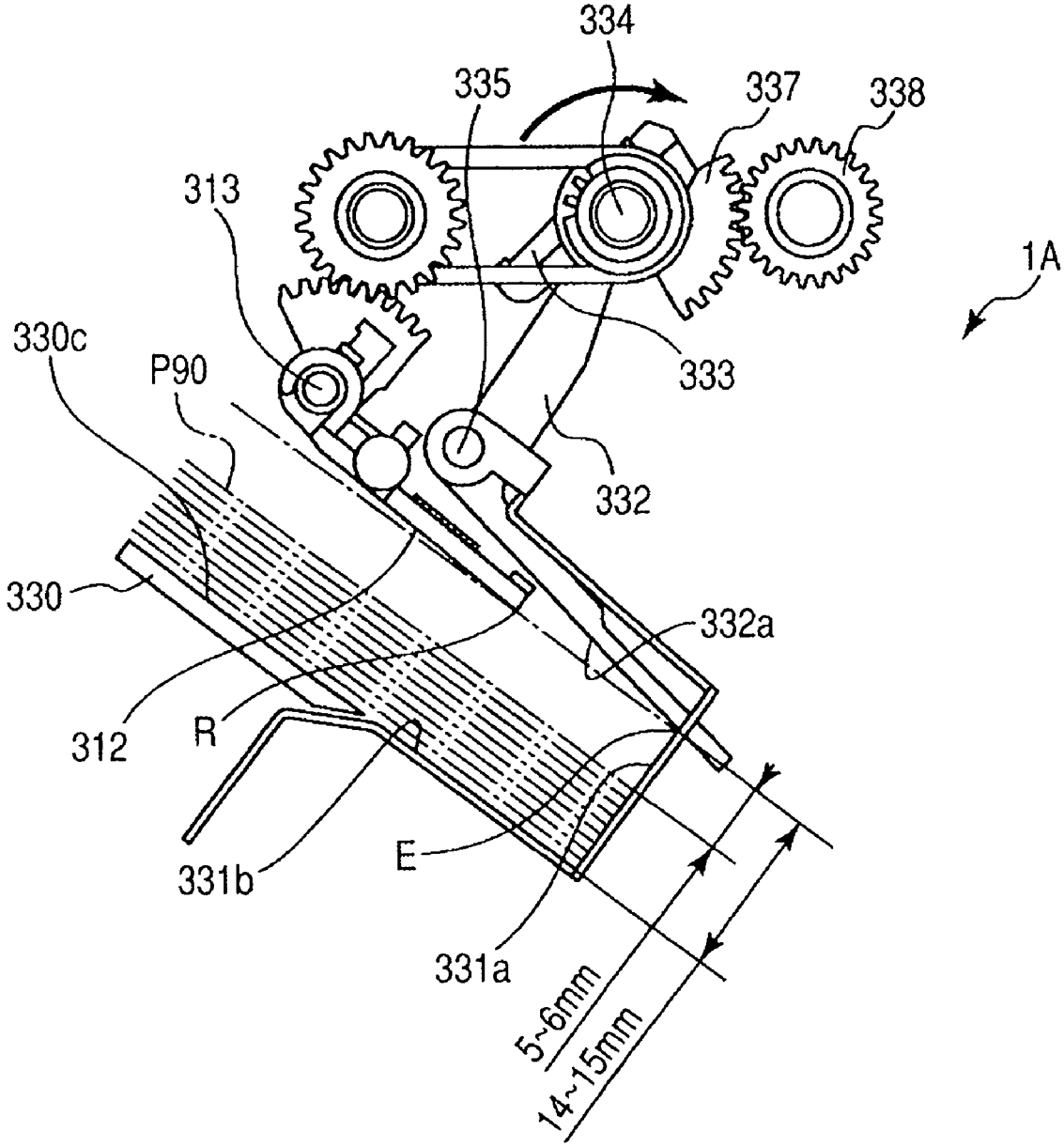
FIG. 34 is an explanatory view of an operation when ninety sheets are stacked in the sheet stacking apparatus in FIG. 31.

The operations described above are repeated till 100 sheets are stacked on the intermediate process tray 330. Finally, when the ninetieth sheet is stacked on the intermediate process tray 330, as shown in FIG. 34, the rotary shaft 334 and the lever stopper 333 are operated. FIG. 31 shows a relationship between the number of the stacked sheets and the positions of the trailing end lever 332 and of the conveying guide 312. Thereafter, the 100 sheets are stapled by the stapling operation of the stapler that will be explained later on.

Thus, the sheet stacking apparatus 1A can always set the rotational allowance of the trailing end lever 332 and the conveying path space between the conveying guide 312 and the stacking surface within the range of about 5 mm to 6 mm through about 4 mm to 5 mm, and therefore the sheet can be pressed by substantially the same pressing force and under substantially the same conditions almost irrespective of the sheet stacking height.

Figure 42:
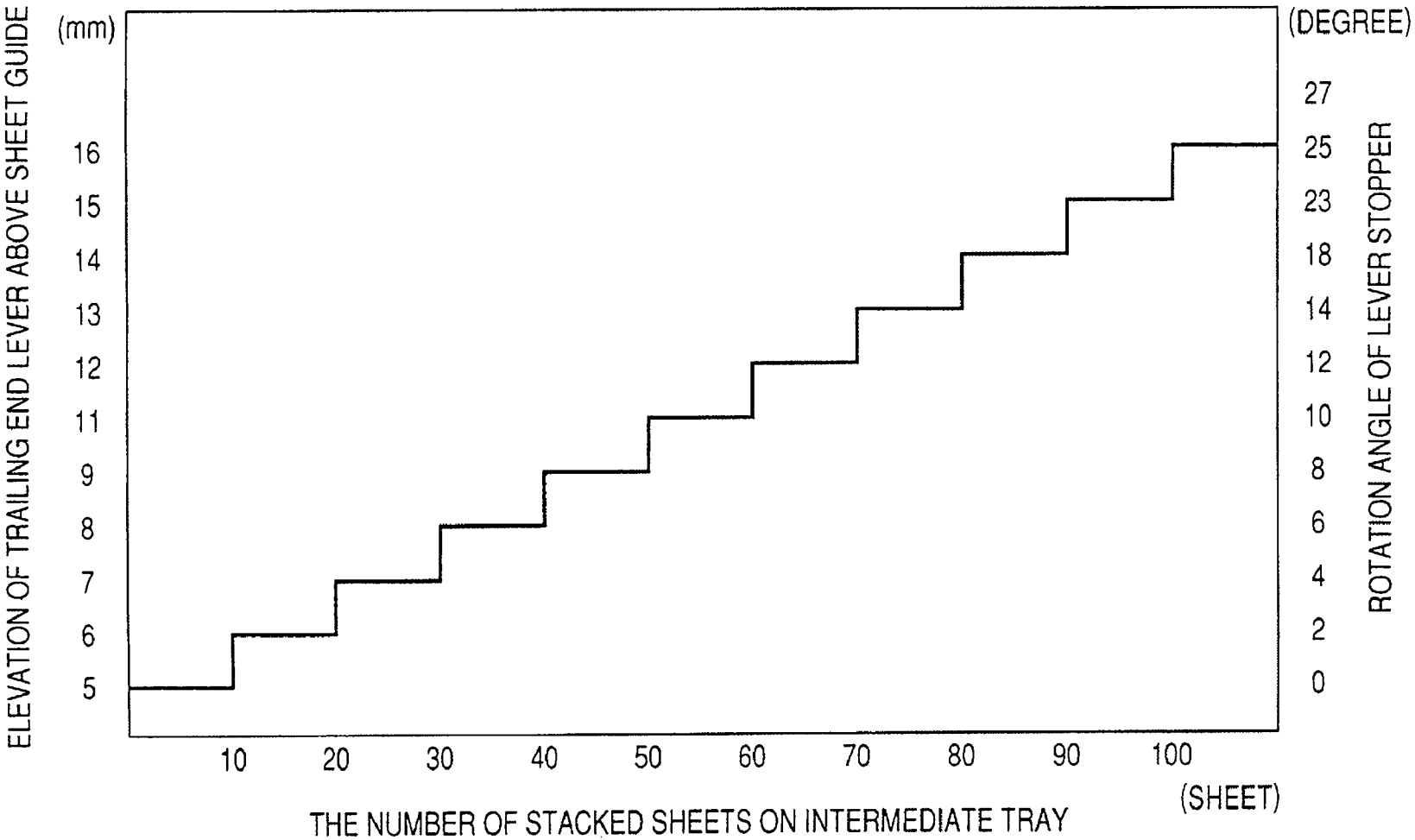
FIG. 42 is a graph showing a relationship between the number of stacked sheets, a position of a trailing end lever and a rotational angle of a lever stopper.

FIG. 42 is a diagram showing a relationship between the number of the sheets stacked (sheet stacking count) on the intermediate process tray 330, a rotational angle of the lever stopper 333 and height positions of the tip E of the trailing end lever 332 and the tip R of the conveying guide 312 in the sheet processing apparatuses 1A, 1. Thus, the sheet processing apparatuses 1A, 1 are invariably capable of keeping, to an optimal clearance, the gap between the trailing end lever 332 and the lever stopper 333 by changing the height of the tip E of the trailing end lever 332 in accordance with the sheet stacking count on the intermediate process tray 330, pressing the sheet always by almost constant pressing force without depending on the sheet stacking count, and reducing the occurrences of the and the that have been the problems inherent in the prior arts.

Further, the sheet stacking apparatus 1 constructed to apply the biasing force of the torsional coil spring 336 to the rotatable lever stopper 333, in the case of the largely upward curled sheet, makes the trailing end lever 332 escape resisting the torsional coil spring 336. This therefore enables a decrease of such a possibility that even the largely upward curled sheet enters while causing the paper jam between the trailing end lever 332 and the intermediate process tray 330. Then, the largely upward curled sheet is restrained from floating by dint of the spring force of the torsional coil spring 336. Besides, the torsional coil spring 336, when adjusting the rotating position of the rotary shaft 334 in accordance with the sheet stacking count, rotates integrally with the rotary shaft 334 and the lever stopper 333, and hence the pressing force of the torsional coil spring 336 pressing the sheet can be made substantially constant, and it is feasible to reduce the possibility that the sheet enters while causing the paper jam between the trailing end lever 332 and the intermediate process tray 330.

It should be noted that in the second embodiment, rotational angular displacement of the lever stopper 333 is done for every ten sheets, however, an angular displacement sheet count and an angular displacement amount may be varied corresponding to the thickness of the aligned sheets, a surface resistance, a type of the transfer image, etc. Moreover, if such control is conducted that a sheet count value is preset and the lever stopper 333 is rotated according to every predetermined sheet count value, there is eliminated a necessity for the setting on the sheet-by-sheet basis, and the complicated control gets unnecessary. For example, FIG. 43 is a table showing the count value per sheet that is set according to the thickness of the sheet and also the angular displacement value of the lever stopper 333. With this contrivance, if the sheets having different thicknesses are mixed in one sheet bundle, the positions of the trailing end lever 332 and the conveying guide 312 can be invariably controlled (adjusted) to the optimal positions.

Note that in the description given above, the sheet stacking surface 331*b* of the trailing end stopper 331 exists on an extension of the stacking surface 330*c* of the intermediate process tray 330, and configures part of the stacking surface of the intermediate process tray.

Figure 35A:
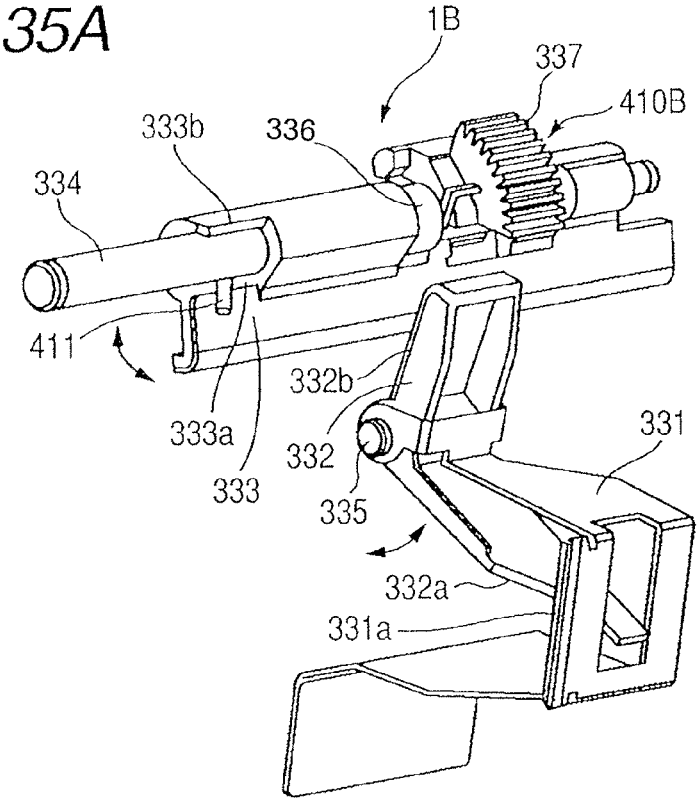
FIG. 35A is a perspective view showing an external configuration of the sheet stacking apparatus in a third embodiment.
Figure 35B:
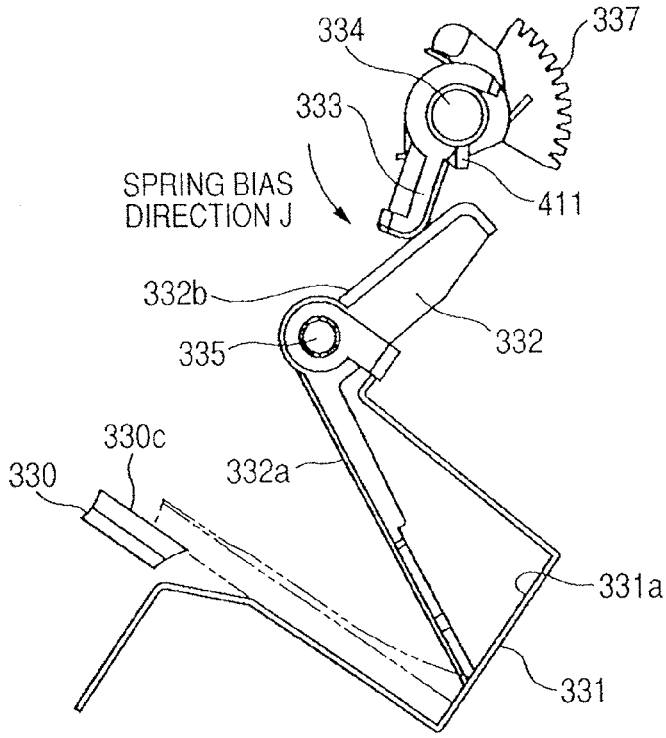
FIG. 35B is a front view thereof.
Figure 36:
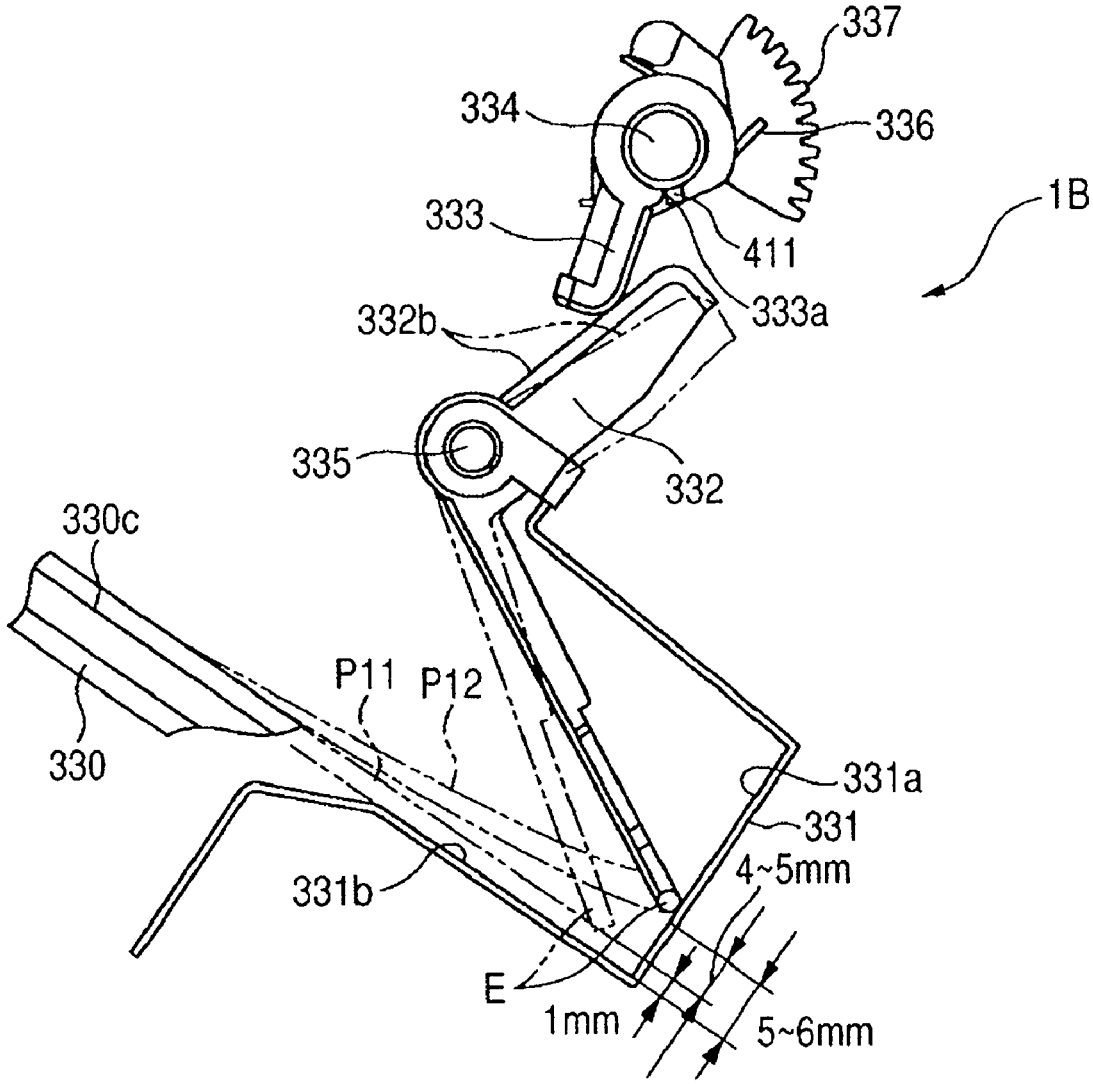
FIG. 36 is an explanatory view of an operation till ten sheets are stacked in the sheet stacking apparatus in the third embodiment of the present invention.

Next, a sheet stacking apparatus 1B in a third embodiment will be explained with reference to FIGS. 35 to 39. The sheet stacking apparatus 1B in the third embodiment has such a configuration that the conveying guide 312 and the support shaft 313 are omitted from the sheet stacking apparatus 1A in the second embodiment. Explained is an operation in which the trailing end stopper 331 aligns the trailing ends of the sheets when the user sets, e.g., the 100-sheet side stitch mode. It is to be noted that the sheet stacking apparatus 1B in the third embodiment has the torsional coil spring 336 as illustrated in FIGS. 35 and 36. The lever stopper 333 is rotatably provided at the rotary shaft 334. The lever stopper 333 is, however, made to abut on the protruded piece 411 by the torsional coil spring 336, thereby regulating the rotation of the lever stopper 333. The torsional coil spring 336, of which one end is provided at the lever stopper 333 and the other end is provided at the rotary shaft 334, rotates integrally with the rotary shaft 334 and the lever stopper 333 in the rotating direction. In the sheet stacking apparatus 1B also, the sheets are pressed by the self-weight of the trailing end stopper 331. A gear 337 configures an adjusting mechanism 410B.

In the present sheet stacking apparatus 1B, after trailing end lever 332 has abutted on the lever stopper 333, the lever stopper 333 rotates resisting the torsional coil spring 336.

As shown in FIG. 36, when none of the sheet P is stacked on the intermediate process tray 330, the rotary shaft 334 stops rotating in an initial position. The lever stopper 333 is rotationally biased (energized) by the torsional coil spring 336 and received by the protruded piece 411 protruding from on the rotary shaft 334, thus regulating the rotation of the lever stopper 333 in the initial position.

Such setting is done that a gap of, e.g., approximately 5 mm to 6 mm is formed between the tip E of the trailing end lever 332 and the sheet stacking surface 331*b* of the trailing end stopper 331 when the trailing end lever 332 abuts on the lever stopper 333. Namely, it follows that the trailing end lever 332 has the rotational allowance corresponding to a value (approximately 5 mm to 6 mm) of the gap.

When the sheets are not stacked on the intermediate process tray 330, the trailing end lever 332 rotates rightward by dint of the self-weight, then the tip E thereof abuts on the sheet stacking surface 331*b* of the trailing end stopper 331, and the abutting portion 332*b* gets apart from the lever stopper 333. Namely, a clearance is formed between the trailing end lever 332 and the lever stopper 333.

The sheet, when sliding on the stacking surface 330*c* of the intermediate process tray 330 and abutting on the support surface 331*a* of the trailing end stopper 331, pushes up the trailing end lever 332 to a degree corresponding to a thickness of the sheet. When the ten sheets are stacked on the intermediate process tray 330, supposing that each sheet is approximately 0.1 mm in thickness, the sheet stacking height becomes approximately 1 mm, and the trailing end lever 332 rotates leftward to a degree corresponding to the sheet stacking height. This rotational allowance is provided for, when the sheet P11 with its trailing end curled upward is fed in, receiving this curled sheet P11 without causing any paper jam, and for restraining the sheet from floating. If the sheet is the curled sheet P12 causing the trailing end lever 332 to rotate more than the rotational allowance of the trailing end lever 332, the curled sheet P12 pushes up and makes the trailing end lever 332 abut on the lever stopper 333, thereby forcing the lever stopper 333 to rotate resisting the torsional coil spring 336 in such a right direction as to separate from the protruded piece 411. The curled sheet P12 acts to force the trailing end lever 332 and the lever stopper 333 to rotate resisting the torsional coil spring 336, and hence the floating can be restrained by reaction of the torsional coil spring 336. In the manner described above, the sheet, even if curled, abuts on the trailing end stopper 331, thereby preferably aligning the trailing end of the sheet.

Figure 37:
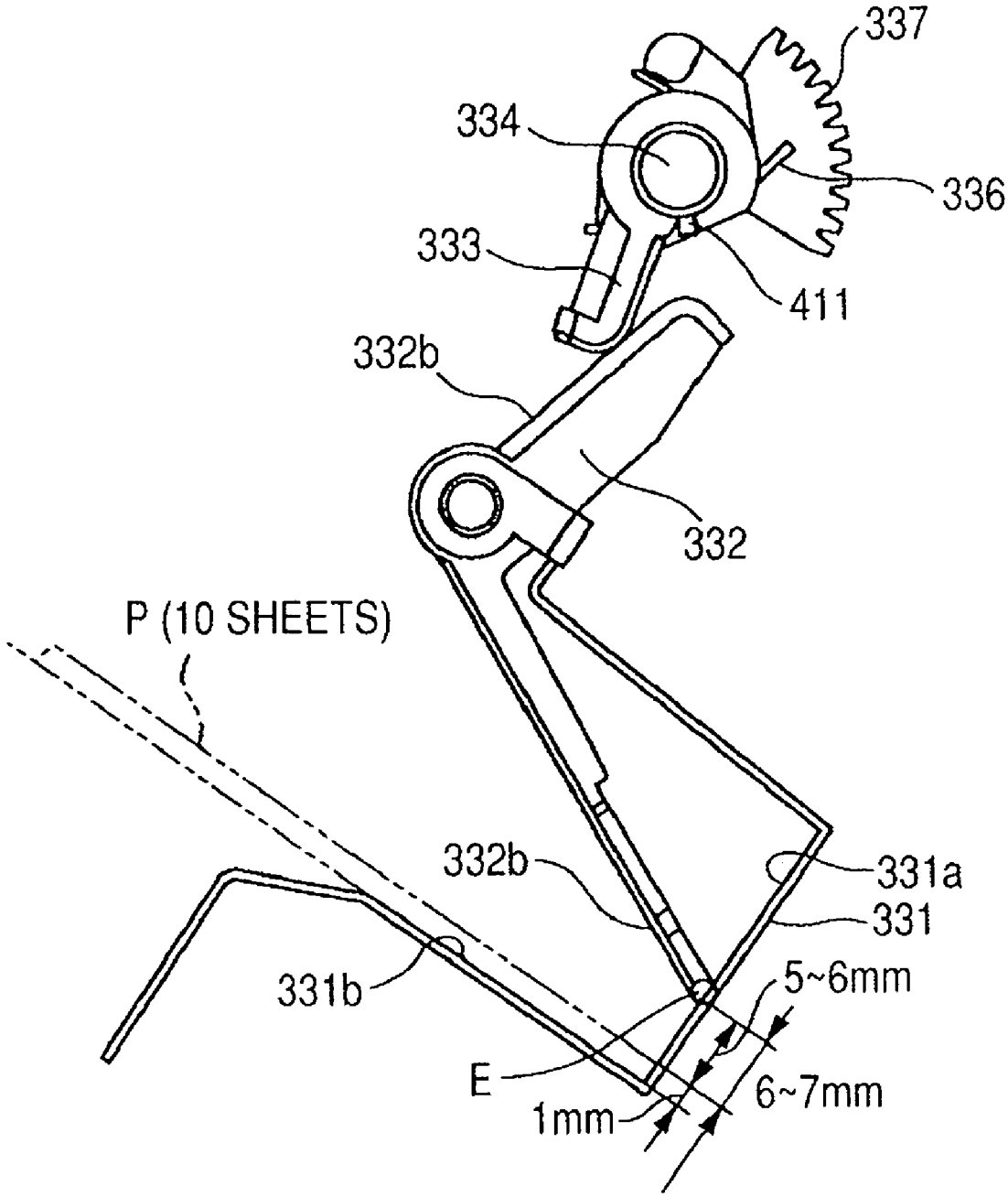
FIG. 37 is an explanatory view of an operation when ten sheets are stacked in the sheet stacking apparatus in FIG. 36.

When finishing the abutting alignment of the tenth sheet, as shown in FIG. 37, the rotary shaft 334 is rotated through approximately 2 degrees rightward. The lever stopper 333, following up the rotary shaft 334, rotates through about 2 degrees leftward. Namely, the rotary shaft 334, the lever stopper 333 and the torsional coil spring 336 integrally rotate through about 2 degrees rightward. Along with this operation, a gap of approximately 5 mm to 6 mm can be formed between the tenth sheet P10 and the tip E of the trailing end lever 332. That is to say, the rotational allowance of the trailing end lever 332 is recovered to about 5 mm to 6 mm. Further, a distance between the sheet stacking surface 331*b* of the trailing end stopper 331 and the tip E of the trailing end lever 332 becomes approximately 6 mm to 7 mm. In this state, the eleventh sheet through the twentieth sheet P20 are stacked and aligned in their trailing ends. In the meantime, if the curled sheets exist among these sheets, the floating of the curled sheet is restrained by the trailing end lever 332. The floating of the largely curled sheet is also well restrained by the reaction of the torsional coil spring 336. When the twentieth sheet P20 is stacked, the rotational allowance of the trailing end lever 332 becomes approximately 4 mm to 5 mm.

Figure 38:
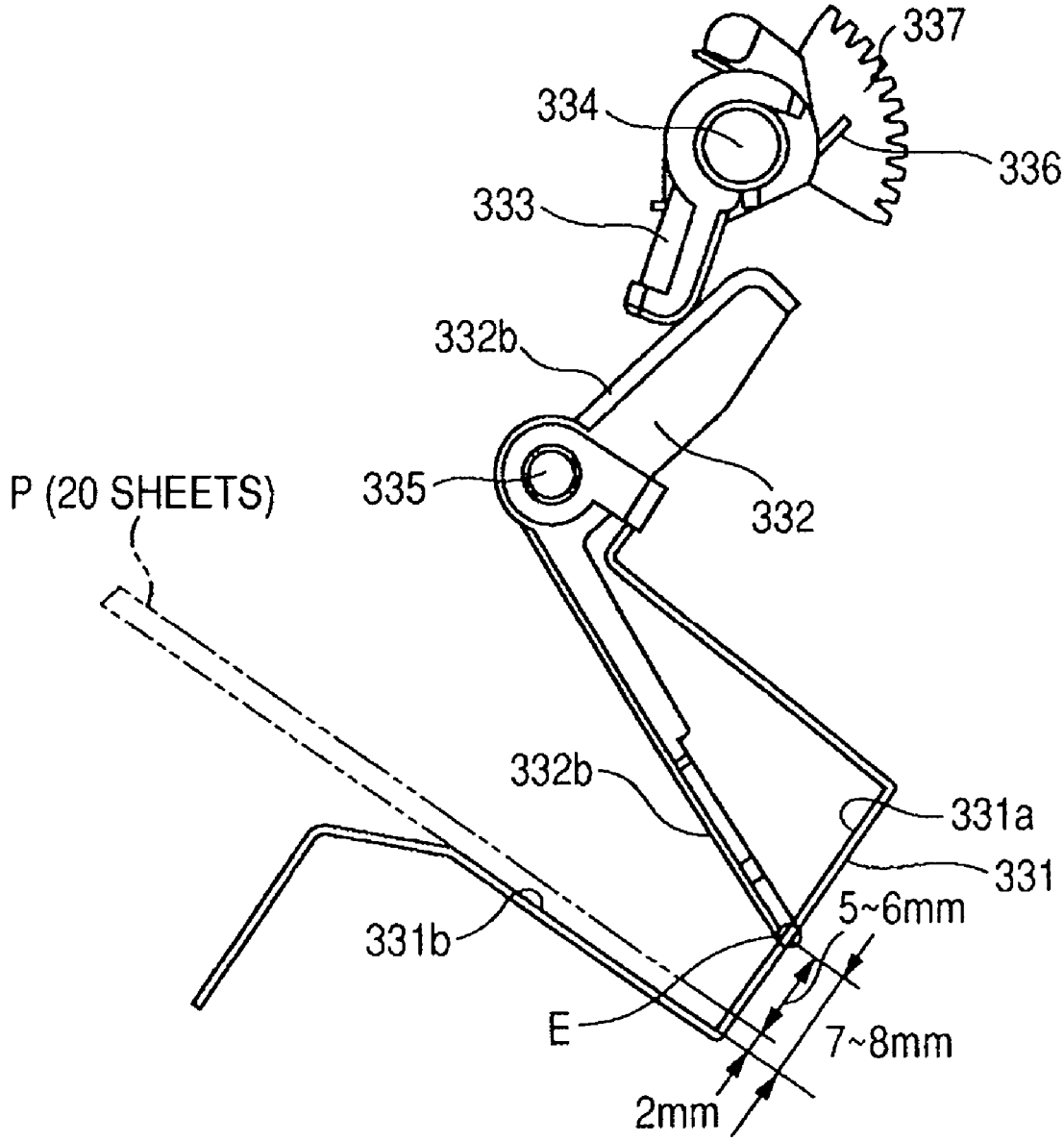
FIG. 38 is an explanatory view of an operation when twenty sheets are stacked in the sheet stacking apparatus in FIG. 36.
Figure 39:
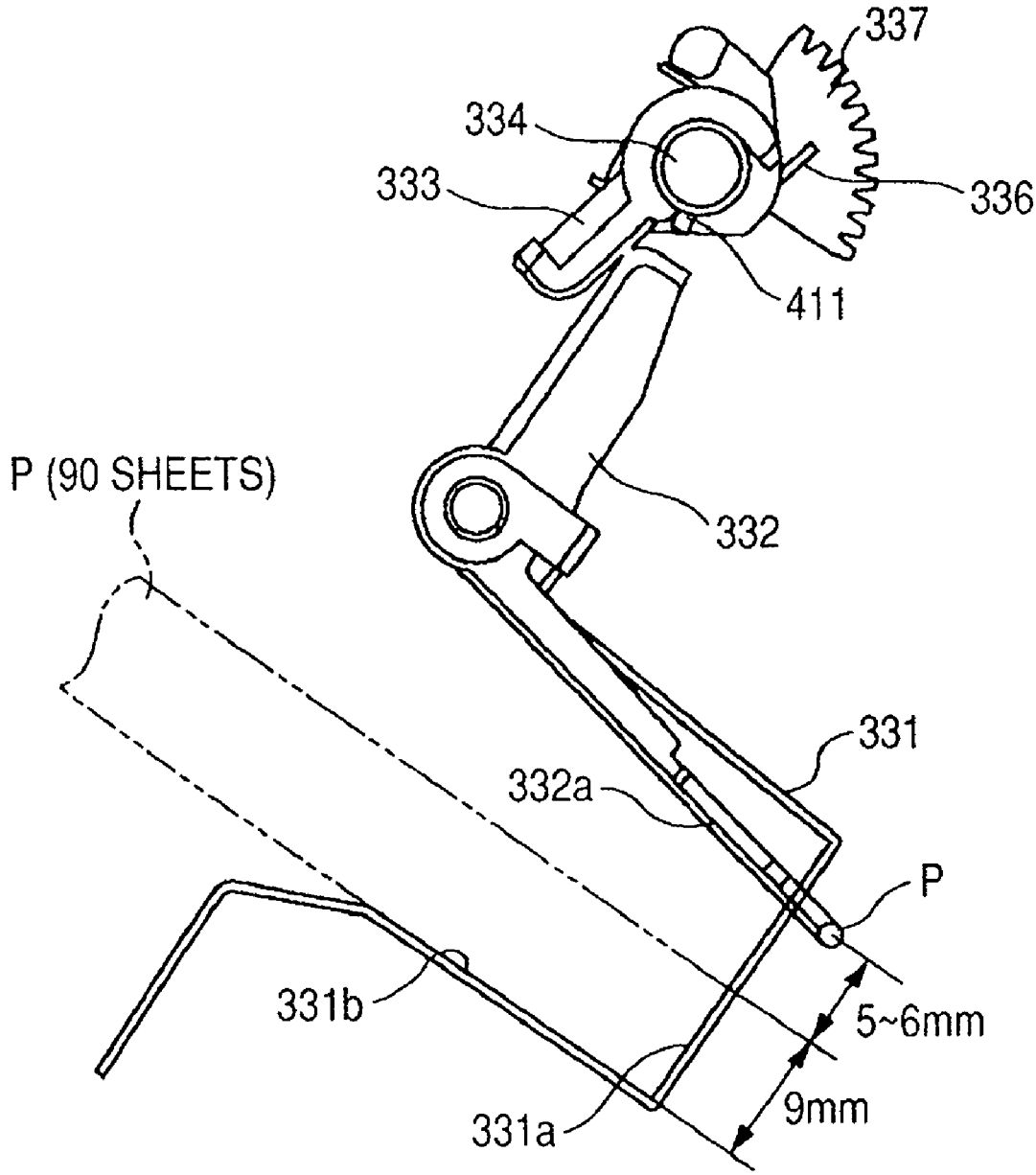
FIG. 39 is an explanatory view of an operation when ninety sheets are stacked in the sheet stacking apparatus in FIG. 36.

Then, as shown in FIG. 38, the rotary shaft 334 is again rotated through about 2 degrees rightward. The lever stopper 333, following up the rotary shaft 334, rotates through approximately 2 degrees leftward. Namely, the rotary shaft 334, the lever stopper 333 and the torsional coil spring 336 integrally rotate through about 2 degrees rightward. The distance between the sheet stacking surface 331*b* of the trailing end stopper 331 and the tip E of the trailing end lever 332 becomes approximately 7 mm to 8 mm. Then, when the twenty first sheet through the thirtieth sheet P30 are stacked, the rotational allowance of the trailing end lever 332 becomes about 4 mm to 5 mm. Then, further, the rotational allowance of the trailing end lever 332 is recovered to about 5 mm to 6 mm by rotating the rotary shaft 334 and the lever stopper 333 through approximately 2 degrees rightward. Finally, as illustrated in FIG. 39, when 90 sheets are stacked, the tenth operation of shifting the position of the lever stopper 333 is conducted.

The operations described above are repeated till 100 sheets are stacked on the intermediate process tray 330. Thereafter, the 100 sheets are stapled by the stapling operation of the stapler that will be explained later on.

Thus, the sheet stacking apparatus 1B can always set the rotational allowance of the trailing end lever 332 within the range of about 5 mm to 6 mm through about 4 mm to 5 mm, and therefore the sheet can be pressed by substantially the same pressing force and under substantially the same conditions almost irrespective of the sheet stacking height. Moreover, the sheet stacking apparatus 1B, in the case of the largely curled sheet, restrains the floating of the sheet by the resilient force of the torsional coil spring 336. For these reasons, the sheet stacking apparatus 1B is capable of reducing the failure of the sheet pullback and the buckling phenomenon that have hitherto been occurred.

Figure 40:
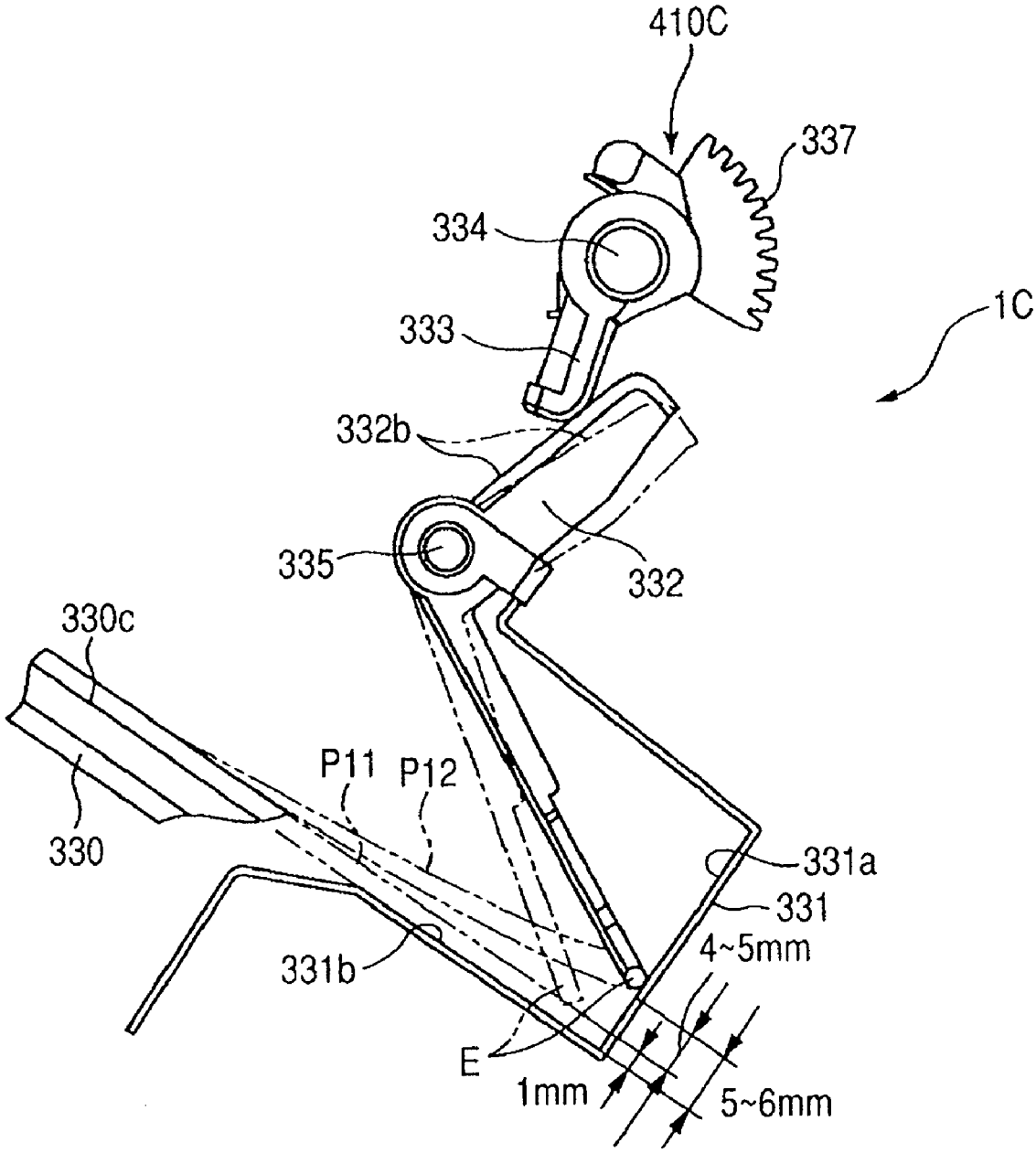
FIG. 40 is an explanatory view of an operation when ten sheets are stacked in the sheet stacking apparatus in a fourth embodiment of the present invention.

Next, a sheet stacking apparatus 1C in a fourth embodiment will hereinafter be described with reference to FIGS. 40 and 41. An operation that the trailing end stopper 331 aligns the trailing ends of the sheets when the user sets, for example, the 100-sheet side stitch mode, will be explained. It should be noted that the sheet stacking apparatus 1C according to the fourth embodiment does not include, as shown in FIG. 40, the torsional coil spring 336 in the sheet stacking apparatus 1B according to the third embodiment, wherein the sheets are pressed by the self-weight of the trailing end lever 332. Further, the rotary shaft 334 and the lever stopper 333 are configured into one united body and rotate integrally. Note that in the sheet stacking apparatus 1C, the lever stopper 333 receives the rotation of the trailing end lever 332 and thus hinders the rotation thereof. Moreover, the gear 337 configures an adjusting mechanism 410C.

As shown in FIG. 40, when none of the sheet P is stacked on the intermediate process tray 330, there is settled an initial upper limit position of the trailing end lever 332 settled in the initial position of the lever stopper 333 integral with the rotary shaft 334 and regulated in rotation by the lever stopper 333. The initial upper limit position of the trailing end lever 332 is set so that a gap of approximately, e.g., 5 mm to 6-mm is formed between the tip E of the trailing end lever 332 and the sheet stacking surface 331*b* of the trailing end stopper 331. Namely, it follows that the trailing end lever 332 has the rotational allowance corresponding just to the gap (approximately 5 mm to 6 mm). The rotational allowance is provided as the configuration flexible to the curled sheets as described above.

Thus, in a state where the upper limit position of the trailing end lever 332 is adjusted to the initial upper limit position, when the sheet is not stacked on the intermediate process tray 330, the trailing end lever 332 rotates rightward by its self-weight, the tip E abuts on the sheet stacking surface 331*b* of the trailing end stopper 331, and the abutting portion 332*b* separates from the lever stopper 333. Namely, a clearance occurs between the trailing end lever 332 and the lever stopper 333.

The sheet, when sliding on the stacking surface 330*c* of the intermediate process tray 330 and abutting on the support surface 331*a* of the trailing end stopper 331, pushes up the trailing end lever 332 to a degree corresponding to a thickness of the sheet. When the ten sheets are stacked on the intermediate process tray 330, supposing that each sheet is approximately 0.1 mm in thickness, the sheet stacking height becomes approximately 1 mm, and the trailing end lever 332 rotates leftward to a degree corresponding to the sheet stacking height. As a result, a gap of about 4 mm to 5 mm is formed between the tip E of the trailing end lever 332 and the tenth sheet. Namely, the rotational allowance of the trailing end lever 332 comes to have a value of approximately 4 mm to 5 mm. This rotational allowance is provided for, when the sheet P11 with its trailing end curled is fed in, receiving this curled sheet P11 without causing any paper jam, and for restraining the floating of the sheet. If the sheet is a curled sheet P12 causing the trailing end lever 332 to rotate more than the rotational allowance of the trailing end lever 332, the trailing end lever 332 is regulated in its rotation by the lever stopper 333 and receives this curled sheet P12, and therefore the curled sheet P12 can be pressed by great pressing force. In the manner described above, the sheet, even if curled, abuts in a good state on the trailing end stopper 331, thereby aligning the trailing end of the sheet.

Further, as shown in FIG. 31B, the conveying path space between the tip R of the conveying guide 312 and the tenth sheet serves to, when a sheet P13 with its trailing end curled downward is fed in, convey the downward-curled sheet P13 toward the trailing end stopper 331 while restraining a crest-shaped vertex portion of the middle portion of the downward-curled sheet P13 and to align this sheet P13. The stiffness of the sheet in the delivery direction is increased by flattening the sheet, whereby the property of alignment with the support surface 331*a* of the trailing end stopper 331 can be enhanced.

In the manner described above, the sheet, whether curled upward or downward, abuts in a good state on the trailing end stopper 331, thereby aligning the trailing end of the sheet.

Figure 41:
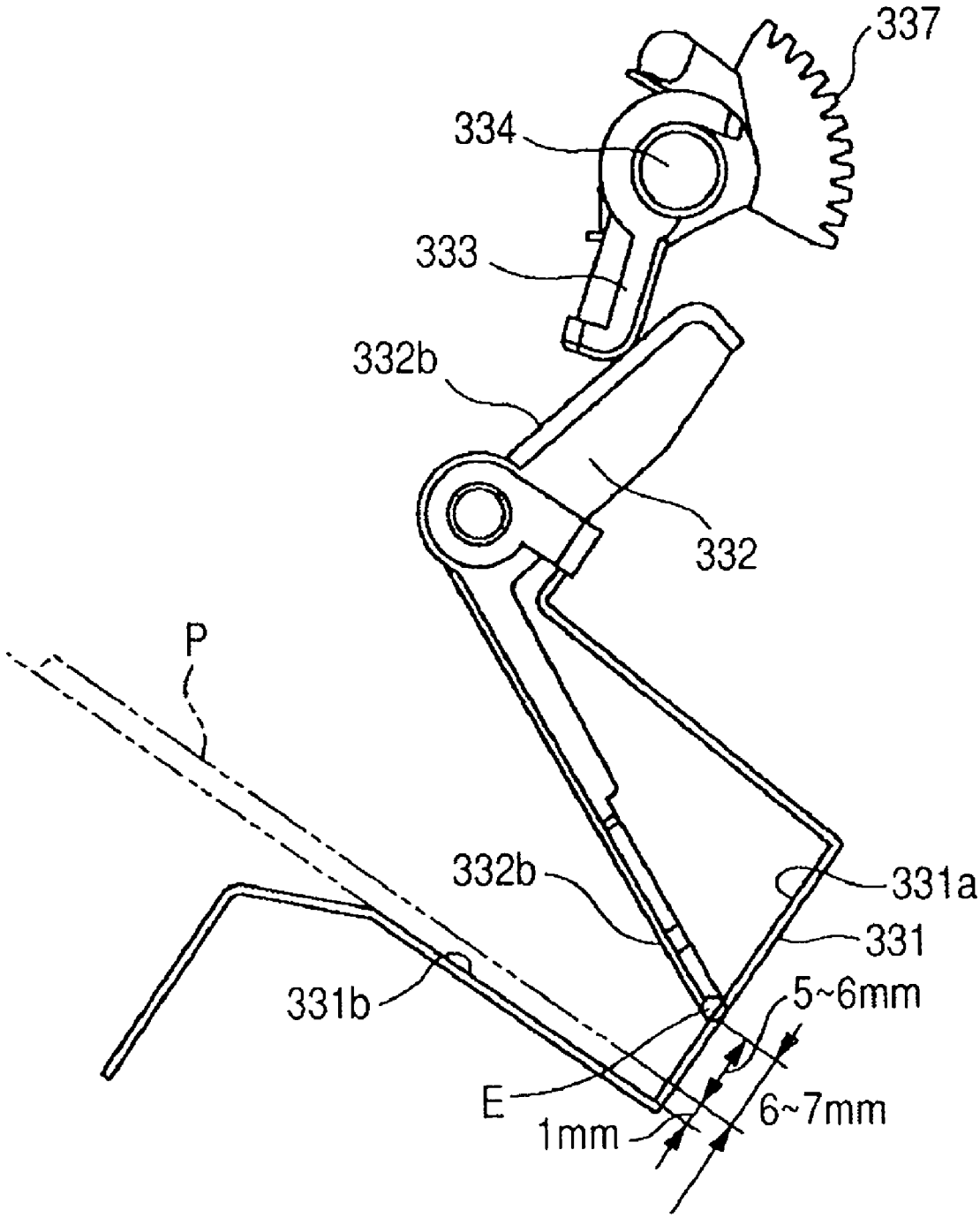
FIG. 41 is an explanatory view of an operation when ten sheets are stacked in the sheet stacking apparatus in FIG. 40.

When finishing the abutting alignment of the tenth sheet, as shown in FIG. 41, the rotary shaft 334 and the lever stopper 333 are rotated through approximately 2 degrees leftward. Along with this operation, the gap of approximately 5 mm to 6 mm can be formed between the tenth sheet and the tip E of the trailing end lever 332. That is to say, the rotational allowance of the trailing end lever 332 is recovered to about 5 mm to 6 mm. Further, the distance between the sheet stacking surface 331*b* of the trailing end stopper 331 and the tip E of the trailing end lever 332 becomes approximately 6 mm to 7 mm. In this state, the eleventh sheet through the twentieth sheet are stacked and aligned in their trailing ends. In the meantime, if the curled sheets exist among these sheets, the floating of the sheet is restrained by the trailing end lever 332. When the twentieth sheet is stacked, the rotational allowance of the trailing end lever 332 becomes approximately 4 mm to 5 mm.

Then, the rotary shaft 334 and the lever stopper 333 are again rotated through about 2 degrees leftward, whereby the rotational allowance of the trailing end lever 332 is recovered to approximately 5 mm to 6 mm. The distance between the sheet stacking surface 331*b* of the trailing end stopper 331 and the tip E of the trailing end lever 332 becomes approximately 7 mm to 8 mm. Then, when the twenty first sheet through the thirtieth sheet are stacked, the rotational allowance of the trailing end lever 332 becomes about 4 mm to 5 mm. Then, further, the rotational allowance of the trailing end lever 332 is recovered to about 5 mm to 6 mm by rotating the rotary shaft 334 and the lever stopper 333 through approximately 2 degrees rightward.

The operations described above are repeated till 100 sheets are stacked on the intermediate process tray 330. FIG. 42 shows a relationship between the sheet stacking count, the position of the trailing end lever 332 and the rotational angle of the lever stopper. Thereafter, the 100 sheets are stapled by the stapling operation of the stapler that will be explained later on.

Thus, the sheet stacking apparatus 1C can always set the rotational allowance of the trailing end lever 332 within the range of about 5 mm to 6 mm through about 4 mm to 5 mm, and therefore the sheet can be pressed by substantially the same pressing force and under substantially the same conditions almost irrespective of the sheet stacking height. Hence, it is possible to reduce the failure of the sheet pullback and the buckling phenomenon that have hitherto been occurred.

FIG. 42 is a diagram showing a relationship between the sheet stacking count on the intermediate process tray 330, the rotational angle of the lever stopper 333 and the height position of the tip E of the trailing end lever 332 in the sheet processing apparatuses 1, 1A, 1B and 1C. Thus, the sheet processing apparatuses 1, 1A, 1B and 1C are invariably capable of keeping, to an optimal clearance, the gap between the trailing end lever 332 and the lever stopper 333 by changing the height of the tip E of the trailing end lever 332 in accordance with the sheet stacking count on the intermediate process tray 330. Further, the sheet processing apparatuses 1, 1A, 1B and 1C are capable of pressing the sheet always by almost constant pressing force without depending on the sheet stacking count, and reducing the occurrences of the [pullback failure] and the [buckling phenomenon] that have been the problems inherent in the prior arts.

Further, the sheet stacking apparatuses 1, 1B constructed to apply the biasing force of the torsional coil spring 336 to the rotatable lever stopper 333, in the case of the largely upward curled sheet, make the trailing end lever 332 escape resisting the torsional coil spring 336. This therefore enables a decrease of such a possibility that even the largely upward curled sheet enters while causing the paper jam between the trailing end lever 332 and the intermediate process tray 330. Then, the largely curled sheet is restrained from floating by dint of the spring force of the torsional coil spring 336. Besides, the torsional coil spring 336, when adjusting the rotating position of the rotary shaft 334 in accordance with the sheet stacking count, rotates integrally with the rotary shaft 334 and the lever stopper 333, and hence the pressing force of the torsional coil spring 336 pressing the sheet can be made substantially constant, and it is feasible to reduce the possibility that the sheet enters while causing the paper jam between the trailing end lever 332 and the intermediate process tray 330.

It should be noted that in the fourth embodiment, the rotational angular displacement of the lever stopper 333 is done for every ten sheets, however, the angular displacement sheet count and then angular displacement amount may be varied corresponding to the thickness of the aligned sheets, the surface resistance, the type of the transfer image, etc. Moreover, if such control is conducted that the sheet count value is preset and the lever stopper 333 is rotated according to every predetermined sheet count value, there is eliminated the necessity for the setting on the sheet-by-sheet basis, and the complicated control gets unnecessary. For example, FIG. 43 is the table showing the count value per sheet that is set according to the thickness of the sheet and also the angular displacement value of the lever stopper 333. With this contrivance, if the sheets having different thicknesses are mixed in one sheet stack, the position of the trailing end lever 332 can be invariably controlled (adjusted) to the optimal position.

Note that in the description given above, the sheet stacking surface 331*b* of the trailing end stopper 331 exists on then extension of the stacking surface 330*c* of the intermediate process tray 330, and configures part of the stacking surface of the intermediate process tray.

The stapling operation will be explained.

The stapler 301 previously stands by in a desired clinch position for the sheet bundle to be aligned and staples the sheet bundle just when completing the delivery of the last sheet P of the sheet bundle and the alignment of the sheet bundle. The stapler 301 moves according as the alignment position of the sheet bundle changes for every sheet bundle corresponding to the offset amount L (see FIG. 26).

When in a one-point stapling mode, in the clinch operation of the stapler 301, after the sheet bundle has been needle-stapled by a predetermined clinch portion, a closing operation of the rocking arm 350 is conducted, and the sheet bundle is delivered by the forward rotations of the sheet-bundle delivery roller pair 380 and is placed (stacked) on the stack tray 622.

The stapler 301, when in a two-point stapling mode, upon finishing the first clinch operation, slide-moves to a second stapling position, and performs again clinching. The rocking arm 350, similarly to the on-point stapling mode, performs the closing operation, and, as the sheet-bundle delivery roller pair 380 rotates in the forward direction, the two-point stapling sheet bundle is delivered to the stack tray 622.

This application claims priorities from Japanese Patent Application Nos. 2005-171720 filed on Jun. 10, 2005, 2005-235556 filed on Aug. 15, 2005, and 2006-096492 filed on Mar. 31, 2006, which are hereby incorporated by reference herein.

What is claimed is:

1. A sheet stacking apparatus comprising:

a sheet stacking portion which stacks a sheet;

a sheet pressing member which presses the sheet on said sheet stacking portion in a pressing position and which is movable upward about an axis by abutting a sheet that is delivered onto said sheet stacking portion;

a regulating member which regulates the upward movement of said sheet pressing member about the axis; and an adjusting mechanism which changes a regulating position where said sheet pressing member is regulated by said regulating member in accordance with a sheet stacking height of the stacked sheets and keeps substantially constant a distance to the regulating position from the pressing position of said sheet pressing member irrespective of the sheet stacking height.

2. A sheet stacking apparatus according to claim 1, further comprising:

a stopper which receives a trailing end of the stacked sheets; and a sheet conveying guide which guides the sheet to said stopper, wherein said sheet pressing member is provided between said sheet conveying guide and said stopper, and a distance between said sheet conveying guide and a sheet stacking surface of said sheet stacking portion is changed in linkage with the change of the regulating position of said sheet pressing member.

3. A sheet stacking apparatus according to claim 2, wherein the sheet pressing position of said sheet pressing member is set in the vicinity of a downstream side of said stopper.

4. A sheet stacking apparatus according to claim 2, wherein said stopper and said sheet pressing member are movable in the direction intersecting the sheet delivery direction.

5. A sheet stacking apparatus according to claim 2, further comprising:

another sheet pressing member which is provided in symmetry with said sheet pressing member in the direction intersecting the sheet delivery direction; and another sheet conveying guide which is provided in symmetry with said sheet conveying guide in the direction intersecting the sheet delivery direction.

6. A sheet stacking apparatus according to claim 5, wherein said sheet pressing member and said sheet conveying guide are driven by the same drive unit, and a distance to the regulating position from the pressing position in which said sheet pressing member presses the sheet and a distance up to an end portion of said conveying guide from a sheet uppermost surface on said sheet stacking portion, are made substantially constant.

7. A sheet stacking apparatus according to claim 1, wherein said regulating member is provided integrally with a rotary shaft rotating corresponding to the sheet stacking height.

8. A sheet stacking apparatus according to claim 1, further comprising:

a biasing member which biases said regulating member toward the regulating position of said sheet pressing member, wherein said sheet pressing member can resist said biasing member and move said regulating member upward.

9. A sheet stacking apparatus according to claim 8, wherein said regulating member is rotatably provided at said rotary shaft rotating corresponding to the sheet stacking height, said biasing member is provided between said regulating member and said rotary shaft so as to bias said regulating member in said regulating position of said sheet pressing member, and said regulating member is regulated in the regulating position of said sheet pressing member by a rotation regulating mechanism which is provided between said rotary shaft and said regulating member.

10. A sheet stacking apparatus according to claim 1, wherein at least said sheet pressing member in said sheet pressing member and said regulating member is movable in a direction intersecting a sheet delivery direction.

11. A sheet processing apparatus which executes processing on a sheet, comprising:

a sheet stacking portion which stacks the sheet;

a sheet pressing member which presses the sheet on said sheet stacking portion in a pressing position and which is movable upward about an axis by abutting a sheet that is delivered onto said sheet stacking portion;

a regulating member which regulates the upward movement of said sheet pressing member about the axis; and an adjusting mechanism which changes a regulating position where said sheet pressing member is regulated by said regulating member in accordance with a sheet stacking height of the stacked sheets and keeps substantially constant a distance to the regulating position from the pressing position of said sheet pressing member irrespective of the sheet stacking height.

12. A sheet processing apparatus according to claim 11, further comprising:

a stopper which receives a trailing end of the stacked sheet; and a sheet conveying guide which guides the sheet to said stopper, wherein said sheet pressing member is provided between said sheet conveying guide and said stopper, and a distance between said sheet conveying guide and a sheet stacking surface of said sheet stacking portion is changed in linkage with the change of the regulating position.

13. A sheet processing apparatus according to claim 11, wherein said regulating member is provided integrally with a rotary shaft rotating corresponding to the sheet stacking height.

14. A sheet processing apparatus according to claim 11, further comprising:

a biasing member which biases said regulating member toward the regulating position of said sheet pressing member, wherein said sheet pressing member can resist said biasing member and move said regulating member upward.

15. A sheet processing apparatus according to claim 11, wherein a moving area of said sheet pressing member is set in a position where said sheet pressing member does not interfere with said binding unit.

16. A sheet processing apparatus according to claim 11, wherein said binding unit is movable in a direction intersecting the sheet delivery direction.

17. An image forming apparatus comprising:

an image forming portion which forms an image on a sheet; and a sheet processing apparatus which executes processing on the sheet on which the image is formed by said image forming portion, said sheet processing apparatus comprising:

a sheet stacking portion which stacks the sheet;

a binding unit which binds the stacked sheets;

a sheet pressing member which presses the sheet on said sheet stacking portion in a pressing position and which is movable upward about an axis by abutting a sheet that is delivered onto said sheet stacking portion;

a regulating member which regulates the upward movement of said sheet pressing member about the axis; and an adjusting mechanism which changes a regulating position where said sheet pressing member is regulated by said regulating member in accordance with a sheet stacking height of the stacked sheets and keeps substantially constant a distance to the regulating position from the pressing position of said sheet pressing member irrespective of the sheet stacking height.

18. An image forming apparatus according to claim 17, further comprising:

a stopper which receives trailing ends of the stacked sheets; and a sheet conveying guide which guides the sheets to said stopper, wherein said sheet pressing member is provided between said sheet conveying guide and said stopper, and a distance between said sheet conveying guide and a sheet stacking surface of said sheet stacking portion is changed in linkage with the change of the regulating position.

19. An image forming apparatus according to claim 17, wherein said regulating member is provided integrally with a rotary shaft rotating corresponding to the sheet stacking height.

20. An image forming apparatus according to claim 17, further comprising:

a biasing member which biases said regulating member toward the regulating position of said sheet pressing member, wherein said sheet pressing member can resist said biasing member and move said regulating member upward.

21. An image forming apparatus comprising:

an image forming portion which forms an image on a sheet;

a sheet stacking portion which stacks the sheet bearing the image formed by said image forming portion;

a sheet pressing member which presses the sheet on said sheet stacking portion in a pressing position and which is movable upward about an axis by abutting a sheet that is delivered onto said sheet stacking portion;

a regulating member which regulates the upward movement of said sheet pressing member about the axis; and an adjusting mechanism which changes a regulating position where said sheet pressing member is regulated by said regulating member in accordance with a sheet stacking height of the stacked sheets and keeps substantially constant a distance to the regulating position from the pressing position of said sheet pressing member irrespective of the sheet stacking height.

22. An image forming apparatus according to claim 21, further comprising:

a stopper which receives trailing ends of the stacked sheets; and a sheet conveying guide which guides the sheets to said stopper, wherein said sheet pressing member is provided between said sheet conveying guide and said stopper, and a distance between said sheet conveying guide and a sheet stacking surface of said sheet stacking portion is changed in linkage with the change of the regulating position.

23. An image forming apparatus according to claim 21, further comprising:

a biasing member which biases said regulating member toward the regulating position of said sheet pressing member, wherein said sheet pressing member can resist said biasing member and move said regulating member upward.

24. A sheet stacking apparatus comprising:

a sheet stacking portion which stacks conveyed sheets;

a sheet pressing member which is movable upward about an axis by abutting the conveyed sheet and which presses the sheets on said sheet stacking portion in a pressing position; and an adjusting mechanism which changes an upper limit position where the upward movement of said sheet pressing member about the axis is regulated, wherein a conveying path space for the conveyed sheet is provided in a gap between the pressing position and the upper limit position, and wherein the adjusting mechanism changes the upper limit position so as to prevent the conveying path space from narrowing by an increase of the sheet stacking height of the stacked sheets.

25. A sheet stacking apparatus according to claim 24, further comprising:

a regulating member which regulates said sheet pressing member in the upper limit position.

* * * * *

UNITED STATES PATENT AND TRADEMARK OFFICE

CERTIFICATE OF CORRECTION

PATENT NO. : 7,419,150 B2
APPLICATION NO. : 11/442322
DATED : September 2, 2008
INVENTOR(S) : Kushida et al.

It is certified that error appears in the above-identified patent and that said Letters Patent is hereby corrected as shown below:

IN THE DRAWINGS:
Sheet No. 41, Figure 43, “TRALING” should read --TRAILING--.

COLUMN 1:
Line 11, “a” should read --an--.
Line 25, “tacking” should read --stacking--.
Line 29, “machine” should read --machine,--.

COLUMN 2:
Line 43, “plurality-of” should read --plurality of--.

COLUMN 7:
Line 16, “pf” should read --of--.

COLUMN 9:
Line 23, “(a” should read --(an--.

COLUMN 10:
Line 51, “angle a” should read --angle α--.

COLUMN 11:
Line 28, “of the of” should read --of--.

COLUMN 17:
Line 24, “theses” should read --these--.

COLUMN 18:
Line 10, “on” should be deleted.
Line 41, “A” should read --An--.
Line 61, “P511” should read --PS11--, and “preparations” should read --preparation--.

COLUMN 19:
Line 29, “a” should read --an--.

UNITED STATES PATENT AND TRADEMARK OFFICE

CERTIFICATE OF CORRECTION

PATENT NO. : 7,419,150 B2
APPLICATION NO. : 11/442322
DATED : September 2, 2008
INVENTOR(S) : Kushida et al.

It is certified that error appears in the above-identified patent and that said Letters Patent is hereby corrected as shown below:

COLUMN 20:
Line 42, “direction-as” should read --direction as--.

COLUMN 21:
Line 45, “explained-later” should read --explained later--.

COLUMN 23:
Line 66, “of the and the” should read --of the [pullback failure] and the [buckling phenomenon]--.

COLUMN 26:
Line 60, “6-mm” should read --6mm--.

COLUMN 29:
Line 20, “according” should read --accordingly--.
Line 33, “on-point” should read --one-point--.

Signed and Sealed this

Twenty-seventh Day of January, 2009

John Doll

JOHN DOLL
*Acting Director of the United States Patent and Trademark Office*